US011542952B2

(12) United States Patent
Suzuki et al.

(10) Patent No.: US 11,542,952 B2
(45) Date of Patent: Jan. 3, 2023

(54) CENTRIFUGAL BLOWER

(71) Applicant: DENSO CORPORATION, Kariya (JP)

(72) Inventors: Yuya Suzuki, Kariya (JP); Sho Kosaka, Kariya (JP); Shuzo Oda, Kariya (JP); Shinichiro Hirai, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/142,949

(22) Filed: Jan. 6, 2021

(65) Prior Publication Data

US 2021/0123451 A1 Apr. 29, 2021

Related U.S. Application Data

(63) Continuation of application No. PCT/JP2019/027552, filed on Jul. 11, 2019.

(30) Foreign Application Priority Data

Jul. 12, 2018 (JP) ..... JP2018-132471
Jul. 8, 2019 (JP) ..... JP2019-127170

(51) Int. Cl.
*F04D 29/28* (2006.01)

(52) U.S. Cl.
CPC ..... *F04D 29/281* (2013.01); *F05D 2240/304* (2013.01); *F05D 2250/51* (2013.01)

(58) Field of Classification Search
CPC ..... F04D 29/281; F04D 29/4206; F04D 29/4213; F04D 29/441; F05D 2250/51
See application file for complete search history.

(56) References Cited

U.S. PATENT DOCUMENTS 3,081,019 A * 3/1963 Freevol ..... F04D 25/166 415/198.1
6,893,218 B2 * 5/2005 Ito ..... F04D 29/083 415/206
8,667,960 B2 * 3/2014 Ausen ..... A62B 18/045 128/201.25

(Continued)

FOREIGN PATENT DOCUMENTS

JP 2003301794 A 10/2003
JP 2004132342 A 4/2004

(Continued)

*Primary Examiner* — Courtney D Heinle
*Assistant Examiner* — Sang K Kim
(74) *Attorney, Agent, or Firm* — Harness, Dickey & Pierce, P.L.C.

(57) ABSTRACT

A centrifugal blower includes a centrifugal fan and a separation cylinder. The centrifugal fan has a separation plate. The separation cylinder is disposed inward of the blades in the radial direction of the centrifugal fan. The separation plate has an inner end surface extending from the one side to the other side in the axial direction at a position of an inner end in the radial direction. The separation cylinder has a separation cylinder end surface extending from the one side to the other side in the axial direction at a position of an end on the other side in the axial direction. A height of one of the separation cylinder end surface and the inner end surface in the axial direction is larger than a height of the other of the separation cylinder end surface and the inner end surface in the axial direction.

9 Claims, 24 Drawing Sheets

(56) References Cited

U.S. PATENT DOCUMENTS

| | | | | |
|---|---|---|---|---|
| 9,127,692 | B2 * | 9/2015 | Goenka | F04D 29/441 |
| 10,421,336 | B2 * | 9/2019 | Vincent | F04D 25/06 |
| 10,723,196 | B2 * | 7/2020 | Wright | F04D 27/005 |
| 2003/0190230 | A1 | 10/2003 | Ito | |
| 2018/0170146 | A1 * | 6/2018 | Hoyle | F04D 25/02 |

FOREIGN PATENT DOCUMENTS

| | | | |
|---|---|---|---|
| JP | 2017227213 | A | 12/2017 |
| JP | 2017538886 | A | 12/2017 |

* cited by examiner

CENTRIFUGAL BLOWER

CROSS REFERENCE TO RELATED APPLICATION

The present application is a continuation application of International Patent Application No. PCT/JP2019/027552 filed on Jul. 11, 2019, which designated the U.S. and claims the benefit of priority from Japanese Patent Application No. 2018-132471 filed on Jul. 12, 2018 and Japanese Patent Application No. 2019-127170 filed on Jul. 8, 2019. The entire disclosures of all of the above applications are incorporated herein by reference.

TECHNICAL FIELD

The present disclosure relates to a centrifugal blower.

BACKGROUND ART

A centrifugal blower is capable of separately drawing two air flows from one side together. The centrifugal blower includes a centrifugal fan that rotates about the fan axis, and a fan case housing the centrifugal fan. The centrifugal blower includes a separation cylinder, a separation plate, and a partition plate to separate the two air flows.

SUMMARY

According to an aspect of the present disclosure, a centrifugal blower includes: a centrifugal fan having a plurality of blades disposed around a fan axis to blow out air drawn from one side in an axial direction of the fan axis outward in a radial direction; and a separation cylinder disposed inward of the blades in the radial direction of the centrifugal fan, the separation cylinder including an opening portion in both sides in the axial direction and having a tubular shape expanding in the radial direction as extended from the one side in the axial direction toward the other side end in the axial direction, to separate an air flow directed toward the centrifugal fan into two air flows. The centrifugal fan has a separation plate provided to intersect each of the plurality of blades. The separation plate has a plate shape extending outward from an inner side in the radial direction, so as to blow out the two air flows separated by the separation cylinder from the centrifugal fan in a state in which the two air flows are separated as air flowing through the one side in the axial direction and air flowing through the other side in the axial direction. The separation plate has an inner end surface extending from the one side to the other side in the axial direction at a position of an inner end in the radial direction. The separation cylinder has a separation cylinder end surface extending from the one side to the other side in the axial direction at a position of the other side end in the axial direction. A height of one of the separation cylinder end surface and the inner end surface in the axial direction is larger than a height of the other of the separation cylinder end surface and the inner end surface in the axial direction.

DESCRIPTION OF EMBODIMENTS

Figure 1:
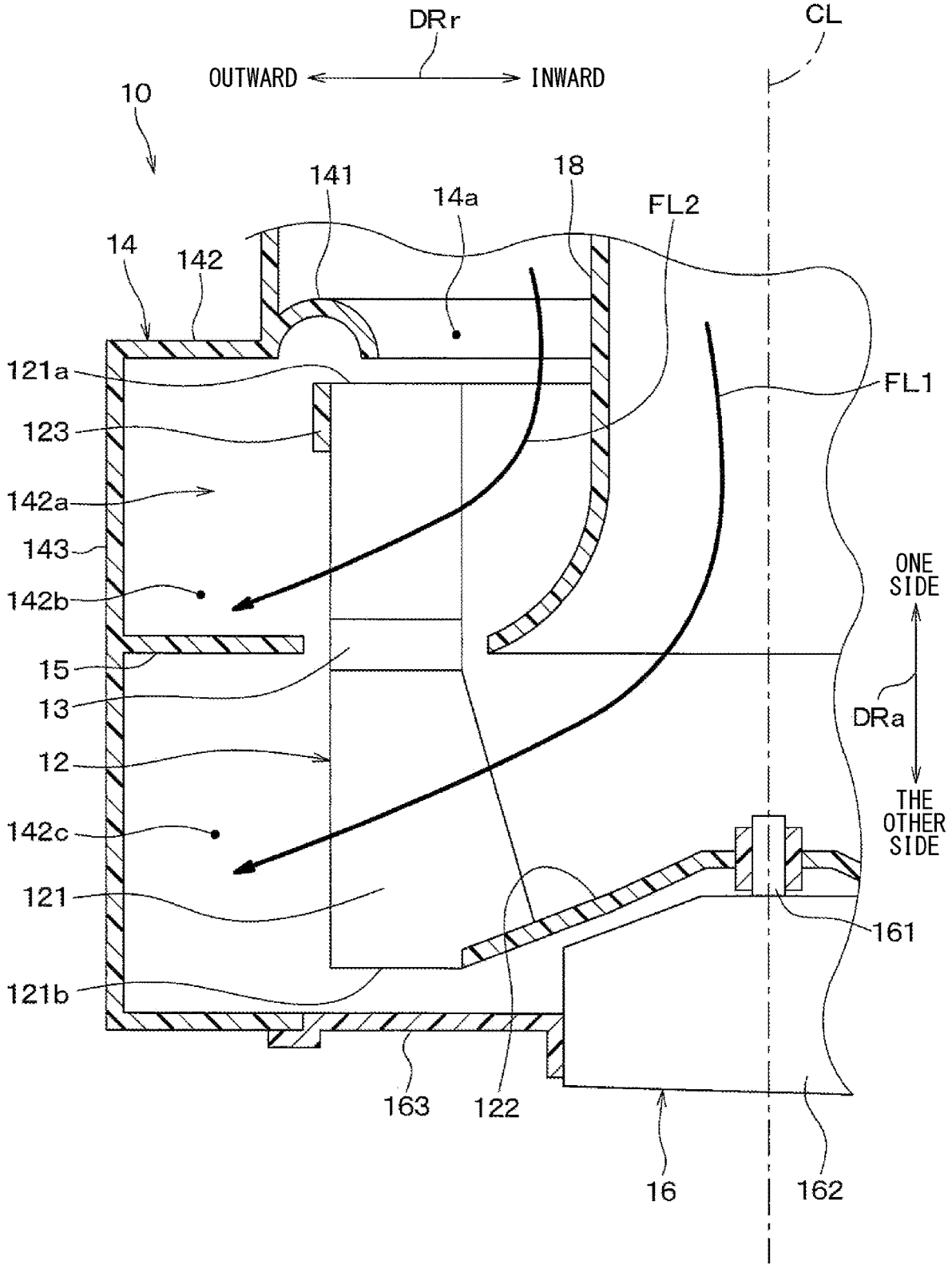
FIG. 1 is a cross-sectional view of a centrifugal blower of a first embodiment.

To begin with, examples of relevant techniques will be described.

A centrifugal blower is applied to a vehicular air conditioner of the inside and outside air two-layer flow type. The centrifugal blower is capable of separately drawing two air flows from one side together. The centrifugal blower includes a centrifugal fan that rotates about the fan axis, and a fan case housing the centrifugal fan. The centrifugal blower includes a separation cylinder, a separation plate, and a partition plate to separate the two air flows.

The separation cylinder is disposed on the radially inner side of the centrifugal fan. The separation cylinder partitions an air passage from an intake port of the fan case to the centrifugal fan into two air passages. The separation plate is provided at blades of the centrifugal fan. The separation plate partitions an air flow passing between the blade and the blade into two air flows. The partition plate is provided in an air passage located around the centrifugal fan inside the fan case. The partition plate partitions the air passage into two air passages.

A position of each fan axis of the separation cylinder, separation plate, and partition plate in the axial direction is set to a position at which the separability of the two air flows can be maintained.

In the centrifugal blower having the above configuration, when components of the centrifugal blower are assembled, a positional deviation in relative positions between the separation cylinder and the separation plate in the axial direction may occur. In this case, the separability of the two air flows cannot be maintained when the relative positional relationship between the two air flows deviates from a range in which the separability of the two air flows can be maintained.

Therefore, it is desirable to increase a range in which the separability of the two air flows can be maintained in the relative positional relationship between the separation cylinder and the separation plate in the axial direction such that the separability can be maintained even though the positional deviation occurs.

Similarly, when components of the centrifugal blower are assembled, a positional deviation in relative positions between the partition plate and the separation plate in the axial direction may occur. In this case, the separability of the two air flows cannot be maintained when the relative positional relationship between the two air flows deviates from a range in which the separability of the two air flows can be maintained.

Therefore, it is desirable to increase a range in which the separability of the two air flows can be maintained in the relative positional relationship between the partition plate and the separation plate in the axial direction such that the separability can be maintained even though the positional deviation occurs.

The present disclosure provides a centrifugal blower capable of increasing a range in which the separability of two air flows can be maintained in a relative positional relationship between a separation cylinder and a separation plate in an axial direction. The present disclosure provides a centrifugal blower capable of increasing a range in which the separability of two air flows can be maintained in a relative positional relationship between a partition plate and a separation plate in an axial direction.

According to an aspect of the present disclosure, in order to attain the object, a centrifugal blower includes:

a centrifugal fan having a plurality of blades disposed around a fan axis to blow out air drawn from one side in an axial direction of the fan axis outward in a radial direction; and a separation cylinder disposed inward of the blades in the radial direction of the centrifugal fan, the separation cylinder including an opening portion in both sides in the axial direction and having a tubular shape expanding in the radial direction as extended from the one side in the axial direction toward the other side end in the axial direction, to separate an air flow directed toward the centrifugal fan into two air flows.

The centrifugal fan has a separation plate provided to intersect each of the plurality of blades. The separation plate has a plate shape extending outward from an inner side in the radial direction, so as to blow out the two air flows separated by the separation cylinder from the centrifugal fan in a state in which the two air flows are separated as air flowing through the one side in the axial direction and air flowing through the other side in the axial direction.

The separation plate has an inner end surface extending from the one side to the other side in the axial direction at a position of an inner end in the radial direction.

The separation cylinder has a separation cylinder end surface extending from the one side to the other side in the axial direction at a position of the other side end in the axial direction.

A height of one of the separation cylinder end surface and the inner end surface in the axial direction is larger than a height of the other of the separation cylinder end surface and the inner end surface in the axial direction.

According to the configuration, the height of one end surface is increased compared with a case where the height of the other end surface is the same as in this aspect and the height of one end surface is the same as the height of the other end surface. Thus, a facing range where the separation cylinder end surface and the inner end surface face each other in the radial direction of the centrifugal fan is enlarged, the facing range being a range of a position of the separation cylinder in the axial direction with respect to the separation plate. When a position of the separation cylinder in the axial direction with respect to the separation plate varied within this facing range, a size of a gap between the separation cylinder end surface and the inner end surface is equal to or less than a predetermined value. Thus, the separability of the two air flows is maintained. Therefore, in the relative positional relationship between the separation cylinder and the separation plate, it is possible to widen the range in the axial direction in which the separability of the two air flows can be maintained.

According to another aspect of the present disclosure, in order to attain the object, a centrifugal blower includes:

a centrifugal fan having a plurality of blades disposed around a fan axis to blow out air drawn from one side in an axial direction of the fan axis outward in a radial direction; and a fan casing housing the centrifugal fan, the fan casing having an intake port drawing air on the one side in the axial direction and forming an air passage through which air blown out from the centrifugal fan flows.

The centrifugal fan has a separation plate provided to intersect each of the plurality of blades, has a plate shape extending outward from an inner side in the radial direction, and separates air flowing between adjacent blades into air flowing through the one side in the axial direction and air flowing through the other side in the axial direction.

The fan casing has a partition plate provided in the air passage and shaped to extend inward from an outer side in the radial direction, so as to partition the air passage into an air passage on the one side in the axial direction and an air passage on the other side in the axial direction in order to restrict mixing of two air flows separated by the separation plate.

The separation plate has an outer end surface that extends from the one side to the other side in the axial direction at a position of an outer end in the radial direction.

The partition plate has a partition plate end surface that extends from the one side to the other side in the axial direction at a position of an inner end in the radial direction.

A height of one of the partition plate end surface and the outer end surface in the axial direction is larger than a height of the other of the partition plate end surface and the outer end surface in the axial direction.

According to the configuration, the height of one end surface is increased compared with a case where the height of the other end surface is the same as in this aspect and the height of one end surface is the same as the height of the other end surface. Thus, a facing range where the partition plate end surface and the outer end surface face each other in the radial direction of the centrifugal fan is enlarged, the facing range being a range of a position of the partition plate in the axial direction with respect to the separation plate. When a position of the partition plate in the axial direction with respect to the separation plate varies within the facing range, a size of a gap between the partition plate end surface and the outer end surface is equal to or less than a predetermined value. Thus, the separability of the two air flows is maintained. Therefore, in the relative positional relationship between the partition plate and the separation plate, it is possible to widen the range in the axial direction in which the separability of the two air flows can be maintained.

According to another aspect of the present disclosure, in order to attain the object, a centrifugal blower includes:

a centrifugal fan having a plurality of blades disposed around a fan axis to blow out air drawn from one side in an axial direction of the fan axis outward in a radial direction;

a separation cylinder disposed inward of the centrifugal fan in the radial direction with respect to the plurality of blades, the separation cylinder including an opening portion in both sides in the axial direction and having a tubular shape expanding in the radial direction as extended from the one side in the axial direction toward an end on the other side in the axial direction to separate an air flow directed toward the centrifugal fan into two air flows; and a fan casing having an intake port drawing air on the one side in the axial direction, houses the centrifugal fan, and forms an air passage through which air blown out from the centrifugal fan flows.

The centrifugal fan has a separation plate provided to intersect each of the plurality of blades and shaped to extend outward from an inner side in the radial direction, so as to blow out the two air flows separated by the separation cylinder from the centrifugal fan in a state in which the two air flows are separated as air flowing through the one side in the axial direction and air flowing through the other side in the axial direction.

The fan casing has a partition plate provided in the air passage and shaped to extend inward from an outer side in the radial direction, so as to partition the air passage into an air passage on the one side in the axial direction and an air passage on the other side in the axial direction in order to restrict mixing of two air flows separated by the separation cylinder and the separation plate.

The separation plate has an inner end surface that extends from the one side to the other side in the axial direction at a position of an inner end in the radial direction and an outer end surface that extends from the one side to the other side in the axial direction at a position of an outer end in the radial direction.

The separation cylinder has a separation cylinder end surface that extends from the one side to the other side in the axial direction at a position of an end on the other side in the axial direction.

The partition plate has a partition plate end surface that extends from the one side to the other side in the axial direction at the position of the inner end in the radial direction.

A height of one of the separation cylinder end surface and the inner end surface in the axial direction is larger than a height of the other of the separation cylinder end surface and the inner end surface in the axial direction, and a height of one of the partition plate end surface and the outer end surface in the axial direction is larger than a height of the other of the partition plate end surface and the outer end surface in the axial direction.

According to the configuration, of the separation cylinder end surface and the inner end surface, the height of one end surface is increased compared with a case where the height of the other end surface is the same as in this aspect and the height of one end surface is the same as the height of the other end surface. Thus, a facing range when the separation cylinder end surface and the inner end surface face each other in the radial direction of the centrifugal fan is enlarged, the facing range being a range of a position of the separation cylinder in the axial direction with respect to the separation plate. When a position of the separation cylinder in the axial direction with respect to the separation plate varied within this facing range, a size of a gap between the separation cylinder end surface and the inner end surface is equal to or less than a predetermined value. Thus, the separability of the two air flows is maintained. Therefore, in the relative positional relationship between the separation cylinder and the separation plate, it is possible to widen the range in the axial direction in which the separability of the two air flows can be maintained.

According to the configuration, of the partition plate end surface and the outer end surface, the height of one end surface is increased, compared with a case where the height of the other end surface is the same as this aspect and the height of one end surface is the same as the height of the other end surface. Thus, a facing range when the partition plate end surface and the outer end surface face each other in the radial direction of the centrifugal fan is enlarged, the facing range being a range of a position of the partition plate in the axial direction with respect to the separation plate. When a position of the partition plate in the axial direction with respect to the separation plate varies within the facing range, a size of a gap between the partition plate end surface and the outer end surface is equal to or less than a predetermined value. Thus, the separability of the two air flows is maintained. Therefore, in the relative positional relationship between the partition plate and the separation plate, it is possible to widen the range in the axial direction in which the separability of the two air flows can be maintained.

According to another aspect of the present disclosure, in order to attain the object, a centrifugal blower includes:

a centrifugal fan having a plurality of blades disposed around a fan axis to blow out air drawn from one side in an axial direction of the fan axis outward in a radial direction; and a separation cylinder disposed inward of the centrifugal fan in the radial direction with respect to the plurality of blades, the separation cylinder including an opening portion in both sides in the axial direction and having a tubular shape expanding in the radial direction as extended from the one side in the axial direction toward an end on the other side in the axial direction, to separate an air flow directed toward the centrifugal fan into two air flows.

The centrifugal fan has a separation plate provided to intersect each of the plurality of blades and shaped to extend outward from an inner side in the radial direction, to blow out the two air flows separated by the separation cylinder from the centrifugal fan in a state in which the two air flows are separated as air flowing through the one side in the axial direction and air flowing through the other side in the axial direction.

The separation plate has an inner end surface that extends from the one side to the other side in the axial direction at a position of an inner end in the radial direction, and a separation plate central portion located at a center in the radial direction.

The separation cylinder has a separation cylinder end surface that extends from the one side to the other side in the axial direction at a position of an end on the other side in the axial direction, and a separation cylinder central portion located at a center in the axial direction.

A height of the inner end surface in the axial direction is larger than a thickness of the separation plate central portion in a normal direction to a surface of the separation plate central portion, and a height of the separation cylinder end surface in the axial direction is larger than a thickness of the separation cylinder central portion in a normal direction to a surface of the separation cylinder central portion.

According to the configuration, the height of the inner end surface is increased compared with a case where the thickness of the separation plate central portion is the same as in this aspect and the height of the inner end surface is the same as the thickness of the separation plate central portion. Moreover, the height of the separation cylinder end surface is increased compared with a case where the thickness of the separation cylinder central portion is the same as in this aspect and the height of the separation cylinder end surface is the same as the thickness of the separation cylinder central portion.

Thus, a facing range when the separation cylinder end surface and the inner end surface face each other in the radial direction of the centrifugal fan is enlarged, the facing range being a range of a position of the separation plate in the axial direction with respect to the separation plate. When a position of the separation cylinder in the axial direction with respect to the separation plate varied within this facing range, a size of a gap between the separation cylinder end surface and the inner end surface is equal to or less than a predetermined value. Thus, the separability of the two air flows is maintained. Therefore, in the relative positional relationship between the separation cylinder and the separation plate, it is possible to widen the range in the axial direction in which the separability of the two air flows can be maintained.

According to another aspect of the present disclosure, in order to attain the object, a centrifugal blower includes:

a centrifugal fan having a plurality of blades disposed around a fan axis to blow out air drawn from one side in an axial direction of the fan axis outward in a radial direction; and a fan casing having an intake port drawing air on the one side in the axial direction, houses the centrifugal fan, and forms an air passage through which air blown out from the centrifugal fan flows.

The centrifugal fan has a separation plate provided to intersect each of the plurality of blades and shaped to extend outward from an inner side in the radial direction, to separate air flowing between adjacent blades into air flowing through the one side in the axial direction and air flowing through the other side in the axial direction.

The separation plate has an outer end surface that extends from the one side to the other side in the axial direction at a position of an outer end in the radial direction, and a separation plate central portion located at a center in the radial direction.

The fan casing has a partition plate provided in the air passage and shaped to extend inward from an outer side in the radial direction, to partition the air passage into an air passage on the one side in the axial direction and an air passage on the other side in the axial direction in order to restrict mixing of two air flows separated by the separation plate.

The partition plate has a partition plate end surface that extends from the one side to the other side in the axial direction at a position of an inner end in the radial direction, and a partition plate central portion located at a center in the radial direction.

A height of the outer end surface in the axial direction is larger than a thickness of the separation plate central portion in a normal direction to a surface of the separation plate central portion, and a height of the partition plate end surface in the axial direction is larger than a thickness of the partition plate central portion in a normal direction to a surface of the partition plate central portion.

According to the configuration, the height of the outer end surface is increased compared with a case where the thickness of the separation plate central portion is the same as in this aspect and the height of the outer end surface is the same as the thickness of the separation plate central portion. Further, the height of the partition plate end surface is increased compared with a case where the thickness of the partition plate central portion is the same as in this aspect and the height of the partition plate end surface is the same as the thickness of the partition plate central portion.

Thus, a facing range when the partition plate end surface and the outer end surface face each other in the radial direction of the centrifugal fan is enlarged, the facing range being a range of a position of the partition plate in the axial direction with respect to the separation plate. When a position of the partition plate in the axial direction with respect to the separation plate varies within the facing range, a size of a gap between the partition plate end surface and the outer end surface is equal to or less than a predetermined value. Thus, the separability of the two air flows is maintained. Therefore, in the relative positional relationship between the partition plate and the separation plate, it is possible to widen the range in the axial direction in which the separability of the two air flows can be maintained.

According to another aspect of the present disclosure, in order to attain the object, a centrifugal blower includes:

a centrifugal fan having a plurality of blades disposed around a fan axis to blow out air drawn from one side in an axial direction of the fan axis outward in a radial direction; and a separation cylinder disposed inward of the centrifugal fan in the radial direction with respect to the plurality of blades, the separation cylinder including an opening portion in both sides in the axial direction and having a tubular shape expanding in the radial direction from the one side in the axial direction toward an end on the other side in the axial direction, to separate an air flow directed toward the centrifugal fan into two air flows.

The centrifugal fan has a separation plate provided to intersect each of the plurality of blades and shaped to extend outward from an inner side in the radial direction, to blow out the two air flows separated by the separation cylinder from the centrifugal fan in a state in which the two air flows are separated as air flowing through the one side in the axial direction and air flowing through the other side in the axial direction.

The separation cylinder has a separation cylinder edge that includes an outer end of the separation cylinder in the radial direction and is located in a periphery of the opening portion on the other side in the axial direction.

The separation plate has an inner edge that includes an inner end of the separation plate in the radial direction.

A height of one of the separation cylinder edge and the inner edge in the axial direction is larger than a height of the other of the separation cylinder edge and the inner edge in the axial direction.

According to the configuration, the height of one edge is increased compared with a case where the height of the other edge is the same in this respect and the height of one edge is the same as the height of the other end surface. Thus, a facing range when the separation cylinder edge and the inner edge face each other in the radial direction of the centrifugal fan is enlarged, the facing range being a range of a position of the separation cylinder in the axial direction with respect to the separation plate. When a position of the separation cylinder in the axial direction with respect to the separation plate varies within this facing range, a size of a gap between the separation cylinder edge and the inner edge is equal to or less than a predetermined value. Thus, the separability of the two air flows is maintained. Therefore, in the relative positional relationship between the separation cylinder and the separation plate, it is possible to widen the range in the axial direction in which the separability of the two air flows can be maintained.

According to another aspect of the present disclosure, in order to attain the object, a centrifugal blower includes:

a centrifugal fan having a plurality of blades disposed around a fan axis to blow out air drawn from one side in an axial direction of the fan axis outward in a radial direction; and a fan casing having an intake port drawing air on the one side in the axial direction, houses the centrifugal fan, and forms an air passage through which air blown out from the centrifugal fan flows.

The centrifugal fan has a separation plate provided to intersect each of the plurality of blades and shaped to extend outward from an inner side in the radial direction, to separate air flowing between adjacent blades into air flowing through the one side in the axial direction and air flowing through the other side in the axial direction.

The fan casing has a partition plate provided in the air passage and shaped to extend inward from an outer side in the radial direction, to partition the air passage into an air passage on the one side in the axial direction and an air passage on the other side in the axial direction in order to restrict mixing of two air flows separated by the separation plate.

The separation plate has an outer edge that includes an outer end of the separation plate in the radial direction.

The partition plate has a partition plate edge that includes an inner end of the partition plate in the radial direction.

A height of one of the outer edge and the partition plate edge in the axial direction is larger than a height of the other of the outer edge and the partition plate edge in the axial direction.

According to the configuration, the height of one edge is increased compared with a case where the height of the other edge is the same in this respect and the height of the one edge is the same as the height of the other edge. Thus, a facing range when the partition plate edge and the outer edge face each other in the radial direction of the centrifugal fan is enlarged, the facing range being a range of a position of the partition plate in the axial direction with respect to the separation plate. When a position of the partition plate in the axial direction with respect to the separation plate varies within this facing range, a size of a gap between the partition plate edge and the outer edge is equal to or less than a predetermined value. Thus, the separability of the two air flows is maintained. Therefore, in the relative positional relationship between the partition plate and the separation plate, it is possible to widen the range in the axial direction in which the separability of the two air flows can be maintained.

According to another aspect of the present disclosure, in order to attain the object, a centrifugal blower includes:

a centrifugal fan having a plurality of blades disposed around a fan axis to blow out air drawn from one side in an axial direction of the fan axis outward in a radial direction;

a separation cylinder disposed inward of the centrifugal fan in the radial direction with respect to the plurality of blades and including an opening portion in both sides in the axial direction, the separation cylinder having a tubular shape expanding in the radial direction as extended from the one side in the axial direction toward an end on the other side in the axial direction, to separate an air flow directed toward the centrifugal fan into two air flows; and a fan casing having an intake port drawing air on the one side in the axial direction, houses the centrifugal fan, and forms an air passage through which air blown out from the centrifugal fan flows.

The centrifugal fan has a separation plate provided to intersect each of the plurality of blades and shaped to extend outward from an inner side in the radial direction, to blow out the two air flows separated by the separation cylinder from the centrifugal fan in a state in which the two air flows are separated as air flowing through the one side in the axial direction and air flowing through the other side in the axial direction.

The fan casing has a partition plate provided in the air passage and shaped to extend inward from an outer side in the radial direction, to partition the air passage into an air passage on the one side in the axial direction and an air passage on the other side in the axial direction in order to restrict mixing of two air flows separated by the separation cylinder and the separation plate.

The separation cylinder has a separation cylinder edge located in a periphery of the opening portion on the other side in the axial direction and including an outer end of the separation cylinder in the radial direction.

The separation plate has an inner edge that includes an inner end of the separation plate in the radial direction and an outer edge that includes an outer end of the separation plate in the radial direction.

The partition plate has a partition plate edge that includes an inner end of the partition plate in the radial direction.

A height of one of the separation cylinder edge and the inner edge in the axial direction is larger than a height of the other of the separation cylinder edge and the inner edge in the axial direction, and a height of one of the outer edge and the partition plate edge in the axial direction is larger than a height of the other of the outer edge and the partition plate edge in the axial direction.

According to the configuration, the height of one edge is increased compared with a case where the height of the other edge is the same in this respect and the height of one edge is the same as the height of the other end surface. Thus, a facing range when the separation cylinder edge and the inner edge face each other in the radial direction of the centrifugal fan is enlarged, the facing range being a range of a position of the separation cylinder in the axial direction with respect to the separation plate. When a position of the separation cylinder in the axial direction with respect to the separation plate varies within this facing range, a size of a gap between the separation cylinder edge and the inner edge is equal to or less than a predetermined value. Thus, the separability of the two air flows is maintained. Therefore, in the relative positional relationship between the separation cylinder and the separation plate, it is possible to widen the range in the axial direction in which the separability of the two air flows can be maintained.

According to the configuration, the height of one edge is increased compared with a case where the height of the other edge is the same as in this aspect and the height of one edge is the same as the height of the other edge. Thus, a facing range when the partition plate edge and the outer edge face each other in the radial direction of the centrifugal fan is enlarged, the facing range being a range of a position of the partition plate in the axial direction with respect to the separation plate. When a position of the partition plate in the axial direction with respect to the separation plate varies within this facing range, a size of a gap between the partition plate edge and the outer edge is equal to or less than a predetermined value. Thus, the separability of the two air flows is maintained. Therefore, in the relative positional relationship between the partition plate and the separation plate, it is possible to widen the range in the axial direction in which the separability of the two air flows can be maintained.

The reference numerals in parentheses attached to the components and the like indicate an example of correspondence between the components and the like and specific components and the like in embodiments to be described below.

Hereinafter, embodiments will be described according to the drawings. Same or equivalent portions among respective embodiments below are labeled with same reference numerals in the drawings.

First Embodiment

A centrifugal blower 10 of the present embodiment illustrated in FIG. 1 is applied to a vehicular air conditioner of the inside and outside air two-layer flow type. The vehicular air conditioner is capable of separately drawing vehicle interior air (that is, inside air) and vehicle exterior air (that is, outside air) together. Hereinafter, the centrifugal blower 10 will be simply referred to as a blower 10.

The blower 10 includes a centrifugal fan 12, a fan casing 14, a motor 16, and a separation cylinder 18. The centrifugal fan 12 rotates about a fan axis CL. The centrifugal fan 12 blows air drawn from one side in an axial direction DRa of the fan axis CL outward of the centrifugal fan 12 in a radial direction DRr. In the present embodiment, the axial direction DRa of the fan axis CL, that is, the axial direction DRa of the centrifugal fan 12 will be referred to as a fan axial direction DRa. The radial direction DRr of the fan axis CL, that is, the radial direction DRr of the centrifugal fan 12 will be referred to as a fan radial direction DRr. The fan radial direction DRr is a direction perpendicular to the fan axial direction DRa.

The centrifugal fan 12 includes multiple blades 121, a main plate 122, and a reinforcing member 123. The multiple blades 121 are disposed around the fan axis CL. Each of the multiple blades 121 has one end 121*a* that is an end on one side in the fan axial direction DRa and the other end 121*b* that is an end on the other side in the fan axial direction DRa. The main plate 122 has a disc shape extending in the fan radial direction DRr. A rotation shaft 161 of the motor 16 is connected to a central portion of the main plate 122. The other end 121*b* of each of the multiple blades 121 is fixed to an outer portion of the main plate 122 in the fan radial direction DRr. The reinforcing member 123 reinforces the centrifugal fan 12. The reinforcing member 123 is annular. The reinforcing member 123 is fixed to a portion of each of the multiple blades 121 adjacent to the one end 121*a* and on the outer side in the fan radial direction DRr.

The centrifugal fan 12 has a separation plate 13. The separation plate 13 separates air flowing between the adjacent blades 121 in the multiple blades 121 into air flowing on one side in the fan axial direction DRa and air flowing on the other side in the fan axial direction DRa. In other words, the separation plate 13 blows out, from the centrifugal fan, the two air flows separated by the separation cylinder 18 in a state in which the two air flows are separated as air flowing through one side in the fan axial direction DRa and air flowing through the other side in the fan axial direction DRa.

The separation plate 13 is annular centering on the fan axis CL. The separation plate 13 has a plate shape extending in the fan radial direction DRr. The separation plate 13 intersects each of the multiple blades 121. Each of the multiple blades 121 and the separation plate 13 are fixed to each other at a portion where the blade 121 and the separation plate 13 intersect.

In the present embodiment, the multiple blades 121, the main plate 122, the reinforcing member 123, and the separation plate 13 are integrally formed as an integrally molded article made of resin. The separation plate 13 may be fixed to the multiple blades 121 after being molded separately from the multiple blades 121.

In each of the multiple blades 121, as an airfoil portion located further toward one side in the fan axial direction DRa than the separation plate 13, an airfoil of a sirocco fan is employed. As an airfoil portion located further toward the other side in the fan axial direction DRa than the separation plate 13, an airfoil of the sirocco fan is employed. As a combination of an airfoil portion on one side and an airfoil portion on the other side, other combinations may be employed. Other combinations include a combination of an airfoil of a sirocco fan and an airfoil of a radial fan, a combination of an airfoil of a radial fan and an airfoil of a sirocco fan, a combination of an airfoil of a radial fan and an airfoil of the radial fan, a combination of an airfoil of a sirocco fan and an airfoil of a turbo fan, a combination of an airfoil of a turbo fan and an airfoil of a sirocco fan, a combination of an airfoil of a turbo fan and an airfoil of the turbo fan, a combination of an airfoil of a radial fan and an airfoil of a turbo fan, and a combination of an airfoil of a turbo fan and an airfoil of a radial fan.

The fan casing 14 houses the centrifugal fan 12 inside the fan casing 14. An intake port 14*a* drawing air is formed in the fan casing 14 on one side in the fan axial direction DRa with respect to the centrifugal fan 12. The fan casing 14 has a bell mouth 141 that forms a peripheral portion of the intake port 14*a*. A cross-sectional shape of the bell mouth 141 is an arc shape such that air can smoothly flow through the intake port 14*a*. A cross-sectional shape of the bell mouth 141 does not have to be an arc shape.

The fan casing 14 has an air passage forming portion 142. The air passage forming portion 142 forms an air passage 142*a* through which air blown out from the centrifugal fan 12 gathers and flows. The air passage 142*a* is formed in a spiral shape in the periphery of the centrifugal fan 12. The air passage forming portion 142 has a peripheral wall portion 143 extending in the fan axial direction DRa around the centrifugal fan 12.

The fan casing 14 has a partition plate 15. The partition plate 15 is provided in the air passage 142*a*, and the partition plate 15 is a member for reducing mixing of two air flows separated by the separation cylinder 18 and the separation plate 13. The partition plate 15 partitions the air passage 142*a* into a first air passage 142*b* on one side in the fan axial direction DRa and a second air passage 142*c* on the other side in the fan axial direction DRa. The partition plate 15 has a plate shape extending in the fan radial direction DRr. The partition plate 15 extends from the peripheral wall portion 143 toward the centrifugal fan 12. In the present embodiment, the air passage forming portion 142 and the partition plate 15 are integrally formed as an integrally molded article made of resin. The partition plate 15 may be fixed to the air passage forming portion 142 after being molded separately from the air passage forming portion 142.

The motor 16 is an electric drive device rotating the centrifugal fan 12. The motor 16 has a rotation shaft 161 and a main body portion 162. The rotation shaft 161 extends toward one side in the fan axial direction DRa from the main body portion 162. The rotation shaft 161 rotates and thus the centrifugal fan 12 rotates. The main body portion 162 is fixed to the fan casing 14 via a motor housing 163.

The separation cylinder 18 separates an air flow directed from the intake port 14*a* toward the centrifugal fan 12 into two air flows. The separation cylinder 18 partitions an air passage extending from the intake port 14*a* to the centrifugal fan 12 into two air passages. The separation cylinder 18 is a cylindrical member extending in the fan axial direction DRa. The separation cylinder 18 has an opening portion at each of an end on one side and an end on the other side in the fan axial direction DRa.

The separation cylinder 18 is disposed inward of the multiple blades 121 and the bell mouth 141 in the fan radial direction DRr. On the other side in the fan axial direction DRa of the separation cylinder 18, the separation cylinder 18 is enlarged in the fan radial direction DRr as extended toward the other side from the one side in the fan axial direction DRa.

The separation cylinder 18 is molded by using resin. The separation cylinder 18 is formed as a part of an inside and outside air switching unit (not illustrated). The separation cylinder 18 is molded integrally with or separately from a casing of the inside and outside air switching unit. The inside and outside air switching unit switches among an inside air mode for drawing inside air, an outside air mode for drawing outside air, and an inside/outside air mode for drawing inside air and outside air separately as modes for drawing air into the blower 10. The inside and outside air switching unit is fixed to the side of the intake port 14*a* in the fan casing 14. Thus, the separation cylinder 18 does not rotate when the centrifugal fan 12 rotates.

Figure 2:
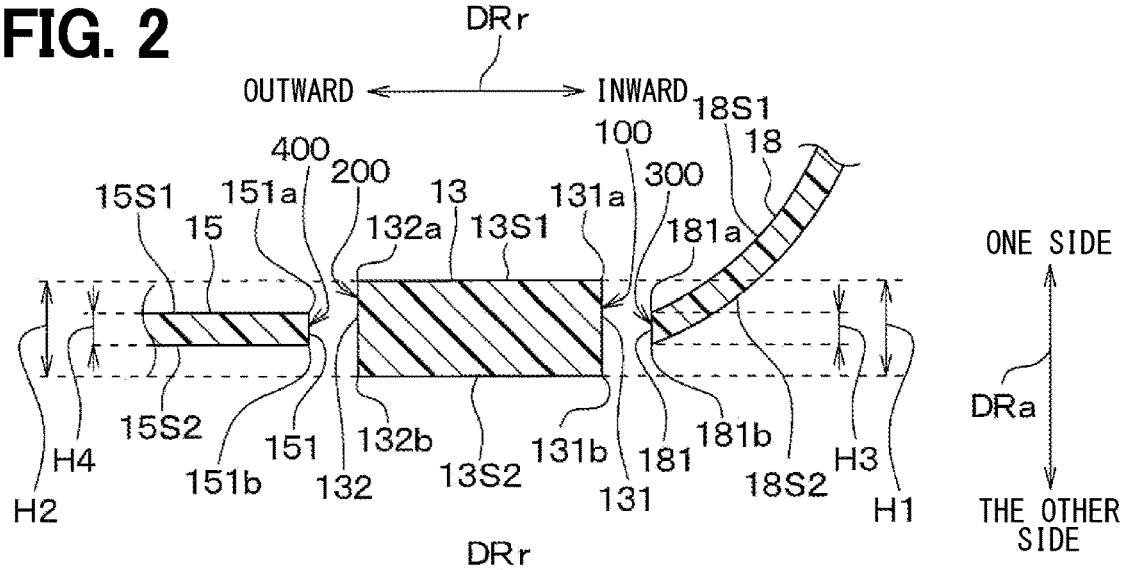
FIG. 2 is a cross-sectional view of a separation plate, a separation cylinder, and a partition plate in FIG. 1.

As illustrated in FIG. 2, the separation plate 13 has an inner end surface 131 located at the inner end in the fan radial direction DRr. The inner end surface 131 of the separation plate 13 faces an inner space in the fan radial direction DRr. The separation plate 13 has an outer end surface 132 located on the outer side in the fan radial direction DRr. The outer end surface 132 of the separation plate 13 faces an outer space in the fan radial direction DRr.

The inner end surface 131 and the outer end surface 132 extend from one side to the other side in the fan axial direction DRa. The inner end surface 131 has one end 131*a* that is an end on one side in the fan axial direction DRa, and the other end 131*b* that is an end on the other side in the fan axial direction DRa. The outer end surface 132 has one end 132*a* that is an end on one side in the fan axial direction DRa, and the other end 132*b* that is an end on the other side in the fan axial direction DRa. In the present embodiment, an extension direction of the outer end surface 132 and an extension direction of the inner end surface 131 are parallel to the fan axial direction DRa.

The separation cylinder 18 has a separation cylinder end surface 181 located at the end on the other side in the fan axial direction DRa. The separation cylinder end surface 181 of the separation cylinder 18 faces an outer space in the fan radial direction DRr.

The separation cylinder end surface 181 extends from one side to the other side in the fan axial direction DRa. The separation cylinder end surface 181 has one end 181*a* that is an end on one side in the fan axial direction DRa, and the other end 181*b* that is an end on the other side in the fan axial direction DRa. In the present embodiment, an extension direction of the separation cylinder end surface 181 is parallel to the fan axial direction DRa.

The partition plate 15 has a partition plate end surface 151 located at the inner end in the fan radial direction DRr. The partition plate end surface 151 of the partition plate 15 faces an inner space in the fan radial direction DRr.

The partition plate end surface 151 extends from one side to the other side in the fan axial direction DRa. The partition plate end surface 151 has one end 151*a* that is an end on one side in the fan axial direction DRa, and the other end 151*b* that is an end on the other side in the fan axial direction DRa. In the present embodiment, an extension direction of the partition plate end surface 151 is parallel to the fan axial direction DRa.

A thickness of the separation plate 13 is the same over the entire region in the extension direction of the separation plate 13. A thickness of the separation cylinder 18 is the same over the entire region of the separation cylinder 18 in the extension direction. A thickness of the partition plate 15 is the same over the entire region of the partition plate 15 in the extension direction. The thickness of the separation plate 13 is larger than the thickness of the separation cylinder 18. The thickness of the separation plate 13 is larger than the thickness of the partition plate 15. The thickness of each of the members 13, 15, and 18 is a length of the member in a direction perpendicular to the extension direction of the member. In other words, the thickness of each of the members 13, 15, and 18 is a length of the member in a normal direction to the surface of the member. In the present specification, the normal direction when the surface is a plane is a direction perpendicular to the surface. The normal direction when the surface is a curved surface is the direction perpendicular to a tangential plane in contact with the surface at a point on the surface.

Thus, a height H1 of the inner end surface 131 in the fan axial direction DRa is larger than a height H3 of the separation cylinder end surface 181 in the fan axial direction DRa. A height H2 of the outer end surface 132 in the fan axial direction DRa is larger than a height H4 of the partition plate end surface 151 in the fan axial direction DRa. The respective heights H1, H2, H3, and H4 of the end surfaces 131, 132, 181, and 151 are distances from the one ends 131*a*, 132*a*, 181*a*, and 151*a* to the other ends 131*b*, 132*b*, 181*b*, and 151*b* in the fan axial direction DRa.

In the blower 10 of the present embodiment, the centrifugal fan 12 is rotated by the motor 16. Thus, air is drawn into the inner side of the centrifugal fan 12 in the fan radial direction DRr from one side of the centrifugal fan 12 in the axial direction DRa. The drawn air is blown out from the centrifugal fan 12 to the outer side in the fan radial direction DRr. The air blown out from the centrifugal fan 12 flows through the air passage 142*a* of the fan casing 14, and is then blown out from an outlet of the fan casing 14.

In this case, as illustrated in FIG. 1, two air flows FL1 and FL2 flow in the blower 10 in a state of being separated by the separation cylinder 18, the separation plate 13, and the partition plate 15. The two air flows FL1 and FL2 are a first flow FL1 flowing inside the separation cylinder 18 and a second flow FL2 flowing outside the separation cylinder 18.

The air blown out from the blower 10 flows through an air conditioning casing of the vehicular air conditioner (not illustrated). A temperature regulator adjusting an air temperature is disposed in the air conditioning casing. The air blown out from the blower is blown into a vehicle compartment after the temperature thereof is adjusted by the temperature regulator. The state in which the two air flows are separated is maintained even inside the air conditioning casing. Each of the two air flows is blown into the vehicle compartment after the temperature thereof is adjusted. For example, in the inside/outside air mode, the outside air drawn from the intake port is blown out from a defroster blowing port after the temperature thereof is adjusted. The inside air drawn from the intake port is blown out from a foot blowing port after the temperature thereof is adjusted.

Figure 3:
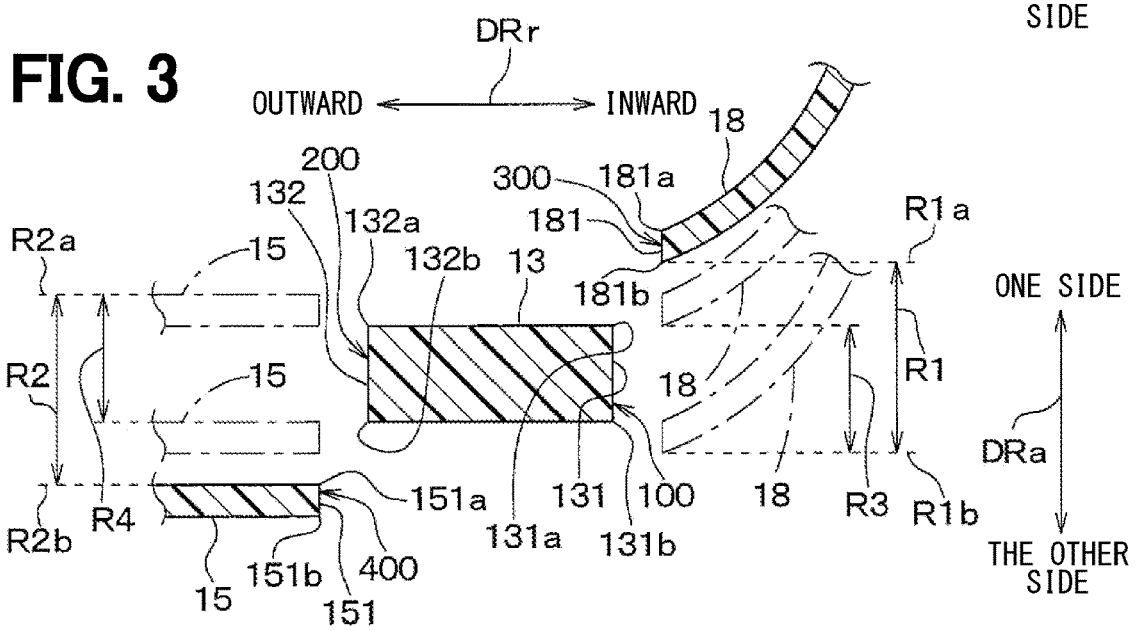
FIG. 3 is a cross-sectional view of the separation plate, the separation cylinder, and the partition plate in FIG. 1 to illustrate an allowable positional relationship between the separation cylinder and the separation plate and an allowable positional relationship between the partition plate and the separation plate.

As illustrated in FIG. 3, in the blower 10 of the present embodiment, when a position of the other end 181*b* of the separation cylinder end surface 181 in the fan axial direction DRa is within a first range R1, it is possible to maintain the separability of the two air flows FL1 and FL2. During assembly of the blower 10, a positional deviation in relative positions between of the separation cylinder 18 and the separation plate 13 in the fan axial direction DRa may occur. In this case, when a position of the other end 181*b* of the separation cylinder end surface 181 is within the first range R1, the separability can be maintained. Therefore, the first range R1 is a range in which the separability of the two air flows FL1 and FL2 can be maintained in the relative positional relationship between the separation cylinder 18 and the separation plate 13 in the fan axial direction DRa.

The first range R1 is a range in which a size of a gap between the separation cylinder 18 and the separation plate 13 can be set to a predetermined value or less in the relative positional relationship between the separation cylinder 18 and the separation plate 13 in the fan axial direction DRa. This predetermined value is the maximum value of the gap when the separability can be maintained, and is a value determined through experiment or the like.

A position of one end R1*a* that is an end of the first range R1 on one side in the fan axial direction DRa is a position on one side in the fan axial direction DRa with respect to the one end 131*a* of the inner end surface 131. A position of the other end R1*b* that is an end of the first range R1 on the other side in the fan axial direction DRa is a position of the other end 181*b* of the separation cylinder end surface 181 when a position of the one end 181*a* of the separation cylinder end surface 181 is the same as that of the other end 131*b* of the inner end surface 131 in the fan axial direction DRa.

When a position of the one end 151*a* of the partition plate end surface 151 in the fan axial direction DRa is within a second range R2, the separability of the two air flows FL1 and FL2 can be maintained. During assembly of the blower 10, a positional deviation in relative positions between the partition plate 15 and the separation plate 13 in the fan axial direction DRa may occur. In this case, when a position of the one end 151*a* of the partition plate end surface 151 is within the second range R2, the separability can be maintained. Therefore, the second range R2 is a range in which the separability of the two air flows FL1 and FL2 can be maintained in the relative positional relationship between the partition plate 15 and the separation plate 13 in the fan axial direction DRa.

The second range R2 is a range in which a size of a gap between the partition plate 15 and the separation plate 13 can be set to a predetermined value or less in the relative positional relationship between the partition plate 15 and the separation plate 13 in the fan axial direction DRa. This predetermined value is the maximum value of the gap when the separability can be maintained, and is a value determined through experiment or the like.

A position of one end R2*a* that is an end of the second range R2 on one side in the fan axial direction DRa is a position of the one end 151*a* of the partition plate end surface 151 when a position of the other end 151*b* of the partition plate end surface 151 is the same as that of the one end 132*a* of the outer end surface 132 in the fan axial direction DRa. A position of the other end R2*b* that is an end of the second range R2 on the other side in the fan axial direction DRa is a position on the other side in the fan axial direction DRa with respect to the other end 132*b* of the outer end surface 132.

Figure 4:
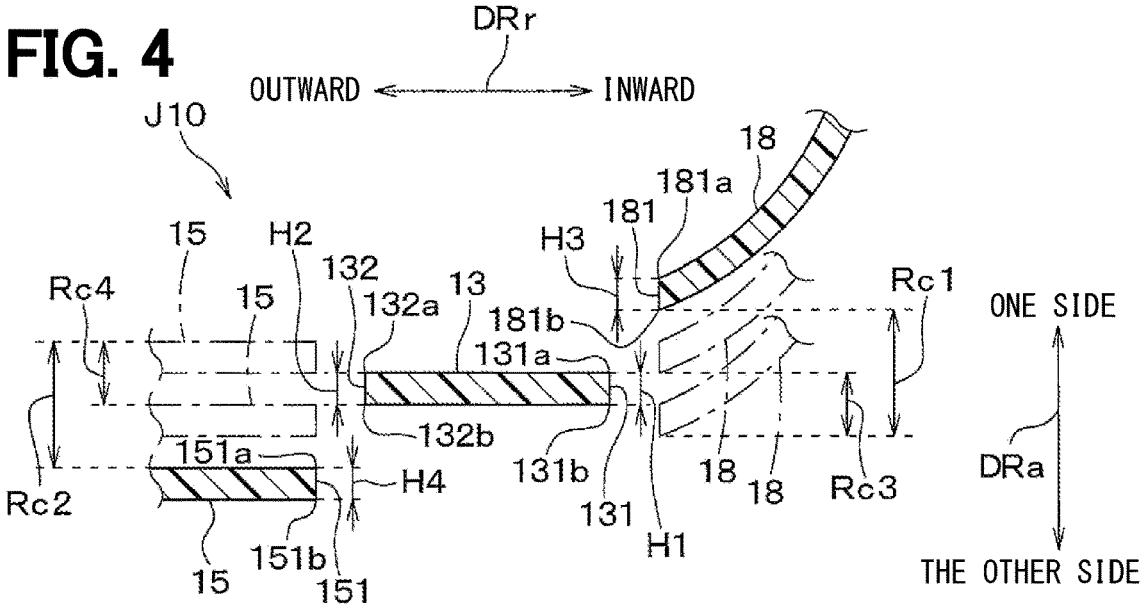
FIG. 4 is a cross-sectional view of a separation plate, a separation cylinder, and a partition plate in a centrifugal blower of Comparative Example 1.

Next, the blower 10 of the present embodiment is compared with a blower J10 of Comparative Example 1 illustrated in FIG. 4. In the blower J10 of Comparative Example 1, the height H1 of the inner end surface 131 is the same as the height H3 of the separation cylinder end surface 181. The height H2 of the outer end surface 132 is the same as the height H4 of the partition plate end surface 151. The height H3 of the separation cylinder end surface 181 and the height H4 of the partition plate end surface 151 of the blower J10 of Comparative Example 1 are the same as those of the blower 10 of the present embodiment. The blower J10 of Comparative Example 1 has the same configuration as that of the blower 10 of the present embodiment except for the above configuration.

Also in the blower J10 of Comparative Example 1, when a position of the other end 181*b* of the separation cylinder end surface 181 in the fan axial direction DRa is within a first range Rc1, it is possible to maintain the separability of the two air flows FL1 and FL2. A positional relationship between ends Rc1*a* and Rc1*b* of the first range Rc1 and the inner end surface 131 is the same as in the first range R1 of the blower 10 of the present embodiment.

When a position of the one end 151*a* of the partition plate end surface 151 in the fan axial direction DRa is within a second range Rc2, the separability of the two air flows FL1 and FL2 can be maintained. A positional relationship between ends Rc2*a* and Rc2*b* of the second range Rc2 and the outer end surface 132 is the same as in the second range R2 of the blower 10 of the present embodiment.

In the blower 10 of the present embodiment, the height H1 of the inner end surface 131 is larger than the height H3 of the separation cylinder end surface 181. Thus, in the blower 10 of the present embodiment, the height H1 of the inner end surface 131 is increased compared with the blower J10 of Comparative Example 1.

As a result, in the relative positional relationship between the separation cylinder 18 and the separation plate 13 in the fan axial direction DRa, a facing range R3 when the separation cylinder end surface 181 and the inner end surface 131 face each other in the fan radial direction DRr is wider than a facing range Rc3 in the blower J10 of Comparative Example 1. A size of the gap between the separation cylinder end surface 181 and the inner end surface 131 is constant even though a position of the separation cylinder 18 with respect to the separation plate 13 varies within the facing range R3 in the fan axial direction DRa. Thus, the separability of the two air flows FL1 and FL2 is maintained.

Therefore, according to the blower 10 of the present embodiment, the first range R1 can be widened more than the first range Rc1 of the blower J10 of Comparative Example 1. Therefore, during assembly of the blower 10, even though a positional deviation occurs in relative positions between the separation cylinder 18 and the separation plate 13 in the fan axial direction DRa, a position of the other end 181*b* of the separation cylinder end surface 181 can be set within the first range R1. The separability of the two air flows FL1 and FL2 can be maintained.

Similarly, in the blower 10 of the present embodiment, the height H2 of the outer end surface 132 is larger than the height H4 of the partition plate end surface 151. Thus, in the blower 10 of the present embodiment, the height H2 of the outer end surface 132 is increased compared with the blower J10 of Comparative Example 1.

As a result, in the relative positional relationship between the partition plate 15 and the separation plate 13 in the fan axial direction DRa, a facing range R4 when the partition plate 15 and the outer end surface 132 face each other in the fan radial direction DRr is wider than a facing range Rc4 in the blower J10 of Comparative Example 1. A size of the gap between the partition plate end surface 151 and the outer end surface 132 is constant even though a position of the partition plate 15 with respect to the separation plate 13 varies within the facing range R4 in the fan axial direction DRa. Thus, the separability of the two air flows FL1 and FL2 is maintained.

Therefore, according to the blower 10 of the present embodiment, the second range R2 can be widened more than the second range Rc2 of Comparative Example 1. Therefore, during assembly of the blower 10, even though a positional deviation occurs in relative positions between the partition plate 15 and the separation plate 13 in the fan axial direction DRa, a position of the one end 151*a* of the partition plate end surface 151 can be set within the second range R2. The separability of the two air flows FL1 and FL2 can be maintained.

According to another aspect, as illustrated in FIG. 2, in the blower 10 of the present embodiment, the separation cylinder 18 has a separation cylinder edge 300. The separation cylinder edge 300 is an end portion of the separation cylinder 18 on the other side in the fan axial direction DRa. The separation cylinder edge 300 is located in the periphery of an opening portion on the other side in the fan axial direction DRa. The separation cylinder edge 300 is a portion including the outer end of the separation cylinder 18 in the fan radial direction DRr. The separation cylinder edge 300 includes the vicinity of the outer end of the separation cylinder 18 in the fan radial direction DRr. The separation cylinder edge 300 extends along a circumferential direction centering on the fan axis CL.

The separation plate 13 has an inner edge 100. The inner edge 100 is a portion including an inner end of the separation plate 13 in the fan radial direction DRr in the separation plate 13. The inner edge 100 includes the vicinity of the inner end of the separation plate 13 of the fan radial direction DRr in the separation plate 13. The inner edge 100 extends along the circumferential direction around the fan axis CL.

The height H1 of the inner edge 100 in the fan axial direction DRa is larger than the height H3 of the separation cylinder edge 300 in the fan axial direction DRa.

The height H1 of the inner edge 100 is a distance in the fan axial direction DRa between an inner end 131*a* of one surface 13S1 of the separation plate 13 in the fan radial direction DRr and an inner end 131*b* of the other surface 13S2 of the separation plate 13 in the fan radial direction DRr. The one surface 13S1 is a surface of the separation plate 13 on one side in the fan axial direction DRa. The other surface 13S2 is a surface of the separation plate 13 on the other side in the fan axial direction DRa. A position of the end 131*a* of the one surface 13S1 is the same as a position of the one end 131*a* of the inner end surface 131. A position of the end 131*b* of the other surface 13S2 is the same as a position of the other end 131*b* of the inner end surface 131. Therefore, the height H1 of the inner edge 100 is the same as the height H1 of the inner end surface 131.

The height H3 of the separation cylinder edge 300 is a distance in the fan axial direction DRa between an outer end 181*a* of one surface 18S1 of the separation cylinder 18 in the fan radial direction DRr and an outer end 181*b* of the other surface 18S2 of the separation cylinder 18 in the fan radial direction DRr. The one surface 18S1 is a surface of the separation cylinder 18 on one side in the fan axial direction DRa in the outer portion in the fan radial direction DRr. The other surface 18S2 is a surface of the separation cylinder 18 on the other side in the fan axial direction DRa in the outer portion in the fan radial direction DRr. A position of the end 181*a* of the one surface 18S1 is the same as a position of the one end 181*a* of the separation cylinder end surface 181. A position of the end 181*b* of the other surface 18S2 is the same as a position of the other end 181*b* of the separation cylinder end surface 181. Thus, the height H3 of the separation cylinder edge 300 is the same as the height H3 of the separation cylinder end surface 181.

According to the configuration, as illustrated in FIG. 3, the facing range R3 when the separation cylinder edge 300 and the inner edge 100 face each other in the fan radial direction DRr is wider than the facing range Rc3 in the blower J10 of Comparative Example 1. Thus, in the relationship between the separation cylinder 18 and the separation plate 13, the effect of the present embodiment is achieved.

The separation plate 13 also has an outer edge 200. The outer edge 200 is a portion including the outer end of the separation plate 13 in the fan radial direction DRr in the separation plate 13. The outer edge 200 includes the vicinity of the outer end of the separation plate 13 in the fan radial direction DRr in the separation plate 13. The outer edge 200 extends along the circumferential direction centering on the fan axis CL.

The partition plate 15 has a partition plate edge 400. The partition plate edge 400 is a portion including the inner end of the partition plate 15 in the fan radial direction DRr in the partition plate 15. The partition plate edge 400 includes the vicinity of the inner end of the partition plate 15 in the fan radial direction DRr in the partition plate 15. The partition plate edge 400 extends along the circumferential direction centering on the fan axis CL.

The height H2 of the outer edge 200 in the fan axial direction DRa is larger than the height H4 of the partition plate edge 400 in the fan axial direction DRa.

The height H2 of the outer edge 200 is a distance in the fan axial direction DRa between the outer end 132*a* of the one surface 13S1 in the fan radial direction DRr and the outer end 132*b* of the other surface 13S2 in the fan radial direction DRr. A position of the outer end 132*a* of the one surface 13S1 is the same as the position of the one end 132*a* of the outer end surface 132. A position of the outer end 132*b* of the other surface 13S2 is the same as a position of the other end 132*b* of the outer end surface 132. Thus, the height H2 of the outer edge 200 is the same as the height H2 of the outer end surface 132.

The height H4 of the partition plate edge 400 is a distance in the fan axial direction DRa between the inner end 151*a* of the one surface 15S1 in the fan radial direction DRr and the inner end 151*b* of the other surface 15S2 in the fan radial direction DRr. The one surface 15S1 is a surface of the partition plate 15 on one side in the fan axial direction DRa. The other surface 15S2 is a surface of the partition plate 15 on the other side in the fan axial direction DRa. A position of the end 151*a* of the one surface 15S1 is the same as a position of the one end 151*a* of the partition plate end surface 151. A position of the end 151*b* of the other surface 15S2 is the same as a position of the other end 151*b* of the partition plate end surface 151. Thus, the height H4 of the partition plate edge 400 is the same as the height H1 of the partition plate end surface 151.

According to the configuration, as illustrated in FIG. 3, a facing range R4 when the partition plate edge 400 and the outer edge 200 face each other in the fan radial direction DRr is wider than a facing range Rc4 in the blower J10 of Comparative Example 1. Therefore, in the relationship between the partition plate 15 and the separation plate 13, the effect of the present embodiment is achieved.

In the present embodiment, in the entire circumferential direction of the separation plate 13, the above-described height relationship is satisfied. However, the above-described relationship of height may be satisfied in only a part of the region in the circumferential direction of the separation plate 13. Air flows passing through the centrifugal fan 12 do not necessarily coincide with each other in the entire circumferential direction of the separation plate 13. Thus, only a region of the entire circumferential direction which has the influence on maintaining the separability of the two air flows needs to satisfy the above-described height relationship. Thus, the effect of the present embodiment described above is also achieved. The same applies to the embodiments described later.

Second Embodiment

Figure 5:
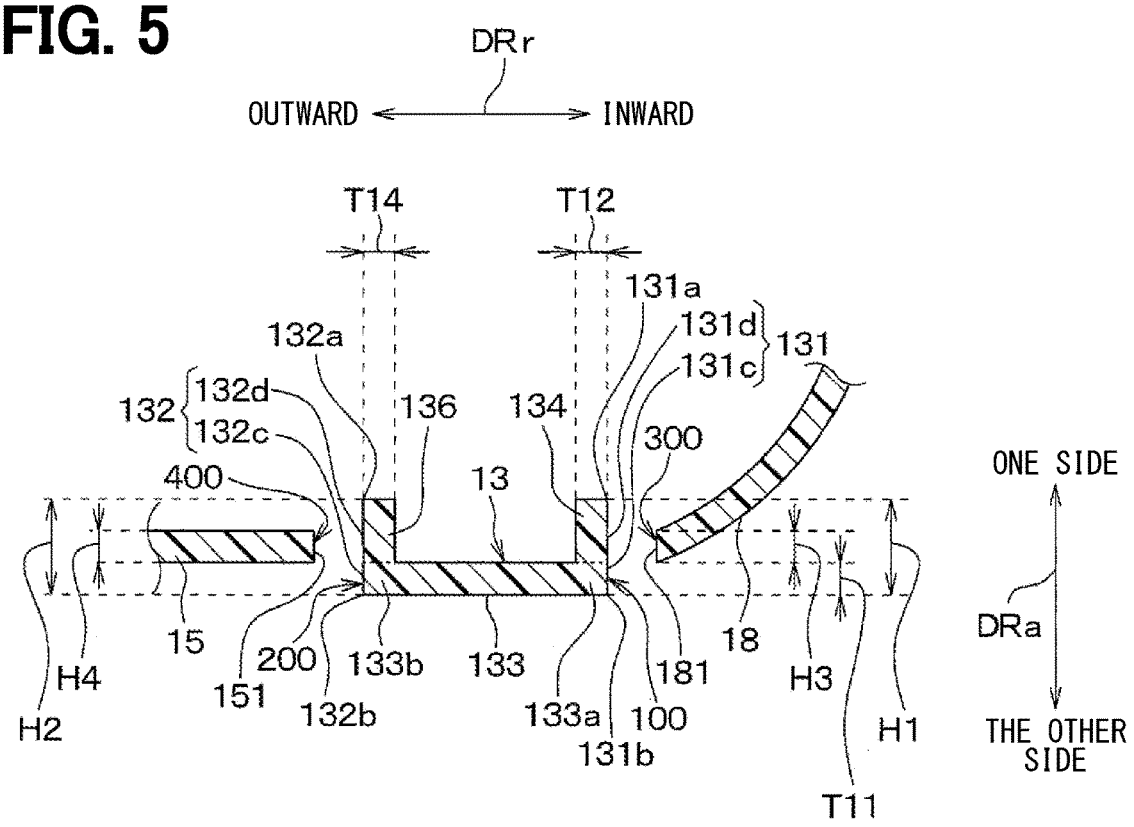
FIG. 5 is a cross-sectional view of a separation plate, a separation cylinder, and a partition plate of a second embodiment.

As illustrated in FIG. 5, in the present embodiment, a shape of a separation plate 13 is different from that in the first embodiment. A configuration of a blower 10 other than the separation plate 13 is the same as that in the first embodiment.

The separation plate 13 includes a separation plate main body portion 133, an inner protruding portion 134, and an outer protruding portion 136. The separation plate main body portion 133 extends from the inner side to the outer side in the fan radial direction DRr. The separation plate main body portion 133 includes both ends of the separation plate 13 in the fan radial direction DRr. In the separation plate main body portion 133, a thickness T11 of the separation plate main body portion 133 in a direction perpendicular to the extension direction of the separation plate main body portion 133 is constant over both ends in the fan radial direction DRr from the center side in the fan radial direction DRr.

The separation plate main body portion 133 includes an inner end of the separation plate 13 in the fan radial direction DRr. The separation plate main body portion 133 has an inner portion 133*a* that is an inner portion of the separation plate main body portion 133 in the fan radial direction DRr and includes an inner end of the separation plate 13 in the fan radial direction DRr. The inner protruding portion 134 protrudes from the inner portion 133*a* toward one side in the fan axial direction DRa.

The separation plate main body portion 133 includes an outer end of the separation plate 13 in the fan radial direction DRr. The separation plate main body portion 133 has an outer portion 133*b* that is an outer portion of the separation plate main body portion 133 in the fan radial direction DRr and includes an outer end of the separation plate 13 of the fan radial direction DRr. The outer protruding portion 136 protrudes from the outer portion 133*b* to one side in the fan axial direction DRa.

In the present embodiment, an inner end surface 131 includes an inner end surface 131*c* of the separation plate main body portion 133 in the fan radial direction DRr and an inner end surface 131*d* of the inner protruding portion 134 in the fan radial direction DRr. An outer end surface 132 includes an outer end surface 132*c* of the separation plate main body portion 133 in the fan radial direction DRr and an outer end surface 132*d* of the outer protruding portion 136 in the fan radial direction DRr.

In the present embodiment, the extension direction of the separation plate main body portion 133 is a direction perpendicular to the fan axial direction DRa. The protruding direction of the inner protruding portion 134 is a direction parallel to the fan axial direction DRa. The protruding direction of the outer protruding portion 136 is a direction parallel to the fan axial direction DRa.

Also in the present embodiment, in the same manner as in the first embodiment, a height H1 of the inner end surface 131 is larger than a height H3 of a separation cylinder end surface 181. A height H2 of the outer end surface 132 is larger than a height H4 of a partition plate end surface 151. In other words, an inner edge 100 includes an inner protruding portion 134. As a result, the height H1 of the inner edge 100 is larger than the height H3 of a separation cylinder edge 300. An outer edge 200 includes the outer protruding portion 136. Thus, the height H2 of the outer edge 200 is larger than the height H4 of the partition plate edge 400. Therefore, according to the present embodiment, the same effect as that of the first embodiment is achieved.

According to the present embodiment, among the separation plate main body portion 133, and the inner protruding portion 134 and the outer protruding portion 136, a thickness of the separation plate 13 in a portion formed by only of the separation plate main body portion 133 is smaller than the height H1 of the inner end surface 131 and the height H2 of the outer end surface 132. The thickness of the separation plate 13 is a thickness measured in a direction perpendicular to the extension direction of the separation plate 13. In other words, the thickness is a thickness in a normal direction to a surface of the separation plate 13.

Therefore, compared with a case where the thickness of the separation plate 13 is uniform with the same size as the height H1 of the inner end surface 131 or the height H2 of the outer end surface 132 in the entire separation plate 13, a material required to form the separation plate 13 can be reduced.

According to the present embodiment, a thickness T12 of the inner protruding portion 134 is the same as the thickness T11 of the separation plate main body portion 133. The thickness T12 of the inner protruding portion 134 is a thickness in the normal direction to the end surface 131*d* of the inner protruding portion 134. In the present embodiment, the normal direction to the end surface 131*d* is the fan radial direction DRr. The thickness T11 of the separation plate main body portion 133 is a thickness in a direction perpendicular to the extension direction of the separation plate main body portion 133. In other words, the thickness T11 of the separation plate main body portion 133 is a thickness in the normal direction to the surface of the separation plate main body portion 133. In the present embodiment, the normal direction to the surface of the separation plate main body portion 133 is the fan axial direction DRa.

Similarly, a thickness T14 of the outer protruding portion 136 is the same as the thickness T11 of the separation plate main body portion 133. The thickness T14 of the outer protruding portion 136 is a thickness in the normal direction to the end surface 132*d* of the outer protruding portion 136. In the present embodiment, the normal direction to the end surface 132*d* is the fan radial direction DRr.

As described above, in the present embodiment, the thickness of the separation plate 13 is uniform over the entire separation plate 13. The thickness of the separation plate 13 is a thickness (that is, a plate thickness) of a plate-shaped portion of the separation plate 13.

Here, in molding of a resin molded article, as a thickness of the resin molded article becomes larger, the cooling time is increased. Thus, it is desirable that the thickness of the resin molded article is less than a predetermined value. The predetermined value is the maximum value of a thickness when the cooling time is within an allowable time.

According to the present embodiment, the height H1 of the inner end surface 131 and the height H2 of the outer end surface 132 can be increased while suppressing an increase in the thickness of the separation plate 13, compared with a case where the separation plate 13 is formed by only the separation plate main body portion 133 of the present embodiment. That is, the thickness of the separation plate 13 can be restricted to a predetermined value or less. Therefore, it is possible to suppress an increase in the cooling time during resin molding of the separation plate 13.

In order to suppress an increase in the cooling time during resin molding of the separation plate 13, the thickness T12 of the inner protruding portion 134 may be equal to or less than the thickness T11 of the separation plate main body portion 133. Similarly, the thickness T14 of the outer protruding portion 136 may be equal to or less than the thickness T11 of the separation plate main body portion 133.

Third Embodiment

Figure 6:
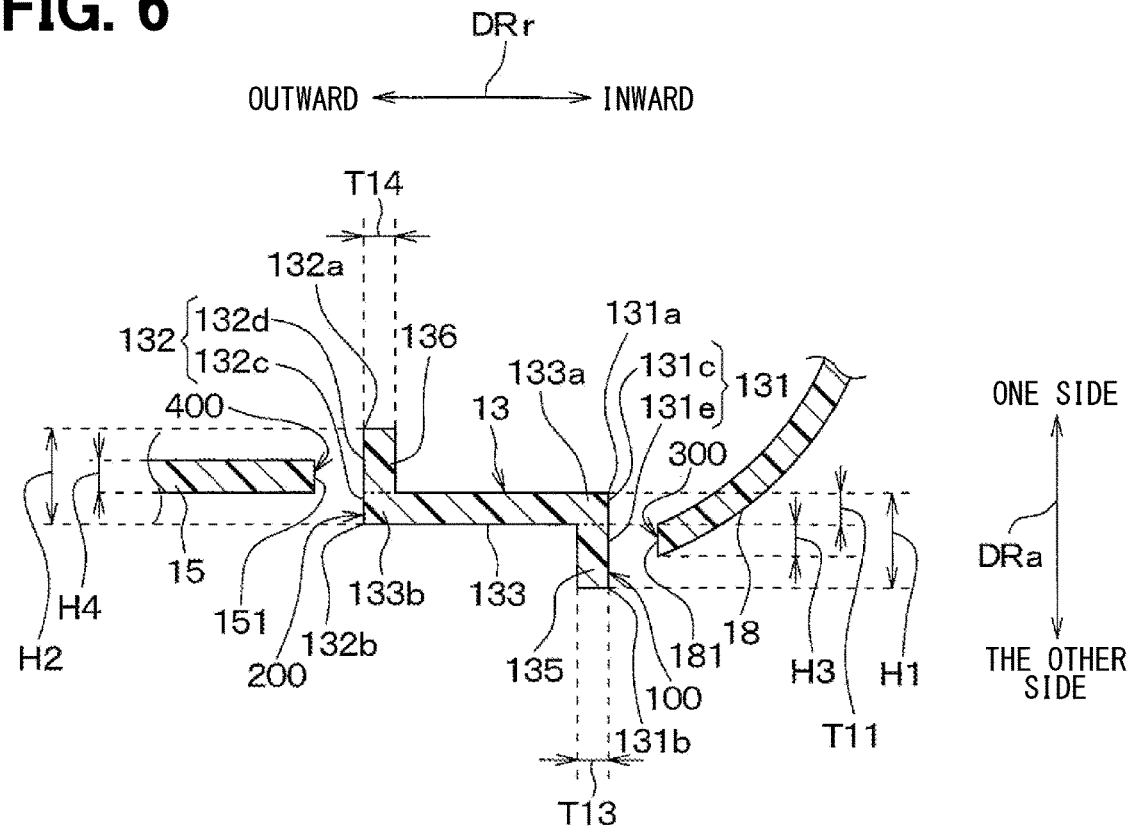
FIG. 6 is a cross-sectional view of a separation plate, a separation cylinder, and a partition plate according to a third embodiment.

As illustrated in FIG. 6, in the present embodiment, a separation plate 13 has an inner protruding portion 135. The inner protruding portion 135 protrudes to an opposite side of the inner protruding portion 134 of the second embodiment. That is, the inner protruding portion 135 protrudes from an inner portion 133*a* to the other side in the fan axial direction DRa. A protruding direction of the inner protruding portion 135 is the same as the protruding direction of the inner protruding portion 134 of the second embodiment. In the present embodiment, an inner end surface 131 includes an inner end surface 131*c* of the separation plate main body portion 133 in the fan radial direction DRr and an inner end surface 131*e* of the inner protruding portion 135 in the fan radial direction DRr. An inner edge 100 includes the inner protruding portion 135. As a result, the height H1 of the inner edge 100 is larger than the height H3 of a separation cylinder edge 300.

In the same manner as the inner protruding portion 134 of the second embodiment, a thickness T13 of the inner protruding portion 135 is the same as a thickness T11 of the separation plate main body portion 133. The thickness T13 of the inner protruding portion 135 is a thickness in the normal direction to the end surface 131*e* of the inner protruding portion 135. In the present embodiment, the normal direction to the end surface 131*e* is the fan radial direction DRr. Remaining configurations of the blower 10 are the same as those in the second embodiment.

According to the present embodiment, the same effect as that of the second embodiment is also achieved. In order to suppress an increase in the cooling time during resin molding of the separation plate 13, the thickness T13 of the inner protruding portion 135 may be equal to or less than the thickness T11 of the separation plate main body portion 133.

Fourth Embodiment

Figure 7:
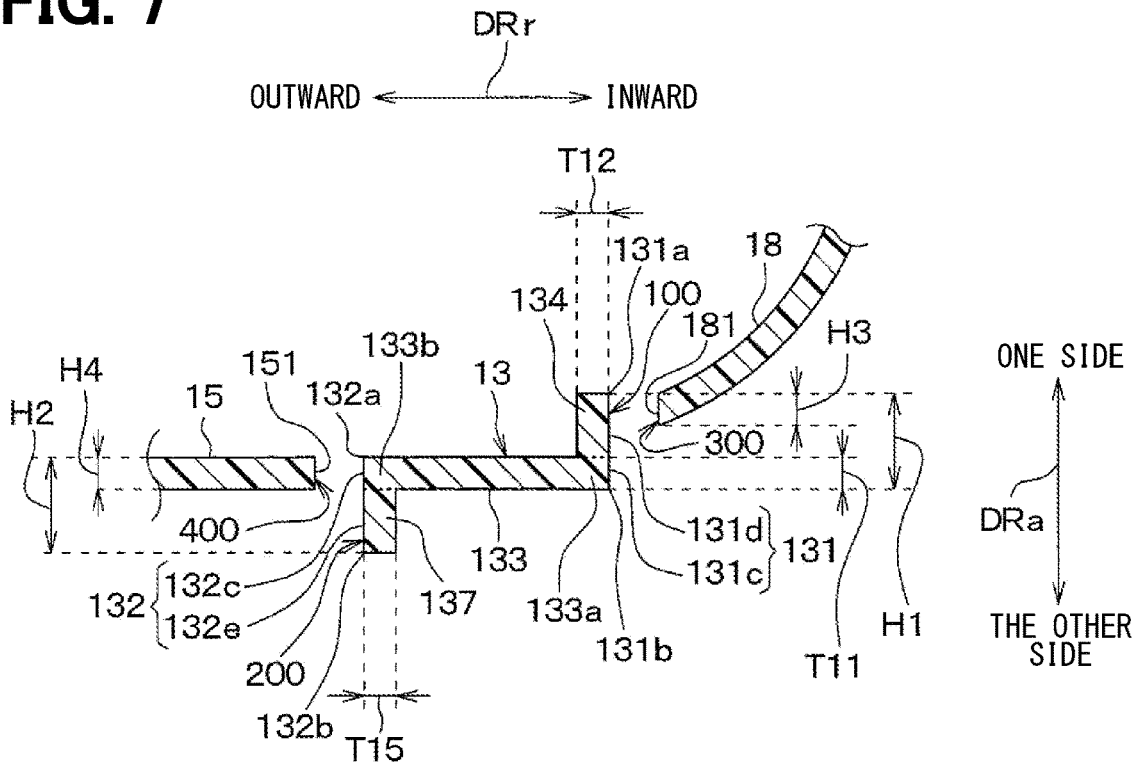
FIG. 7 is a cross-sectional view of a separation plate, a separation cylinder, and a partition plate according to a fourth embodiment.

As illustrated in FIG. 7, in the present embodiment, a separation plate 13 has an outer protruding portion 137. The outer protruding portion 137 protrudes to an opposite side of the outer protruding portion 136 of the second embodiment. That is, the outer protruding portion 137 protrudes from an outer portion 133*b* to the other side in the fan axial direction DRa. A protruding direction of the outer protruding portion 137 is the same as the protruding direction of the outer protruding portion 136 of the second embodiment. In the present embodiment, an outer end surface 132 includes an outer end surface 132*c* of a separation plate main body portion 133 in the fan radial direction DRr and an outer end surface 132*e* of the outer protruding portion 137 in the fan radial direction DRr. An outer edge 200 includes the outer protruding portion 137. Thus, the height H2 of the outer edge 200 is larger than the height H4 of the partition plate edge 400.

In the same manner as the outer protruding portion 136 of the second embodiment, a thickness T15 of the outer protruding portion 137 is the same as a thickness T11 of the separation plate main body portion 133. A thickness T15 of the outer protruding portion 137 is a thickness in the normal direction to the end surface 132*e* of the outer protruding portion 137. In the present embodiment, the normal direction to the end surface 132*e* is the fan radial direction DRr. Remaining configurations of the blower 10 are the same as those in the second embodiment.

According to the present embodiment, the same effect as that of the second embodiment is also achieved. In order to suppress an increase in the cooling time during resin molding of the separation plate 13, the thickness T15 of the outer protruding portion 137 may be equal to or less than the thickness T11 of the separation plate main body portion 133.

Fifth Embodiment

Figure 8:
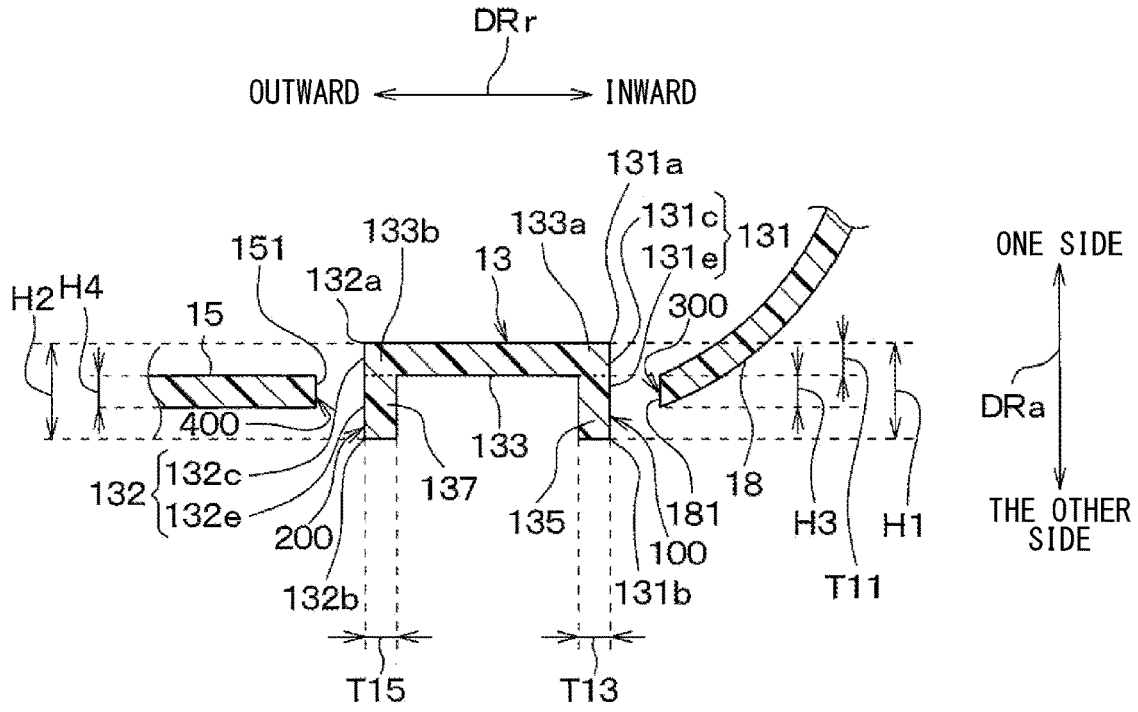
FIG. 8 is a cross-sectional view of a separation plate, a separation cylinder, and a partition plate according to a fifth embodiment.

As illustrated in FIG. 8, in the present embodiment, a separation plate 13 has an inner protruding portion 135 in the same manner as in the third embodiment. In the same manner as in the fourth embodiment, the separation plate 13 has an outer protruding portion 137. Remaining configurations of the blower 10 are the same as those in the second embodiment. According to the present embodiment, the same effect as that of the second embodiment is also achieved.

Sixth Embodiment

Figure 9:
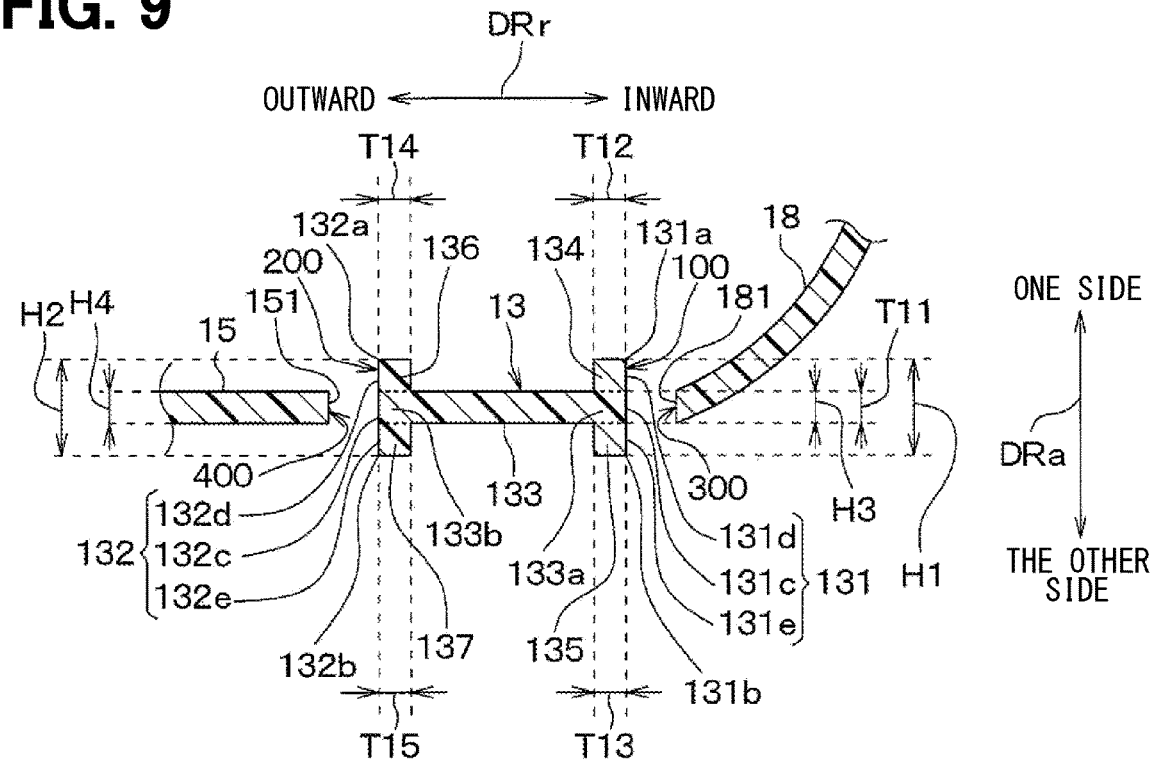
FIG. 9 is a cross-sectional view of a separation plate, a separation cylinder, and a partition plate according to a sixth embodiment.

As illustrated in FIG. 9, the present embodiment differs from the second embodiment in that a separation plate 13 has two inner protruding portions 134 and 135 and two outer protruding portions 136 and 137.

One inner protruding portion 134 of the two inner protruding portions 134 and 135 protrudes from an inner portion 133*a* to one side in the fan axial direction DRa. The other inner protruding portion 135 of the two inner protruding portions 134 and 135 protrudes from the inner portion 133*a* to the other side in the fan axial direction DRa. One outer protruding portions 136 of the two outer protruding portions 136 and 137 protrudes from an outer portion 133*b* to one side in the fan axial direction DRa. The other outer protruding portion 137 of the two outer protruding portions 136 and 137 protrudes from the outer portion 133*b* to the other side in the fan axial direction DRa.

In the present embodiment, an inner end surface 131 includes an inner end surface 131*c* of a separation plate main body portion 133 in the fan radial direction DRr, an inner end surface 131*d* of the one inner protruding portion 134 in the fan radial direction DRr, and an inner end surface 131*e* of the other inner protruding portion 135 in the fan radial direction DRr. An outer end surface 132 includes an outer end surface 132*c* of the separation plate main body portion 133 in the fan radial direction DRr, an outer end surface 132*d* of the one outer protruding portion 136 in the fan radial direction DRr, and an outer end surface 132*e* of the other outer protruding portion 137 in the fan radial direction DRr.

Also in the present embodiment, respective thicknesses T12 and T13 of the two inner protruding portions 134 and 135 are the same as a thickness T11 of the separation plate main body portion 133. Respective thicknesses T14 and T15 of the two outer protruding portions 136 and 137 are the same as the thickness T11 of the separation plate main body portion 133.

An inner edge 100 includes the two inner protruding portions 134 and 135. As a result, the height H1 of the inner edge 100 is larger than the height H3 of a separation cylinder edge 300. An outer edge 200 includes the two outer protruding portions 136 and 137. Thus, the height H2 of the outer edge 200 is larger than the height H4 of the partition plate edge 400. Remaining configurations of the blower 10 are the same as those in the second embodiment. According to the present embodiment, the same effect as that of the second embodiment is also achieved.

Seventh Embodiment

Figure 10:
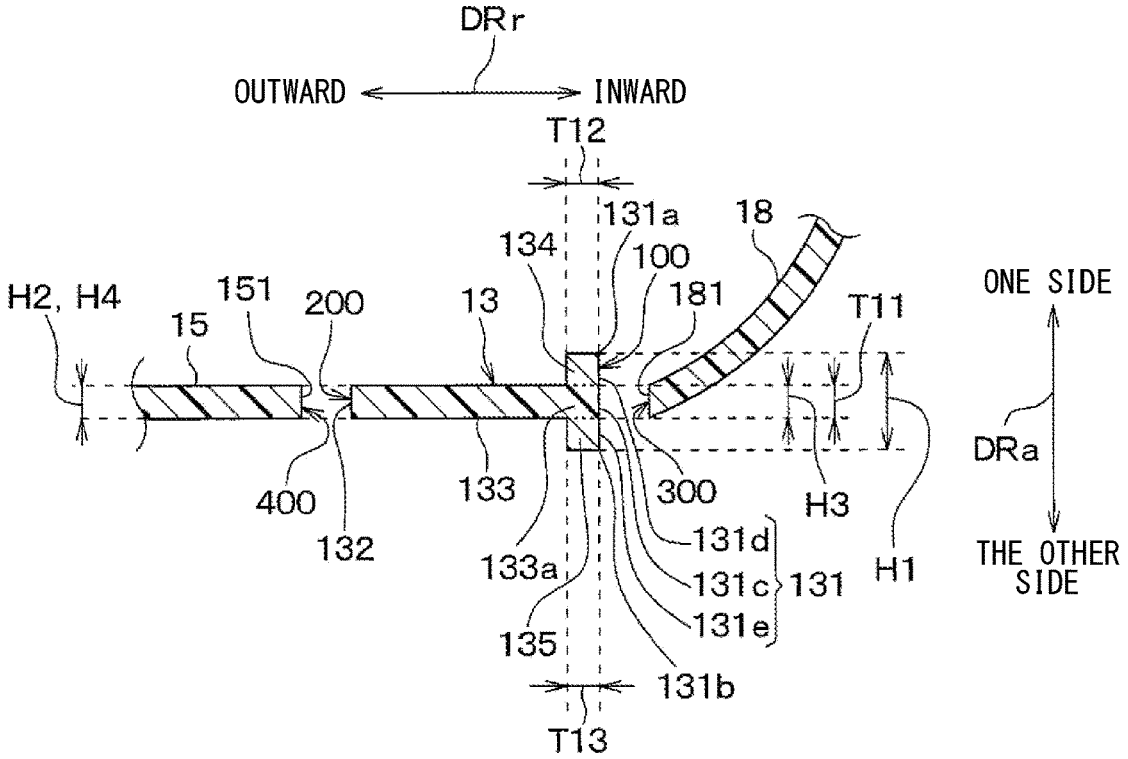
FIG. 10 is a cross-sectional view of a separation plate, a separation cylinder, and a partition plate according to a seventh embodiment.

As illustrated in FIG. 10, in the present embodiment, in the same manner as in the sixth embodiment, a separation plate 13 has two inner protruding portions 134 and 135. As a result, a height H1 of an inner end surface 131 is larger than a height H3 of a separation cylinder end surface 181. That is, the height H1 of an inner edge 100 is larger than the height H3 of a separation cylinder edge 300.

However, unlike the sixth embodiment, the separation plate 13 does not have two outer protruding portions 136 and 137. The height H2 of the outer end surface 132 is the same as the height H4 of the partition plate end surface 151. That is, a height H2 of an outer edge 200 is the same as a height H4 of a partition plate edge 400.

According to the present embodiment, among the effects of the sixth embodiment, the same effect as the effect achieved by the configuration common to the present embodiment is achieved.

In the second to fifth embodiments, the separation plate 13 may not have the outer protruding portions 136 and 137. Also in this case, the height H1 of the inner end surface 131 is larger than the height H3 of the separation cylinder end surface 181. The height H2 of the outer end surface 132 is the same as the height H4 of the partition plate end surface 151. With this configuration, among the effects of the second to fifth embodiments, the same effect as the effect achieved by the configuration common to the present embodiment is also achieved.

Eighth Embodiment

Figure 11:
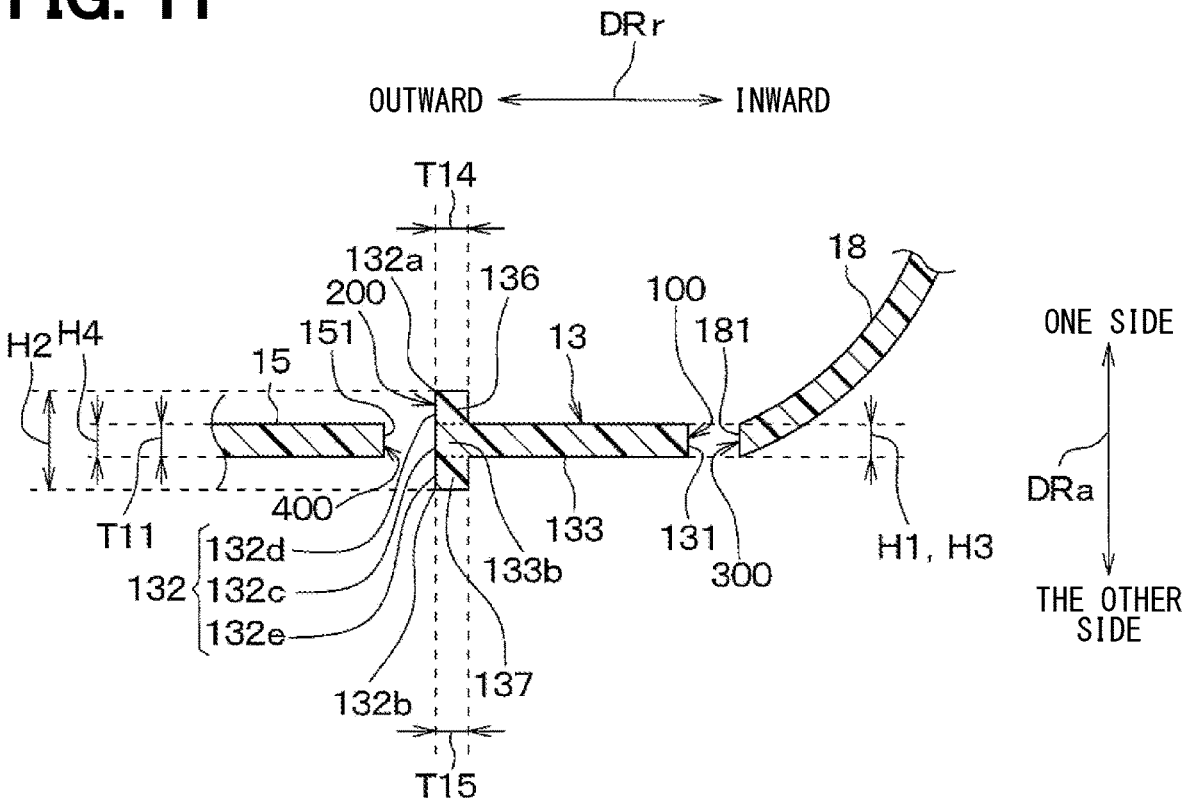
FIG. 11 is a cross-sectional view of a separation plate, a separation cylinder, and a partition plate according to an eighth embodiment.

As illustrated in FIG. 11, in the present embodiment, in the same manner as in the sixth embodiment, a separation plate 13 has two outer protruding portions 136 and 137. Thus, a height H2 of an outer end surface 132 is larger than a height H4 of a partition plate end surface 151. That is, the height H2 of an outer edge 200 is larger than the height H4 of a partition plate edge 400.

However, unlike the sixth embodiment, the separation plate 13 does not have two inner protruding portions 134 and 135. A height H1 of an inner end surface 131 is the same as a height H3 of a separation cylinder end surface 181. That is, the height H1 of an inner edge 100 is the same as the height H3 of a separation cylinder edge 300.

According to the present embodiment, among the effects of the sixth embodiment, the same effect as the effect achieved by the configuration common to the present embodiment is achieved.

In the second to fifth embodiments, the separation plate 13 may not have the inner protruding portions 134 and 135. Also in this case, the height H2 of the outer end surface 132 is larger than the height H4 of the partition plate end surface 151. A height H1 of an inner end surface 131 is the same as a height H3 of a separation cylinder end surface 181. With this configuration, among the effects of the second to fifth embodiments, the same effect as the effect achieved by the configuration common to the present embodiment is also achieved.

Ninth Embodiment

Figure 12:
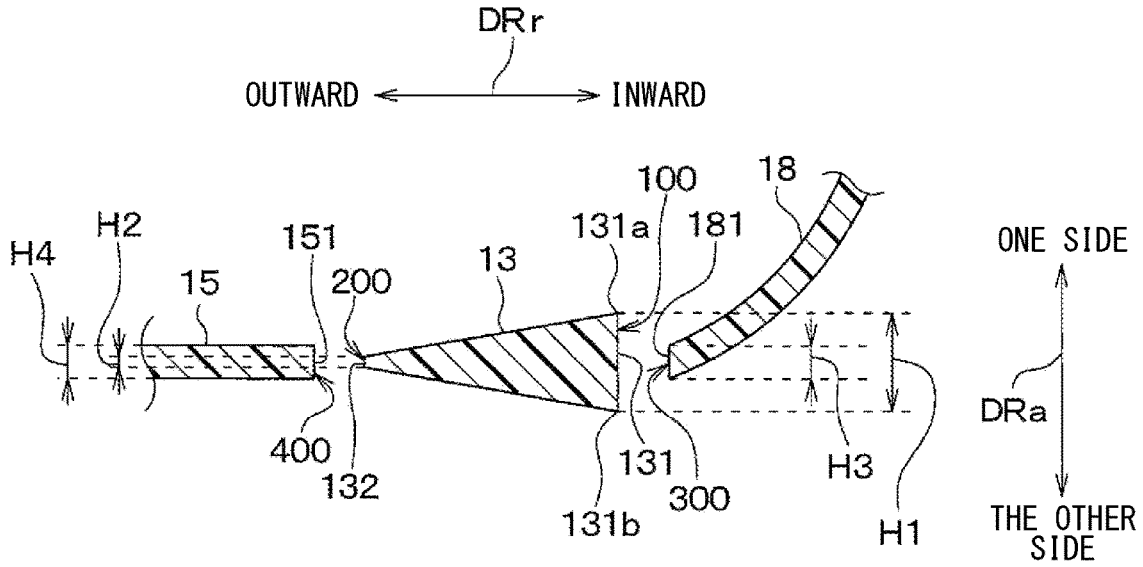
FIG. 12 is a cross-sectional view of a separation plate, a separation cylinder, and a partition plate according to a ninth embodiment.

As illustrated in FIG. 12, in the present embodiment, a shape of a separation plate 13 is different from that in the first embodiment. A configuration of a blower 10 other than the separation plate 13 is the same as that in the first embodiment.

The separation plate 13 extends inward from the outer side in the fan radial direction DRr. A thickness of the separation plate 13 is gradually increased toward the inner end of the separation plate 13 in a fan radial direction DRr from the outer end of the separation plate 13 in the fan radial direction DRr. In the same manner as in the first embodiment, a height H1 of an inner end surface 131 is larger than a height H3 of a separation cylinder end surface 181. On the other hand, unlike the first embodiment, a height H2 of an outer end surface 132 is smaller than a height H4 of a partition plate end surface 151. In other words, the height H1 of an inner edge 100 is larger than a height H3 of a separation cylinder edge 300. The height H2 of an outer edge 200 is smaller than the height H4 of a partition plate edge 400.

According to the present embodiment, among the effects of the first embodiment, the same effect as the effect achieved by the configuration common to the present embodiment is achieved.

Tenth Embodiment

Figure 13:
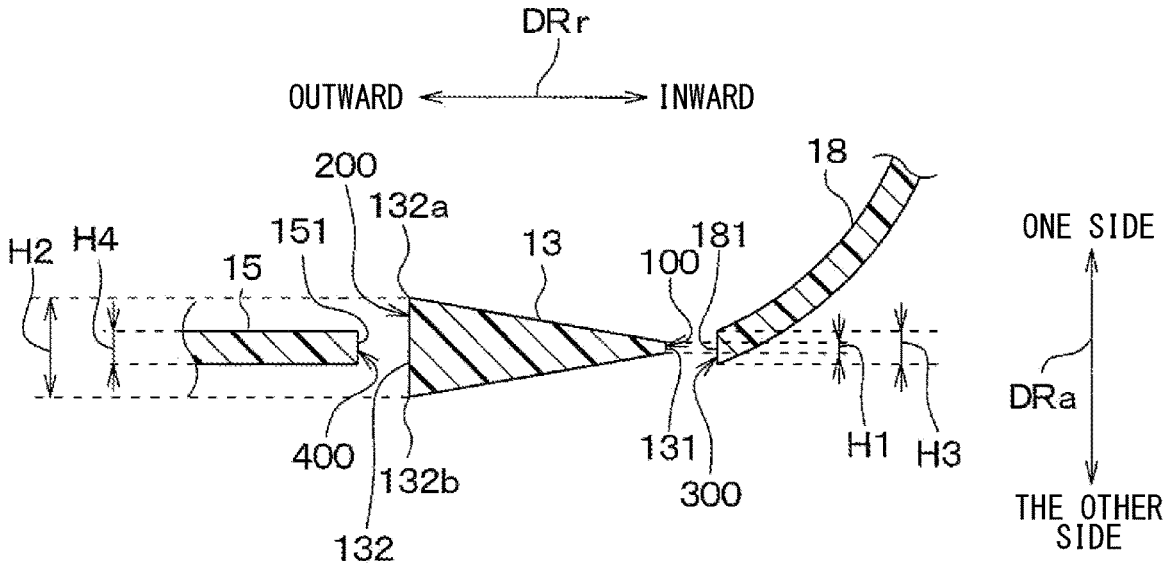
FIG. 13 is a cross-sectional view of a separation plate, a separation cylinder, and a partition plate according to a tenth embodiment.

As illustrated in FIG. 13, in the present embodiment, a shape of a separation plate 13 is different from that in the first embodiment. A configuration of a blower 10 other than the separation plate 13 is the same as that in the first embodiment.

The separation plate 13 extends outward from the inner side in the fan radial direction DRr. A thickness of the separation plate 13 is gradually increased toward the outer end of the separation plate 13 in a fan radial direction DRr from the inner end of the separation plate 13 in the fan radial direction DRr. In the same manner as in the first embodiment, a height H2 of an outer end surface 132 is larger than a height H4 of a partition plate end surface 151. On the other hand, unlike the first embodiment, a height H1 of an inner end surface 131 is smaller than a height H3 of a separation cylinder end surface 181. In other words, the height H2 of an outer edge 200 is larger than the height H4 of a partition plate edge 400. The height H1 of an inner edge 100 is smaller than the height H3 of a separation cylinder edge 300.

According to the present embodiment, among the effects of the first embodiment, the same effect as the effect achieved by the configuration common to the present embodiment is achieved.

Eleventh Embodiment

Figure 14:
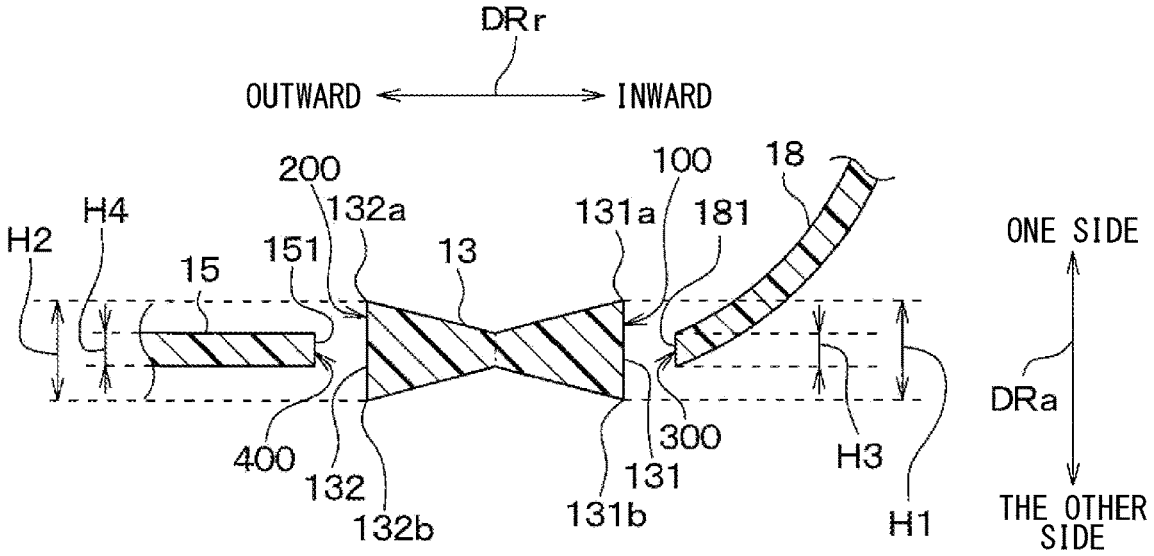
FIG. 14 is a cross-sectional view of a separation plate, a separation cylinder, and a partition plate according to an eleventh embodiment.

As illustrated in FIG. 14, in the present embodiment, a shape of a separation plate 13 is different from that in the first embodiment. A configuration of a blower 10 other than the separation plate 13 is the same as that in the first embodiment.

The separation plate 13 extends inward from the outer side in the fan radial direction DRr. A thickness of the separation plate 13 is gradually increased toward an inner end of the separation plate 13 in the fan radial direction DRr from a central portion of the separation plate 13 in the fan radial direction DRr. In the same manner as in the first embodiment, a height H1 of an inner end surface 131 is larger than a height H3 of a separation cylinder end surface 181.

A thickness of the separation plate 13 is gradually increased toward an outer end of the separation plate 13 in the fan radial direction DRr from the central portion of the separation plate 13 in the fan radial direction DRr. In the same manner as in the first embodiment, a height H2 of an outer end surface 132 is larger than a height H4 of a partition plate end surface 151.

In other words, the height H1 of an inner edge 100 is larger than a height H3 of a separation cylinder edge 300. A height H2 of an outer edge 200 is larger than a height H4 of a partition plate edge 400. According to the present embodiment, the same effect as that of the first embodiment is achieved.

Twelfth Embodiment

Figure 15:
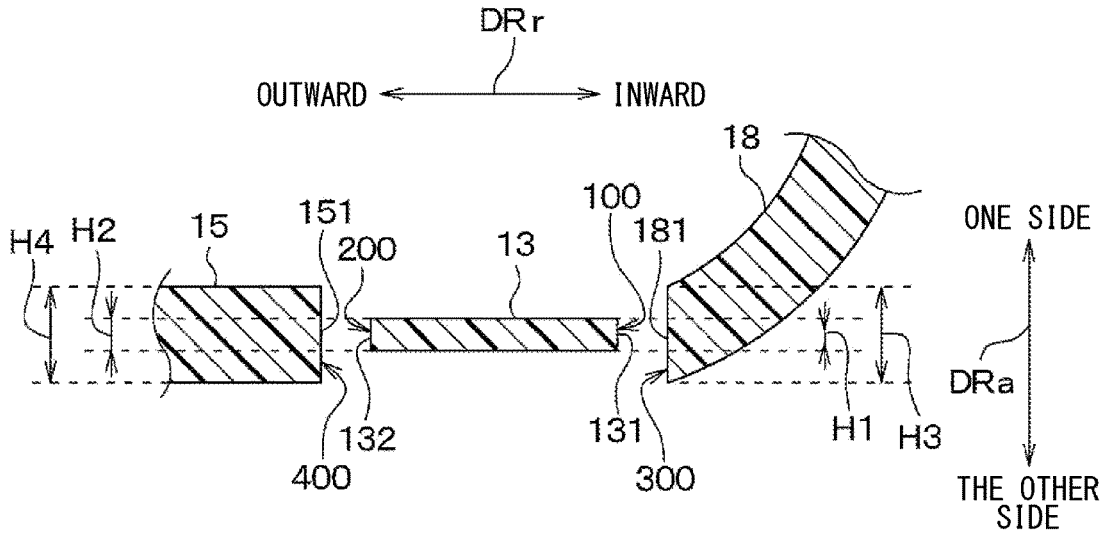
FIG. 15 is a cross-sectional view of a separation plate, a separation cylinder, and a partition plate according to a twelfth embodiment.

As illustrated in FIG. 15, in the present embodiment, a thickness of a separation cylinder 18 is larger than a thickness of a separation plate 13. A thickness of a partition plate 15 is larger than a thickness of the separation plate 13. The thickness of the separation plate 13 is the same over the entire region in the extension direction of the separation plate 13. A thickness of the separation cylinder 18 is the same over the entire region of the separation cylinder 18 in the extension direction. A thickness of the partition plate 15 is the same over the entire region of the partition plate 15 in the extension direction.

Therefore, a height H3 of a separation cylinder end surface 181 is larger than a height H1 of an inner end surface 131. A height H4 of a partition plate end surface 151 is larger than a height H2 of an outer end surface 132. In other words, the height H3 of a separation cylinder edge 300 is larger than the height H1 of an inner edge 100. The height H4 of a partition plate edge 400 is lower than the height H2 of an outer edge 200.

Figure 16:
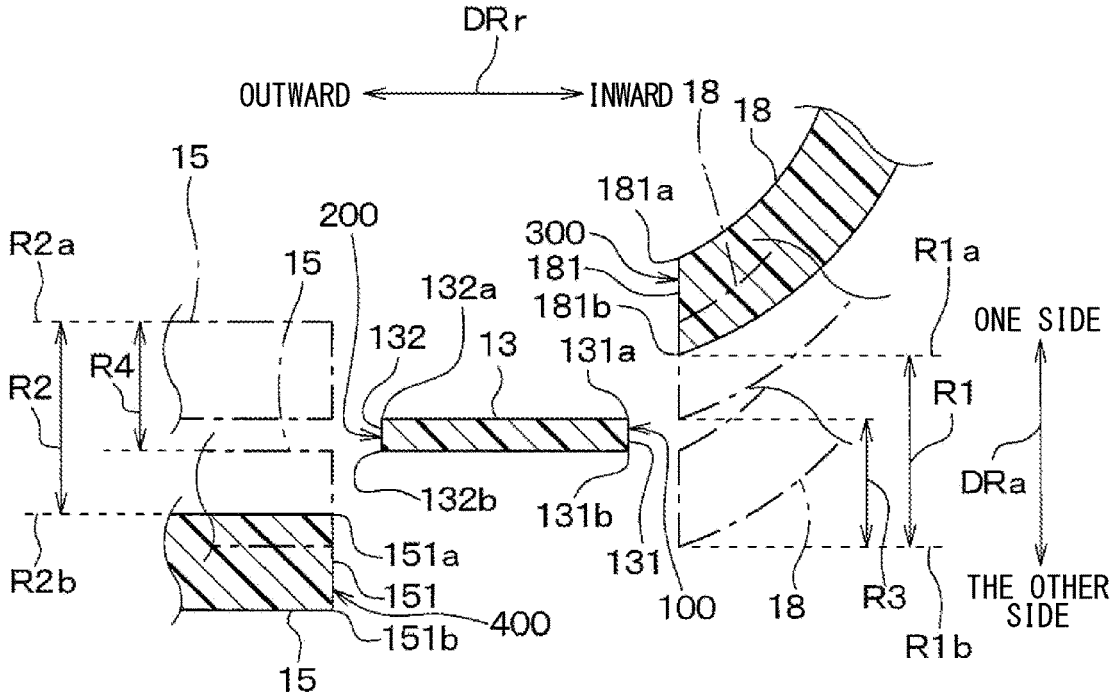
FIG. 16 is a cross-sectional view of the separation plate, the separation cylinder, and the partition plate according to the twelfth embodiment to illustrate an allowable positional relationship between the separation cylinder and the separation plate and an allowable positional relationship between the partition plate and the separation plate.

As illustrated in FIG. 16, also in the present embodiment, in the same manner as in the first embodiment, when a position of the other end 181*b* of a separation cylinder end surface 181 in the fan axial direction DRa is within a first range R1, the separability of two air flows FL1 and FL2 can be maintained. Positions of one end R1*a* and the other end R1*b* of the first range R1 are set in the same manner as in the first embodiment.

In the same manner as in the first embodiment, when a position of one end 151*a* of a partition plate end surface 151 in the fan axial direction DRa is within a second range R2, the separability of the two air flows FL1 and FL2 can be maintained. Positions of one end R2*a* and the other end R2*b* of the second range R2 are set in the same manner as in the first embodiment.

Next, the blower 10 of the present embodiment is compared with a blower J10 of Comparative Example 1 illustrated in FIG. 4. A thickness of the separation plate 13 of a blower 10 of the present embodiment is the same as the thickness of the separation plate 13 of the blower J10 of Comparative Example 1.

In the blower 10 of the present embodiment, the height H3 of the separation cylinder end surface 181 is larger than the height H1 of the inner end surface 131. Therefore, in the blower 10 of the present embodiment, the height H3 of the separation cylinder end surface 181 is increased compared with the blower J10 of Comparative Example 1.

As a result, in the same manner as in the blower 10 of the first embodiment, in the relative positional relationship between the separation cylinder 18 and the separation plate 13 in the fan axial direction DRa, a facing range R3 in which the separation cylinder end surface 181 and the inner end surface 131 face each other in the fan radial direction DRr is wider than the facing range Rc3 in the blower J10 of the comparative example 1. That is, the facing range R3 when the separation cylinder edge 300 and the inner edge 100 face each other in the fan radial direction DRr is wider than the facing range Rc3 in the blower J10 of Comparative Example 1.

Therefore, according to the blower 10 of the present embodiment, the first range R1 can be widened more than the first range Rc1 of the blower J10 of Comparative Example 1. Therefore, during assembly of the blower 10, even though a positional deviation occurs in relative positions between the separation cylinder 18 and the separation plate 13 in the fan axial direction DRa, the separability of the two air flow FL1 and FL2 can be maintained.

Similarly, in the blower 10 of the present embodiment, the height H4 of the partition plate end surface 151 is larger than the height H2 of the outer end surface 132. Therefore, in the blower 10 of the present embodiment, the height H4 of the partition plate end surface 151 is increased compared with the blower J10 of Comparative Example 1.

Consequently, in the same manner as in the blower 10 of the first embodiment, in the relative positional relationship between the partition plate 15 and the separation plate 13 in the fan axial direction DRa, a facing range R4 in which the partition plate 15 and the outer end surface 132 face each other in the fan radial direction DRr is wider than the facing range Rc4 in the blower J10 of the comparative example 1. That is, the facing range R4 when the partition plate edge 400 and the outer edge 200 face each other in the fan radial direction DRr is wider than the facing range Rc4 in the blower J10 of Comparative Example 1.

Therefore, according to the blower 10 of the present embodiment, the second range R2 can be widened more than the second range Rc2 of Comparative Example 1. Therefore, during assembly of the blower 10, even though a positional deviation occurs in relative positions between the partition plate 15 and the separation plate 13 in the fan axial direction DRa, the separability of the two air flows FL1 and FL2 can be maintained.

Thirteenth Embodiment

Figure 17:
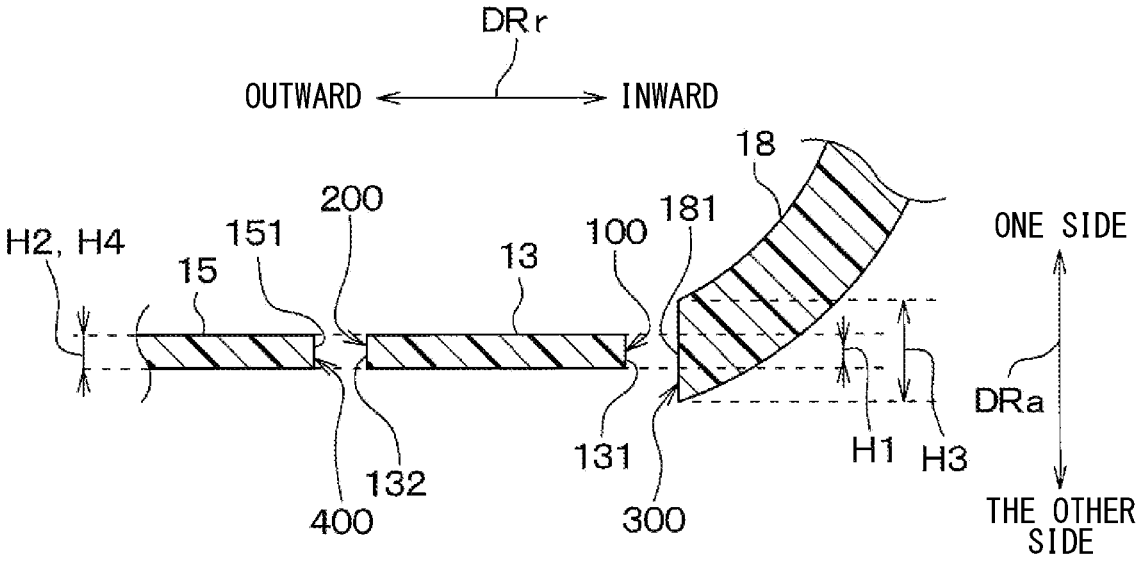
FIG. 17 is a cross-sectional view of a separation plate, a separation cylinder, and a partition plate according to a thirteenth embodiment.

As illustrated in FIG. 17, in the present embodiment, in the same manner as in the twelfth embodiment, a thickness of a separation cylinder 18 is larger than a thickness of a separation plate 13. Therefore, a height H3 of a separation cylinder end surface 181 is larger than a height H1 of an inner end surface 131. That is, a height H3 of a separation cylinder edge 300 is larger than a height H1 of an inner edge 100.

However, unlike the twelfth embodiment, a thickness of a partition plate 15 is the same as a thickness of a separation plate 13. Therefore, a height H4 of a partition plate end surface 151 is the same as a height H2 of an outer end surface 132. That is, the height H4 of a partition plate edge 400 is the same as the height H2 of an outer edge 200.

According to the present embodiment, among the effects of the twelfth embodiment, the same effect as the effect achieved by the configuration common to the present embodiment is achieved.

Fourteenth Embodiment

Figure 18:
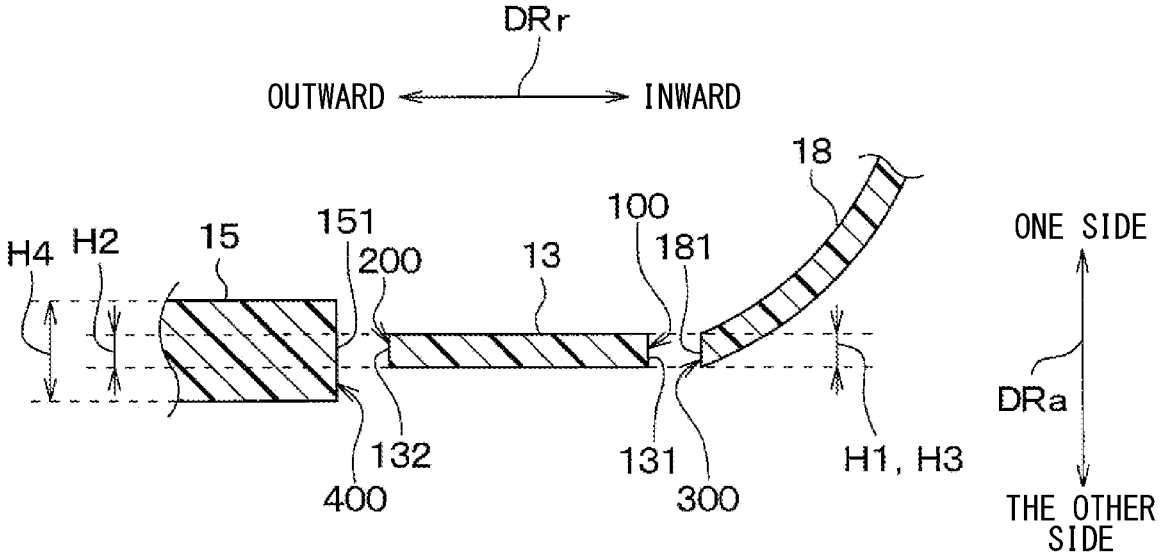
FIG. 18 is a cross-sectional view of a separation plate, a separation cylinder, and a partition plate according to a fourteenth embodiment.

As illustrated in FIG. 18, in the present embodiment, in the same manner as in the twelfth embodiment, a thickness of a partition plate 15 is larger than a thickness of a separation plate 13. Therefore, a height H4 of a partition plate end surface 151 is larger than a height H2 of an outer end surface 132. That is, the height H4 of a partition plate edge 400 is larger than a height H2 of an outer edge 200.

However, a thickness of a separation cylinder 18 is the same as the thickness of the separation plate 13. Therefore, a height H3 of a separation cylinder end surface 181 is the same as a height H1 of an inner end surface 131. That is, the height H3 of a separation cylinder edge 300 is the same as the height H1 of an inner edge 100.

According to the present embodiment, among the effects of the twelfth embodiment, the same effect as the effect achieved by the configuration common to the present embodiment is achieved.

Fifteenth Embodiment

Figure 19:
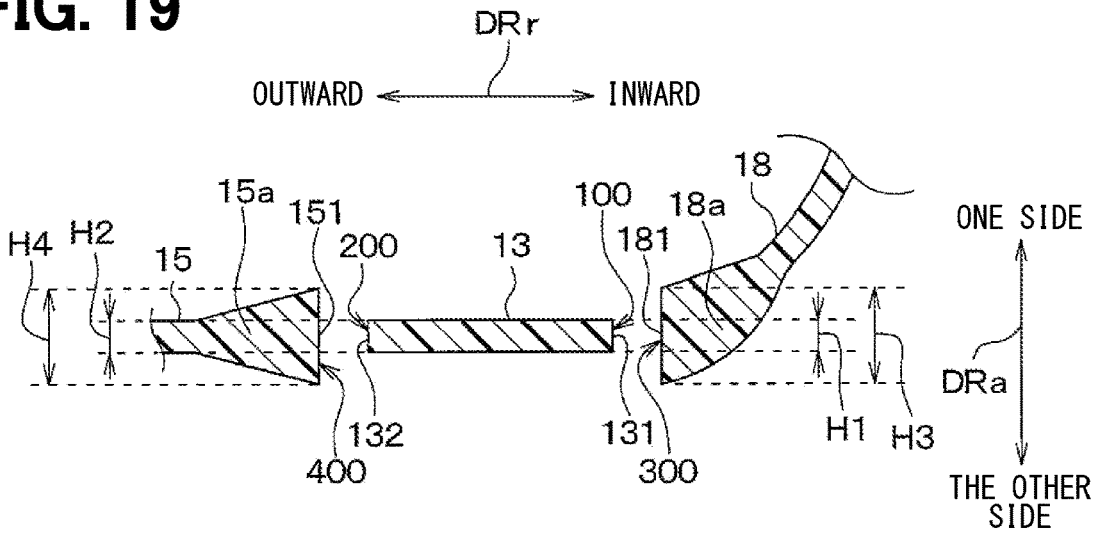
FIG. 19 is a cross-sectional view of a separation plate, a separation cylinder, and a partition plate according to a fifteenth embodiment.

As illustrated in FIG. 19, a thickness of a separation cylinder 18 is gradually increased as extended outward from the inner side in the fan radial direction DRr in an outer portion 18*a* that is an outer portion of the separation cylinder 18 in the fan radial direction DRr and includes an end of the separation cylinder 18 in the fan radial direction DRr. In the same manner as in the twelfth embodiment, a height H3 of a separation cylinder end surface 181 is larger than a height H1 of an inner end surface 131. That is, a height H3 of a separation cylinder edge 300 is larger than a height H1 of an inner edge 100.

A thickness of a partition plate 15 is gradually increased as extended inward from the outer side in the fan radial direction DRr in an inner portion 15*a* that is an inner portion of the partition plate 15 in the fan radial direction DRr and includes an inner end of the partition plate 15 in the fan radial direction DRr. In the same manner as in the twelfth embodiment, a height H4 of a partition plate end surface 151 is larger than a height H2 of an outer end surface 132. That is, the height H4 of a partition plate edge 400 is larger than a height H2 of an outer edge 200.

According to the present embodiment, the same effect as that of the twelfth embodiment is achieved.

Sixteenth Embodiment

Figure 20:
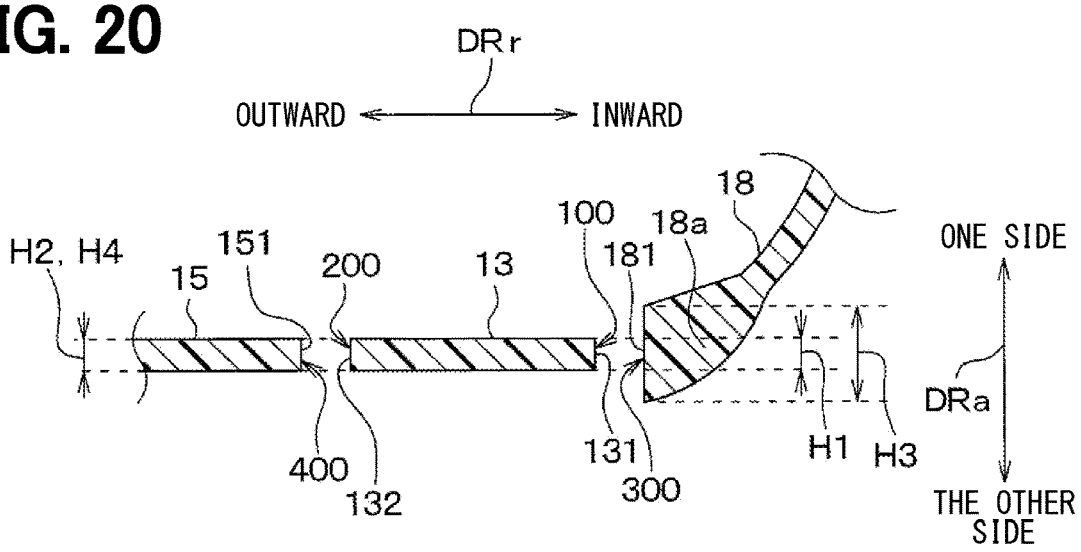
FIG. 20 is a cross-sectional view of a separation plate, a separation cylinder, and a partition plate according to a sixteenth embodiment.

As illustrated in FIG. 20, in the same manner as in the fifteenth embodiment, a thickness of a separation cylinder 18 is gradually increased outward from the inner side in the fan radial direction DRr in an outer portion 18*a* of the separation cylinder 18. A height H3 of a separation cylinder end surface 181 is larger than a height H1 of an inner end surface 131. That is, a height H3 of a separation cylinder edge 300 is larger than a height H1 of an inner edge 100.

However, unlike the fifteenth embodiment, a thickness of a partition plate 15 is uniform over the entire region in the extension direction of the partition plate 15, and is the same as a thickness of a separation plate 13. Therefore, a height H4 of a partition plate end surface 151 is the same as a height H2 of an outer end surface 132. That is, the height H4 of a partition plate edge 400 is the same as the height H2 of an outer edge 200.

According to the present embodiment, among the effects of the fifteenth embodiment, the same effect as the effect achieved by the configuration common to the present embodiment is achieved.

Seventeenth Embodiment

Figure 21:
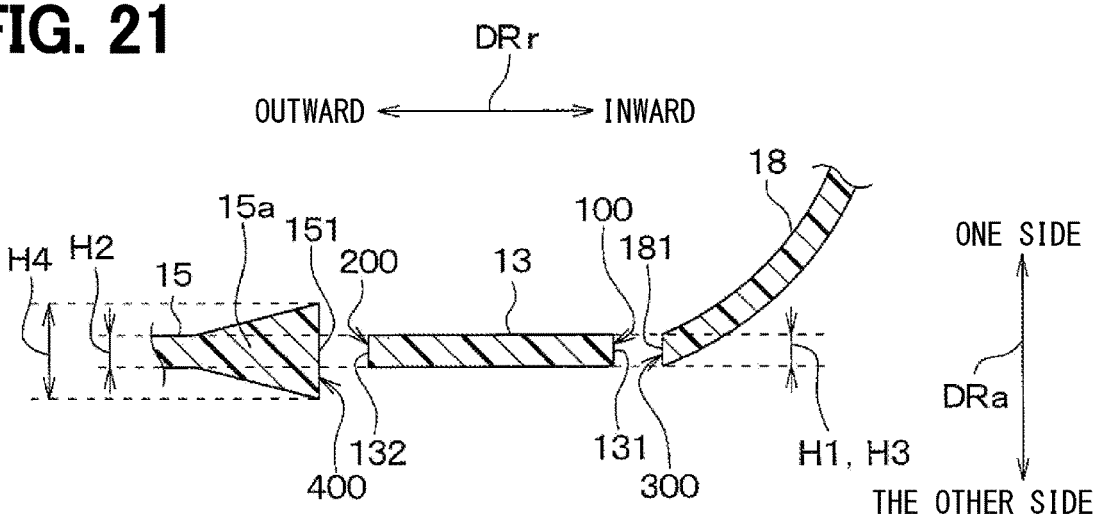
FIG. 21 is a cross-sectional view of a separation plate, a separation cylinder, and a partition plate according to a seventeenth embodiment.

As illustrated in FIG. 21, as in the fifteenth embodiment, a thickness of a partition plate 15 is gradually increased inward from the outer side in the fan radial direction DRr in an inner portion 15*a* of the partition plate 15. A height H4 of a partition plate end surface 151 is larger than a height H2 of an outer end surface 132. That is, the height H4 of a partition plate edge 400 is larger than a height H2 of an outer edge 200.

However, unlike the fifteenth embodiment, a thickness of the separation cylinder 18 is uniform over the entire region in the extension direction of the separation cylinder 18, and is the same as a thickness of a separation plate 13. Therefore, a height H3 of a separation cylinder end surface 181 is the same as a height H1 of an inner end surface 131. That is, the height H3 of a separation cylinder edge 300 is the same as the height H1 of an inner edge 100.

According to the present embodiment, among the effects of the fifteenth embodiment, the same effect as the effect achieved by the configuration common to the present embodiment is achieved.

Eighteenth Embodiment

Figure 22:
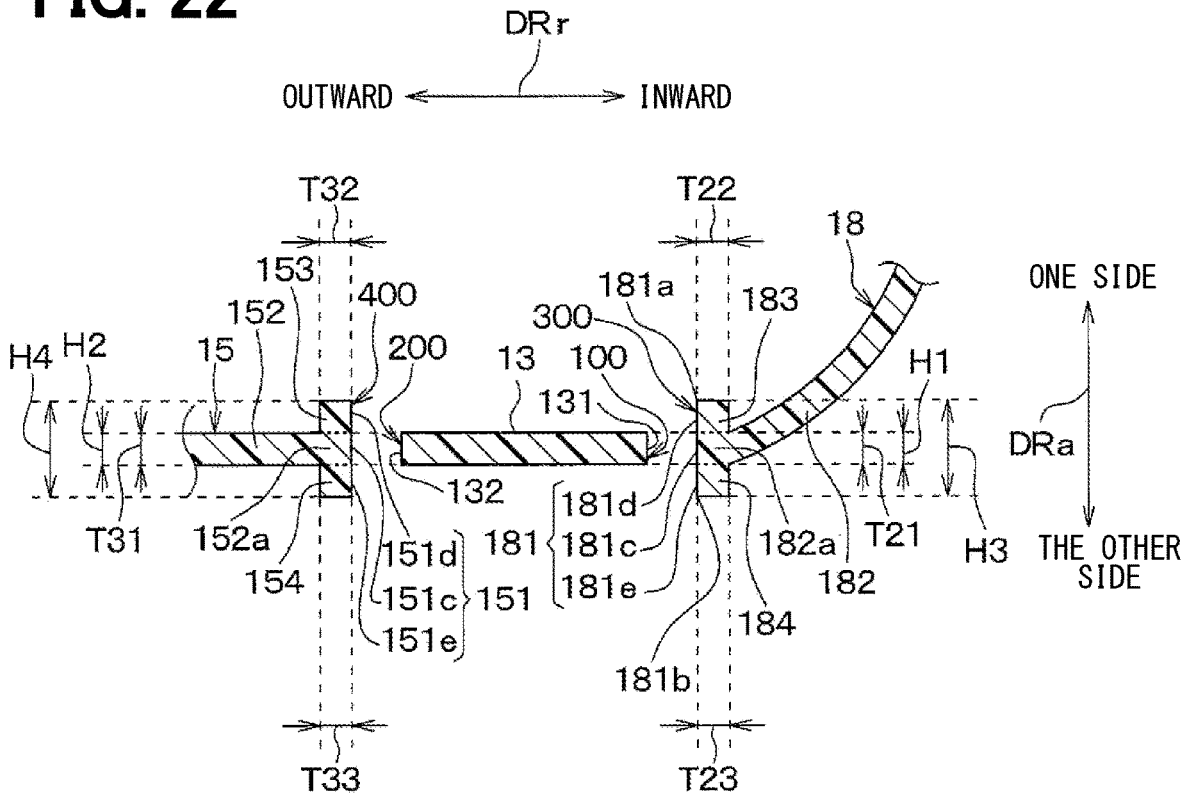
FIG. 22 is a cross-sectional view of a separation plate, a separation cylinder, and a partition plate according to an eighteenth embodiment.

As illustrated in FIG. 22, a separation cylinder 18 has a separation cylinder main body portion 182 and two separation cylinder protruding portions 183 and 184. The separation cylinder main body portion 182 extends from one side in the fan axial direction DRa toward an end on the other side, and extends to be located on the outer side in the fan radial direction DRr toward the end on the other side in the fan axial direction DRa. The separation cylinder main body portion 182 includes an outer end of a separation cylinder 18 in the fan radial direction DRr. The separation cylinder main body portion 182 has an outer portion 182*a* that is an outer portion of the separation cylinder main body portion 182 in the fan radial direction DRr and includes an outer end of the separation cylinder 18 in the fan radial direction DRr.

One separation cylinder protruding portion 183 of the two separation cylinder protruding portions 183 and 184 protrudes from an outer portion 182*a* toward one side in the fan axial direction DRa. The other separation cylinder protruding portion 184 of the two separation cylinder protruding portions 183 and 184 protrudes from the outer portion 182*a* to the other side in the fan axial direction DRa. Protruding directions of the two separation cylinder protruding portions 183 and 184 are directions parallel to the fan axial direction DRa.

In the present embodiment, a separation cylinder end surface 181 includes an outer end surface 181*c* of the separation cylinder main body portion 182 in the fan radial direction DRr, an outer end surface 181*d* of the one separation cylinder protruding portion 183 in the fan radial direction DRr, and an outer end surface 181*e* of the other separation cylinder protruding portion 184 in the fan radial direction DRr.

A partition plate 15 includes a partition plate main body portion 152, and two partition plate protruding portions 153 and 154. The partition plate main body portion 152 extends inward from the outer side in the fan radial direction DRr. The partition plate main body portion 152 includes an inner end of the partition plate 15 in the fan radial direction DRr. The partition plate main body portion 152 has an inner portion 152*a* that is an inner portion of the partition plate main body portion 152 in the fan radial direction DRr and includes an inner end of the partition plate 15 in the fan radial direction DRr.

One partition plate protruding portion 153 of the two partition plate protruding portions 153 and 154 protrudes from an inner portion 152*a* to one side in the fan axial direction DRa. The other partition plate protruding portion 154 of the two partition plate protruding portions 153 and 154 protrudes from the inner portion 152*a* to the other side in the fan axial direction DRa. Protruding directions of the two partition plate protruding portions 153 and 154 are directions parallel to the fan axial direction DRa.

In the present embodiment, a partition plate end surface 151 includes an inner end surface 151*c* of the partition plate main body portion 152 in the fan radial direction DRr, an inner end surface 151*d* of the one partition plate protruding portion 153 in the fan radial direction DRr, and an inner end surface 151*e* of the other partition plate protruding portion 154 in the fan radial direction DRr.

In the present embodiment, in the same manner as in the twelfth embodiment, a height H3 of the separation cylinder end surface 181 is larger than a height H1 of an inner end surface 131. A height H4 of a partition plate end surface 151 is larger than a height H2 of an outer end surface 132. In other words, a separation cylinder edge 300 includes the two separation cylinder protruding portions 183 and 184. As a result, the height H3 of the separation cylinder edge 300 is larger than the height H1 of an inner edge 100. A partition plate edge 400 includes the two partition plate protruding portions 153 and 154. Thus, the height H4 of the partition plate edge 400 is larger than the height H2 of an outer edge 200. Therefore, according to the present embodiment, the same effect as that of the twelfth embodiment can be achieved.

According to the present embodiment, a thickness of the separation cylinder 18 in a portion formed by only the separation cylinder main body portion 182 among the separation cylinder main body portion 182 and the two separation cylinder protruding portions 183 and 184 is smaller than the height H3 of the separation cylinder end surface 181. The thickness of the separation cylinder 18 is a thickness in the normal direction to a surface of the separation cylinder 18.

Therefore, compared with a case where the thickness of the separation cylinder 18 is uniform with the same size as the height H3 of the separation cylinder end surface 181 in the entire separation cylinder 18, a material required to form the separation cylinder 18 can be reduced.

Similarly, according to the present embodiment, a thickness of the partition plate 15 in a portion formed by only the partition plate main body portion 152 among the partition plate main body portion 152 and the two partition plate protruding portions 153 and 154 is smaller than the height H4 of the partition plate end surface 151. The thickness of the partition plate 15 is a thickness in the normal direction to a surface of the partition plate 15.

Therefore, compared with a case where the thickness of the partition plate 15 is uniform with the same size as the height H4 of the partition plate end surface 151 in the entire partition plate 15, a material required to form the partition plate 15 can be reduced.

According to the present embodiment, each of thicknesses T22 and T23 of the two separation cylinder protruding portions 183 and 184 is the same as a thickness T21 of the separation cylinder main body portion 182. The thicknesses T22 and T23 of the two separation cylinder protruding portions 183 and 184 are respectively thicknesses in the normal direction to the end surfaces 181*d* and 181*e* of the two separation cylinder protruding portions 183 and 184. In the present embodiment, the normal direction to the end surfaces 181*d* and 181*e* is the fan radial direction DRr. The thickness T21 of the separation cylinder main body portion 182 is a thickness in the normal direction to a surface of the separation cylinder main body portion 182. The thickness T21 of the separation cylinder main body portion 182 is measured at the portion formed of only the separation cylinder main body portion 182 among the separation cylinder main body portion 182 and the two separation cylinder protruding portions 183 and 184.

As described above, in the present embodiment, the thickness of the separation cylinder 18 is uniform over the entire separation cylinder 18. The thickness of the separation cylinder 18 is a thickness (that is, a plate thickness) of a plate-shaped portion of the separation cylinder 18.

According to the configuration, it is possible to increase the height H3 of the separation cylinder end surface 181 while suppressing an increase in the thickness of the separation cylinder 18, compared with a case where the separation cylinder 18 is formed by only the separation cylinder main body portion 182 of the present embodiment. Thus, in the same manner as in the separation plate 13 of the second embodiment, it is possible to suppress an increase in the cooling time during resin molding of the separation cylinder 18.

In order to suppress an increase in the cooling time during resin molding of the separation cylinder 18, each of the thicknesses T22 and T23 of the two separation cylinder protruding portions 183 and 184 may be equal to or less than the thickness T21 of the separation cylinder main body portion 182.

Similarly, according to the present embodiment, each of thicknesses T32 and T33 of the two partition plate protruding portions 153 and 154 is the same as a thickness T31 of the partition plate main body portion 152. The thicknesses T32 and T33 of the two partition plate protruding portions 153 and 154 are respectively thicknesses in the normal direction to the end surfaces 151*d* and 151*e* of the two partition plate protruding portions 153 and 154. In the present embodiment, the normal direction to the end surfaces 151*d* and 151*e* is the fan radial direction DRr. The thickness T31 of the partition plate main body portion 152 is a thickness in the normal direction to a surface of the partition plate main body portion 152. In the present embodiment, the normal direction to the surface of the partition plate main body portion 152 is a direction perpendicular to the fan axial direction DRa. The thickness T31 of the partition plate main body portion 152 is measured at a portion formed by only the partition plate main body portion 152 among the partition plate main body portion 152 and the two partition plate protruding portions 153 and 154.

As described above, in the present embodiment, the thickness of the partition plate 15 is uniform over the entire partition plate 15. The thickness of the partition plate 15 is a thickness (that is, the plate thickness) of a plate-shaped portion of the partition plate 15.

According the configuration, compared with a case where the partition plate 15 is formed by only the partition plate main body portion 152 of the present embodiment, it is possible to increase the height H4 of the partition plate end surface 151 while suppressing an increase in the thickness of the partition plate 15. Therefore, in the same manner as in the separation plate 13 of the second embodiment, it is possible to suppress an increase in the cooling time during resin molding of the partition plate 15.

In order to suppress an increase in the cooling time during resin molding of the partition plate 15, each of the thicknesses T32 and T33 of the two partition plate protruding portions 153 and 154 may be equal to or less than the thickness T31 of the partition plate main body portion 152.

Nineteenth Embodiment

Figure 23:
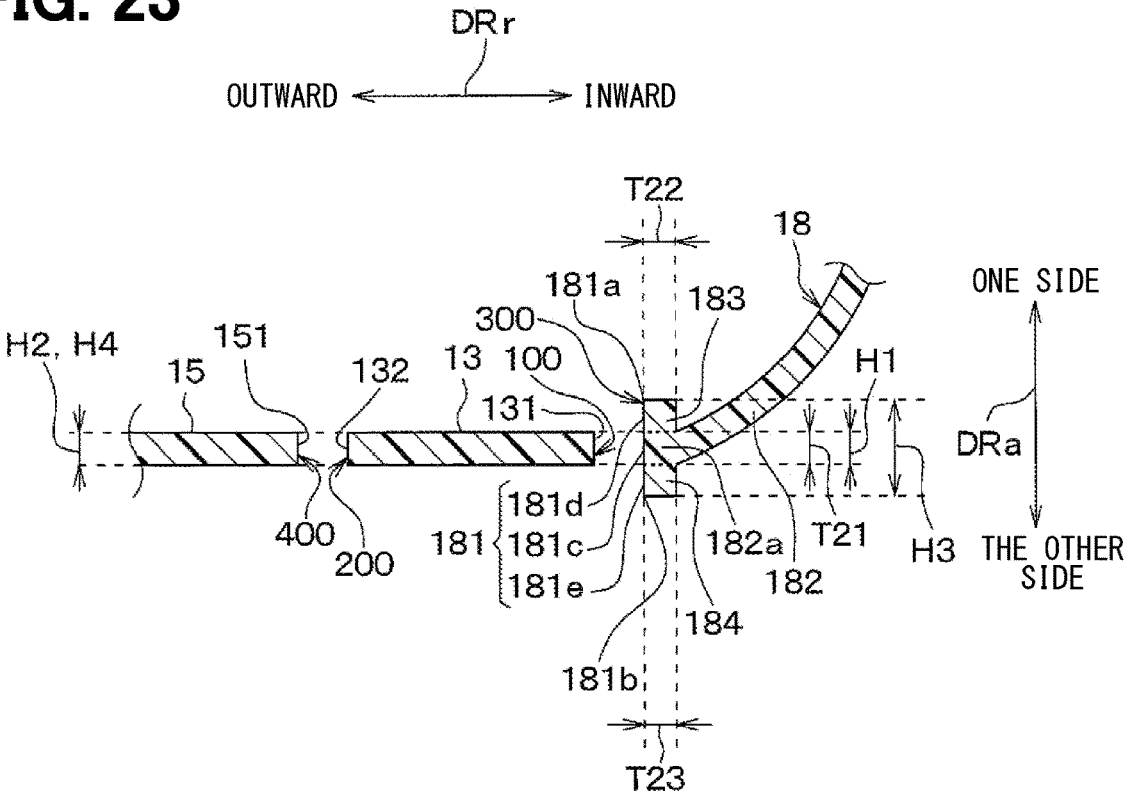
FIG. 23 is a cross-sectional view of a separation plate, a separation cylinder, and a partition plate according to a nineteenth embodiment.

As illustrated in FIG. 23, in the present embodiment, in the same manner as in the eighteenth embodiment, a separation cylinder 18 has a separation cylinder main body portion 182 and two separation cylinder protruding portions 183 and 184. As a result, a height H3 of a separation cylinder end surface 181 is larger than a height H1 of an inner end surface 131. That is, a height H3 of a separation cylinder edge 300 is larger than a height H1 of an inner edge 100.

However, unlike the eighteenth embodiment, a partition plate 15 does not have two partition plate protruding portions 153 and 154. A height H4 of a partition plate end surface 151 is the same as a height H2 of an outer end surface 132. That is, the height H4 of a partition plate edge 400 is the same as the height H2 of an outer edge 200.

According to the present embodiment, among the effects of the eighteenth embodiment, the same effect as the effect achieved by the configuration common to the present embodiment is also achieved. In the present embodiment and the eighteenth embodiment, the separation cylinder 18 has the two separation cylinder protruding portions 183 and 184. However, the separation cylinder 18 may have only one of the two separation cylinder protruding portions 183 and 184. According to the configuration, the same effect as in a case where the two separation cylinder protruding portions 183 and 184 are provided is also achieved.

Twentieth Embodiment

Figure 24:
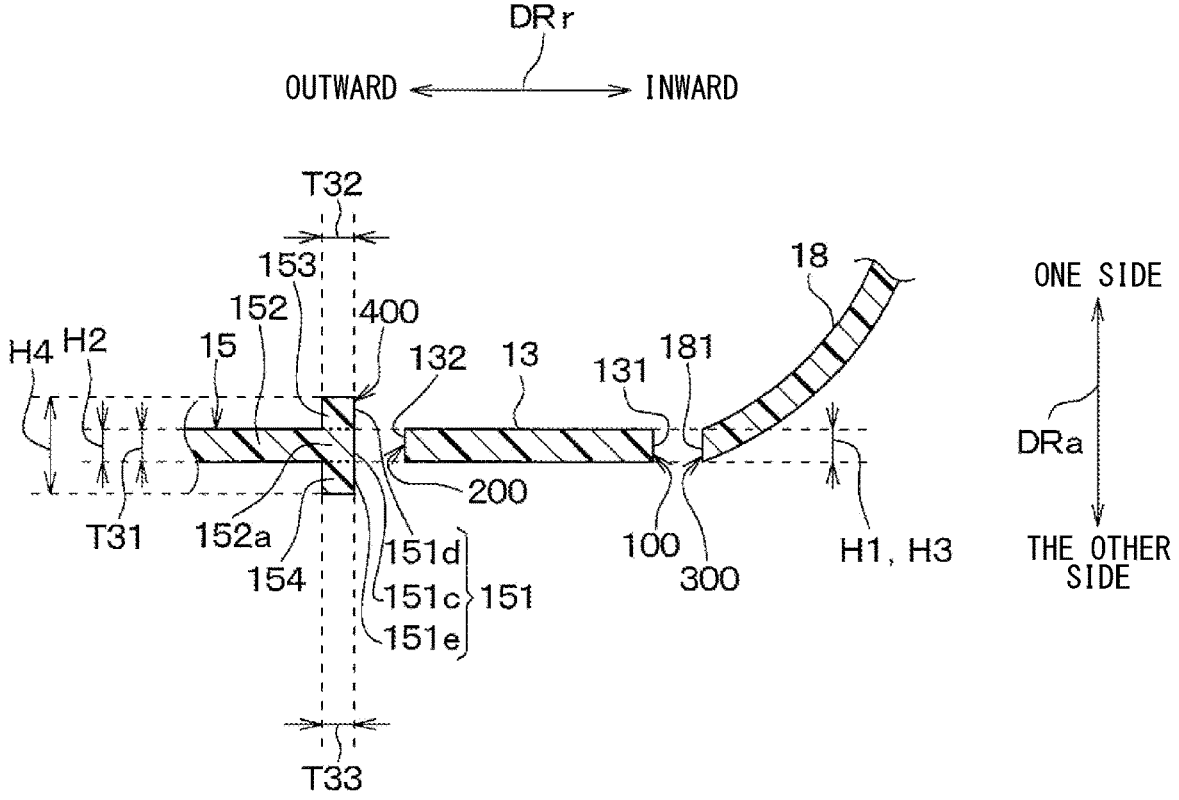
FIG. 24 is a cross-sectional view of a separation plate, a separation cylinder, and a partition plate according to a twentieth embodiment.

As illustrated in FIG. 24, in the present embodiment, in the same manner as in the eighteenth embodiment, a partition plate 15 includes a partition plate main body portion 152 and two partition plate protruding portions 153 and 154. Thus, a height H4 of a partition plate end surface 151 is larger than a height H2 of an outer end surface 132. That is, the height H4 of a partition plate edge 400 is larger than a height H2 of an outer edge 200.

However, unlike the eighteenth embodiment, the separation cylinder 18 does not have two separation cylinder protruding portions 183 and 184. A height H3 of a separation cylinder end surface 181 is the same as a height H1 of an inner end surface 131. That is, the height H3 of a separation cylinder edge 300 is the same as the height H1 of an inner edge 100.

According to the present embodiment, among the effects of the eighteenth embodiment, the same effect as the effect achieved by the configuration common to the present embodiment is also achieved. In the present embodiment and the eighteenth embodiment, the partition plate 15 has the two partition plate protruding portions 153 and 154. However, the partition plate 15 may have only one of the two partition plate protruding portions 153 and 154. According to the configuration, the same effect as in a case where the two partition plate protruding portions 153 and 154 are provided is also achieved.

Twenty-First Embodiment

Figure 25:
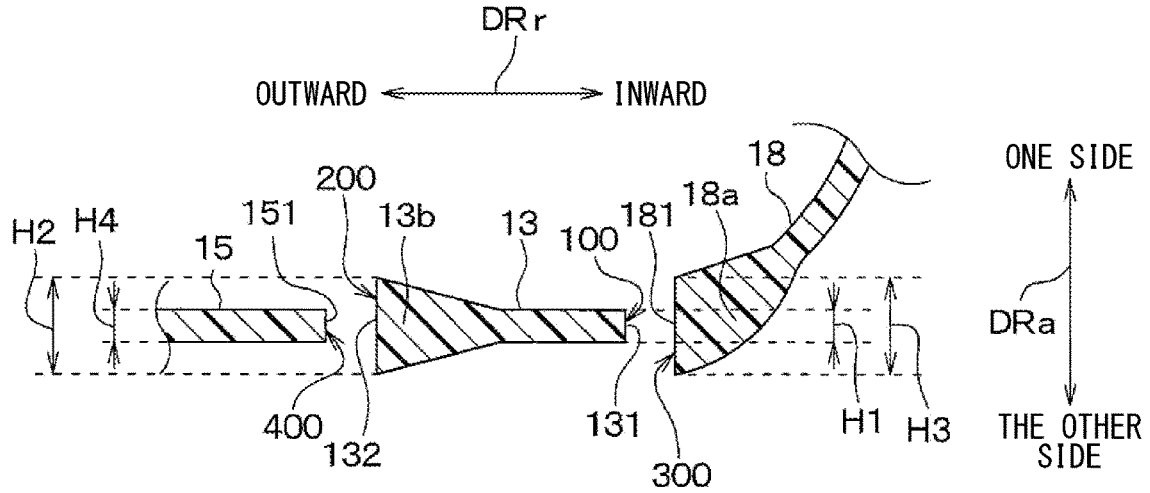
FIG. 25 is a cross-sectional view of a separation plate, a separation cylinder, and a partition plate according to a 21st embodiment.

As illustrated in FIG. 25, in the same manner as in the fifteenth embodiment, the thickness of the separation cylinder 18 is gradually increased toward an outer end from the inner side in the fan radial direction DRr in an outer portion 18*a* of a separation cylinder 18. A height H3 of a separation cylinder end surface 181 is larger than a height H1 of an inner end surface 131. That is, a height H3 of a separation cylinder edge 300 is larger than a height H1 of an inner edge 100. Therefore, according to the present embodiment, among the effects of the fifteenth embodiment, the same effect as the effect achieved by the configuration common to the present embodiment can be achieved.

A thickness of a separation plate 13 is gradually increased toward an outer end from the inner side in the fan radial direction DRr in an outer portion 13*b* that is an outer portion of the separation plate 13 in the fan radial direction DRr and includes an outer end of the separation plate 13 in the fan radial direction DRr. In the same manner as in the first embodiment, a height H2 of an outer end surface 132 is larger than a height H4 of a partition plate end surface 151. That is, the height H2 of an outer edge 200 is larger than the height H4 of a partition plate edge 400. Therefore, according to the present embodiment, among the effects of the first embodiment, the same effect as the effect achieved by the configuration common to the present embodiment is achieved.

Twenty-Second Embodiment

Figure 26:
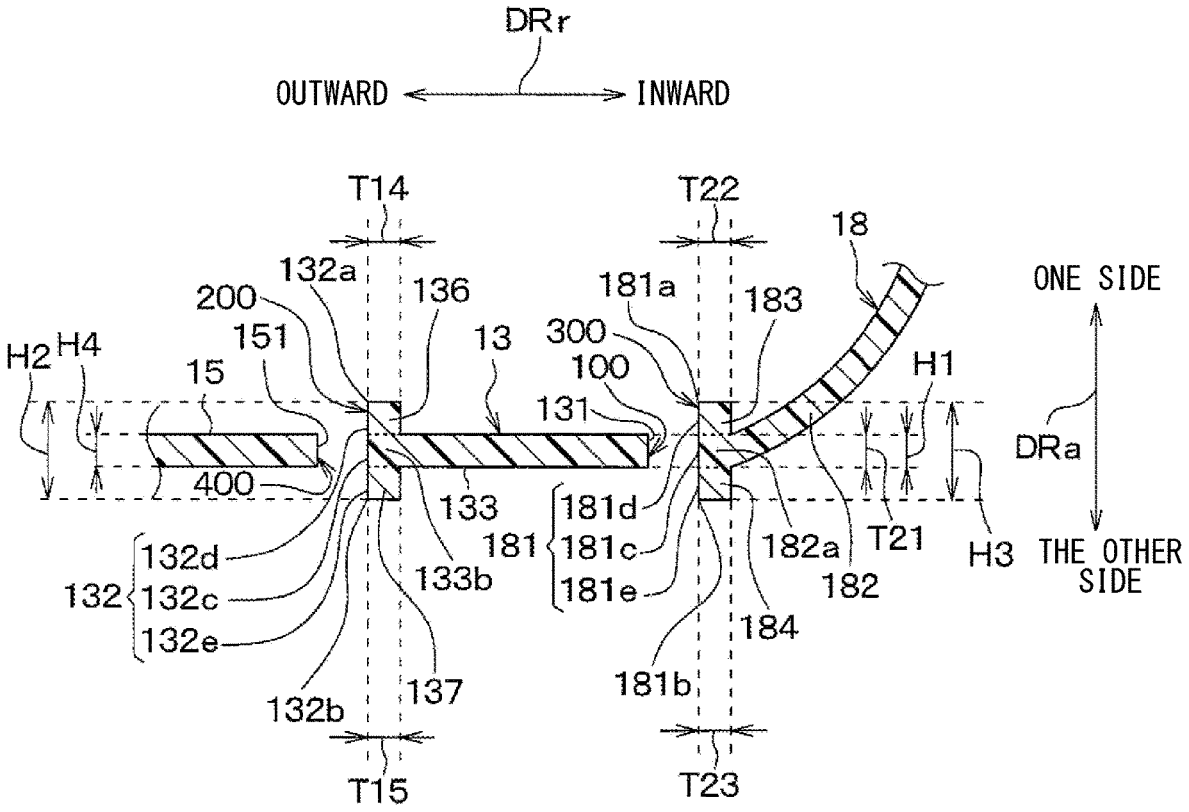
FIG. 26 is a cross-sectional view of a separation plate, a separation cylinder, and a partition plate according to a 22nd embodiment.

As illustrated in FIG. 26, in the present embodiment, in the same manner as in the eighteenth embodiment, a separation cylinder 18 has a separation cylinder main body portion 182 and two separation cylinder protruding portions 183 and 184. As a result, a height H3 of a separation cylinder end surface 181 is larger than a height H1 of an inner end surface 131. That is, a height H3 of a separation cylinder edge 300 is larger than a height H1 of an inner edge 100. Therefore, according to the present embodiment, among the effects of the eighteenth embodiment, the same effect as the effect achieved by the configuration common to the present embodiment is also achieved. The separation cylinder 18 may have only one of the two separation cylinder protruding portions 183 and 184.

In the present embodiment, in the same manner as in the sixth embodiment, a separation plate 13 has two outer protruding portions 136 and 137. Thus, a height H2 of an outer end surface 132 of the separation plate 13 in the fan axial direction DRa is larger than a height H4 of a partition plate end surface 151 in the fan axial direction DRa. That is, the height H2 of an outer edge 200 is larger than the height H4 of a partition plate edge 400. Therefore, according to the present embodiment, among the effects of the sixth embodiment, the same effect as the effect achieved by the configuration common to the present embodiment is achieved. The separation plate 13 may have only one of the two outer protruding portions 136 and 137.

Twenty-Third Embodiment

Figure 27:
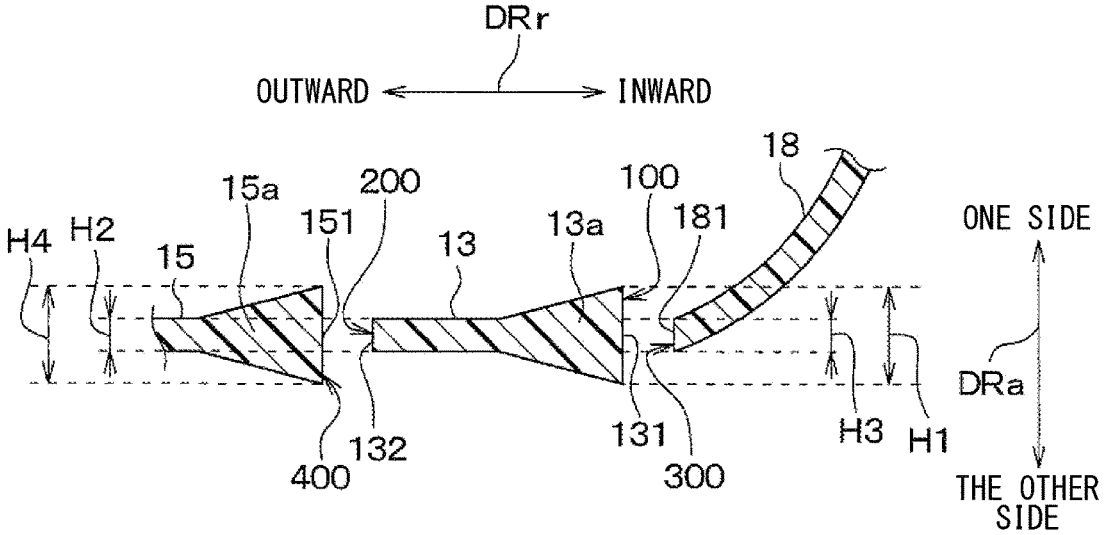
FIG. 27 is a cross-sectional view of a separation plate, a separation cylinder, and a partition plate according to a 23rd embodiment.

As illustrated in FIG. 27, a thickness of a separation plate 13 is gradually increased toward an inner end from the outer side in the fan radial direction DRr in an inner portion 13*a* that is an inner portion of the separation plate 13 in the fan radial direction DRr and includes the inner end of the separation plate 13 in the fan radial direction DRr. Then, in the same manner as in the first embodiment, a height H1 of an inner end surface 131 in the fan axial direction DRa is larger than a height H3 of the separation cylinder end surface 181 in the fan axial direction DRa. That is, the height H1 of an inner edge 100 is larger than the height H3 of a separation cylinder edge 300. Therefore, according to the present embodiment, among the effects of the first embodiment, the same effect as the effect achieved by the configuration common to the present embodiment is achieved.

In the same manner as in the fifteenth embodiment, a thickness of a partition plate 15 is gradually increased inward from the outer side in the fan radial direction DRr in an inner portion 15*a* of a partition plate 15. A height H4 of a partition plate end surface 151 is larger than a height H2 of an outer end surface 132. That is, the height H4 of a partition plate edge 400 is larger than a height H2 of an outer edge 200. Therefore, according to the present embodiment, among the effects of the fifteenth embodiment, the same effect as the effect achieved by the configuration common to the present embodiment can be achieved.

Twenty-Fourth Embodiment

Figure 28:
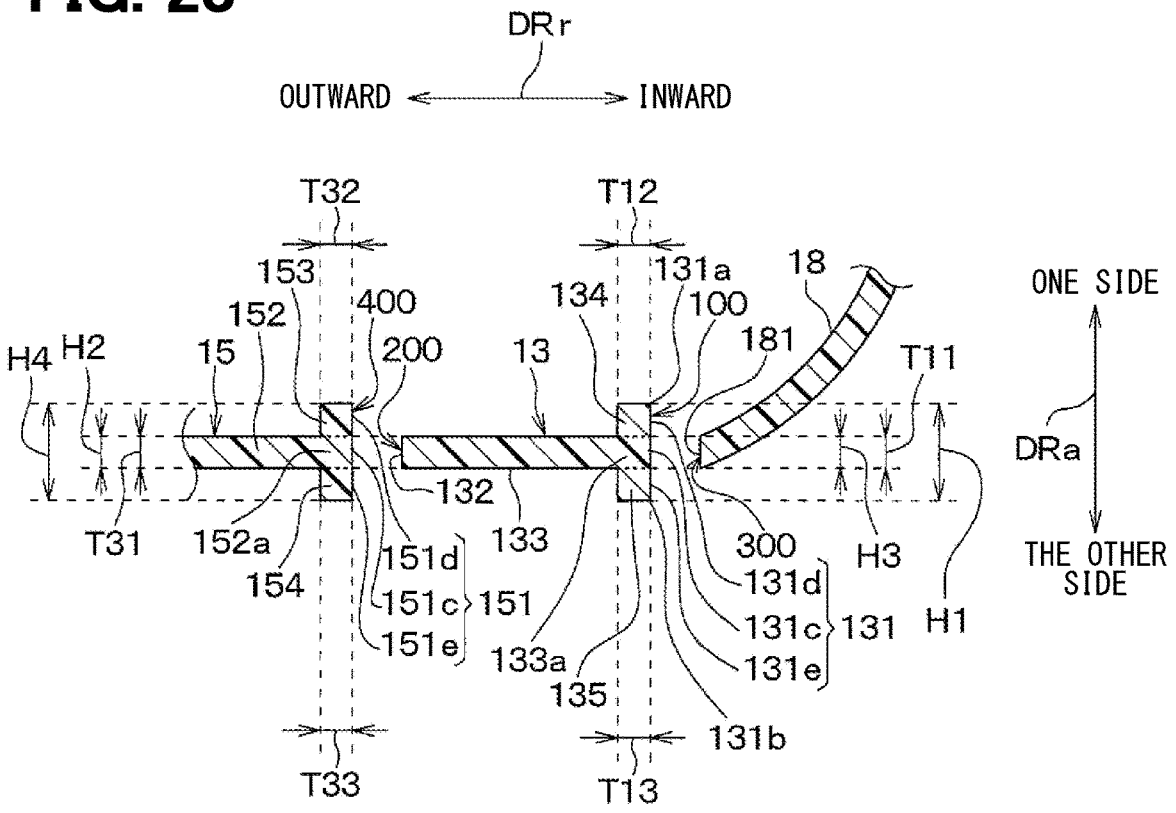
FIG. 28 is a cross-sectional view of a separation plate, a separation cylinder, and a partition plate according to a 24th embodiment.

As illustrated in FIG. 28, in the present embodiment, in the same manner as in the sixth embodiment, a separation plate 13 has two inner protruding portions 134 and 135. As a result, a height H1 of an inner end surface 131 is larger than a height H3 of a separation cylinder end surface 181. In other words, an inner edge 100 includes the two inner protruding portions 134 and 135. As a result, the height H1 of the inner edge 100 is larger than the height H3 of a separation cylinder edge 300. Therefore, according to the present embodiment, among the effects of the sixth embodiment, the same effect as the effect achieved by the configuration common to the present embodiment is achieved.

The separation plate 13 may have only one of the two inner protruding portions 134 and 135. According to the configuration, the same effect as a case where the two inner protruding portions 134 and 135 are provided is also achieved.

In the present embodiment, in the same manner as in the eighteenth embodiment, a partition plate 15 includes a partition plate main body portion 152 and two partition plate protruding portions 153 and 154. Thus, a height H4 of a partition plate end surface 151 is larger than a height H2 of an outer end surface 132. In other words, a partition plate edge 400 includes the two partition plate protruding portions 153 and 154. Thus, the height H4 of the partition plate edge 400 is larger than the height H2 of an outer edge 200. Therefore, according to the present embodiment, among the effects of the eighteenth embodiment, the same effect as the effect achieved by the configuration common to the present embodiment is achieved.

The partition plate 15 may have only one of the two partition plate protruding portions 153 and 154. According to the configuration, the same effect as in a case where the two partition plate protruding portions 153 and 154 are provided is also achieved.

Twenty-Fifth Embodiment

Figure 29:
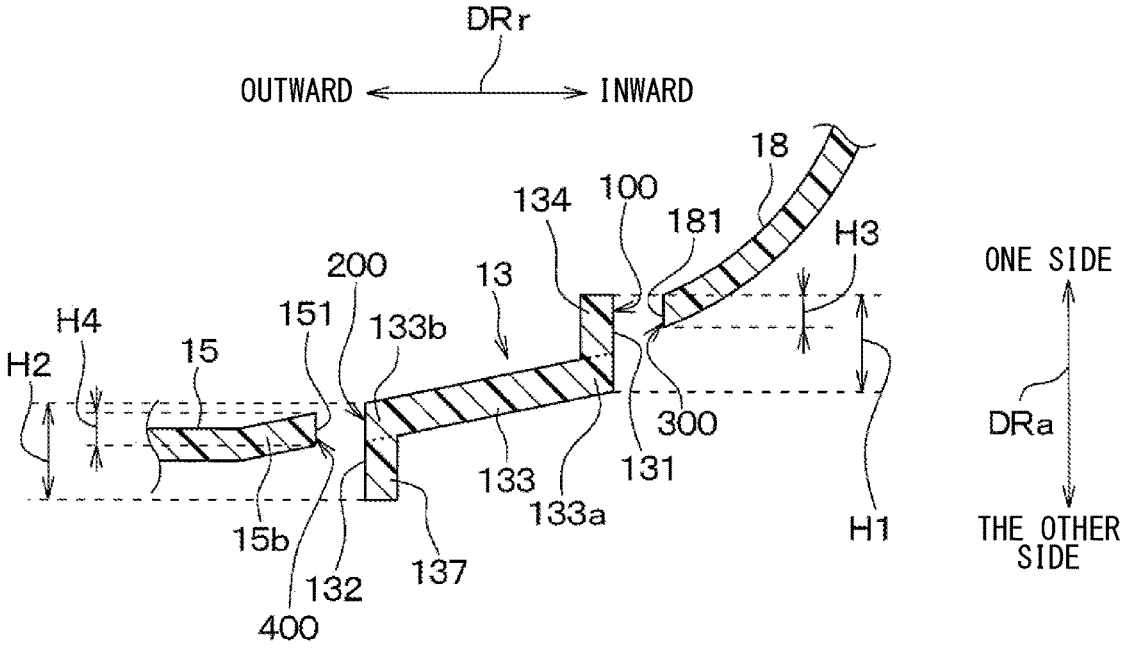
FIG. 29 is a cross-sectional view of a separation plate, a separation cylinder, and a partition plate according to a 25th embodiment.

In the fourth embodiment illustrated in FIG. 7, the extension direction of the separation plate main body portion 133 is a direction perpendicular to the fan axial direction DRa. In contrast, as illustrated in FIG. 29, in the present embodiment, the extension direction of a separation plate main body portion 133 is a direction inclined with respect to the direction perpendicular to the fan axial direction DRa such that an inner portion 133*a* of the separation plate main body portion 133 is located further toward one side in the fan axial direction DRa than an outer portion 133*b*.

In the present embodiment, the extension direction of an inner portion 15*b* that is an inner portion of a partition plate 15 in the fan radial direction DRr and includes an inner end of the partition plate 15 in the fan radial direction DRr is a direction inclined with respect to the direction perpendicular to the fan axial direction DRa.

According to the present embodiment, the same effects as the effects of the first and second embodiments are also achieved. In each of the above embodiments, in the same manner as in the present embodiment, the extension direction of the whole or a part of the separation plate 13 may be a direction inclined with respect to the direction perpendicular to the fan axial direction DRa. In each of the above embodiments, in the same manner as in the present embodiment, the extension direction of the whole or a part of the partition plate 15 may be a direction inclined with respect to the direction perpendicular to the fan axial direction DRa.

Twenty-Sixth Embodiment

Figure 30:
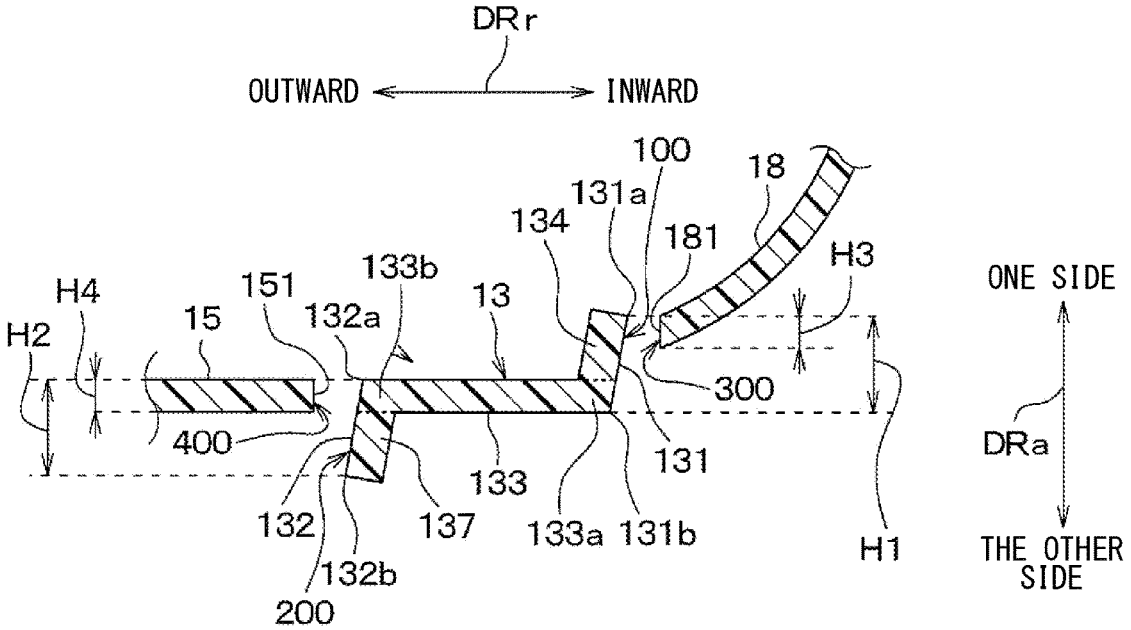
FIG. 30 is a cross-sectional view of a separation plate, a separation cylinder, and a partition plate according to a 26th embodiment.

In the fourth embodiment illustrated in FIG. 7, the inner end surface 131 and the outer end surface 132 are parallel to the fan axial direction DRa. In contrast, as illustrated in FIG. 30, in the present embodiment, an inner end surface 131 and an outer end surface 132 extend in a direction inclined with respect to the fan axial direction DRa.

Specifically, the inner end surface 131 extends from one side to the other side in the fan axial direction DRa such that one end 131*a* is located further inward in the fan radial direction DRr than the other end 131*b*. The outer end surface 132 extends from one side to the other side in the fan axial direction DRa such that one end 132*a* is located further inward in the fan radial direction DRr than the other end 132*b*.

Also in the present embodiment, in the same manner as in the first embodiment, a height H1 of the inner end surface 131 is larger than a height H3 of a separation cylinder end surface 181. A height H2 of the outer end surface 132 is larger than a height H4 of a partition plate end surface 151. In other words, the height H1 of an inner edge 100 is larger than a height H3 of a separation cylinder edge 300. A height H2 of an outer edge 200 is larger than a height H4 of a partition plate edge 400. Therefore, according to the present embodiment, the same effect as that of the first embodiment is also achieved.

In the present embodiment, an angle of the inner end surface 131 with respect to the fan axial direction DRa and an angle of the outer end surface 132 with respect to the fan axial direction DRa are set as follows. It is assumed that a position of the separation cylinder 18 with respect to the separation plate 13 is within the facing range R3 illustrated in FIG. 3, and varies in the fan axial direction DRa. In this case, an angle of the inner end surface 131 is set such that a size of a gap between the separation cylinder end surface 181 and the inner end surface 131 is equal to or less than a predetermined value. Similarly, it is assumed that a position of the partition plate 15 with respect to the separation plate 13 is within the facing range R4 illustrated in FIG. 3, and varies in the fan axial direction DRa. In this case, an angle of the outer end surface 132 is set such that a size of a gap between the partition plate end surface 151 and the outer end surface 132 is equal to or less than a predetermined value.

Thus, as long as the same effect as that of the first embodiment is achieved, the inner end surface 131 and the outer end surface 132 may be slightly inclined with respect to the fan axial direction DRa. Although not illustrated, in each of the above embodiments, as long as the same effect as that of the first embodiment is achieved, the separation cylinder end surface 181 and the partition plate end surface 151 may extend in a direction inclined with respect to the fan axial direction DRa as in the present embodiment.

Twenty-Seventh Embodiment

Figure 31:
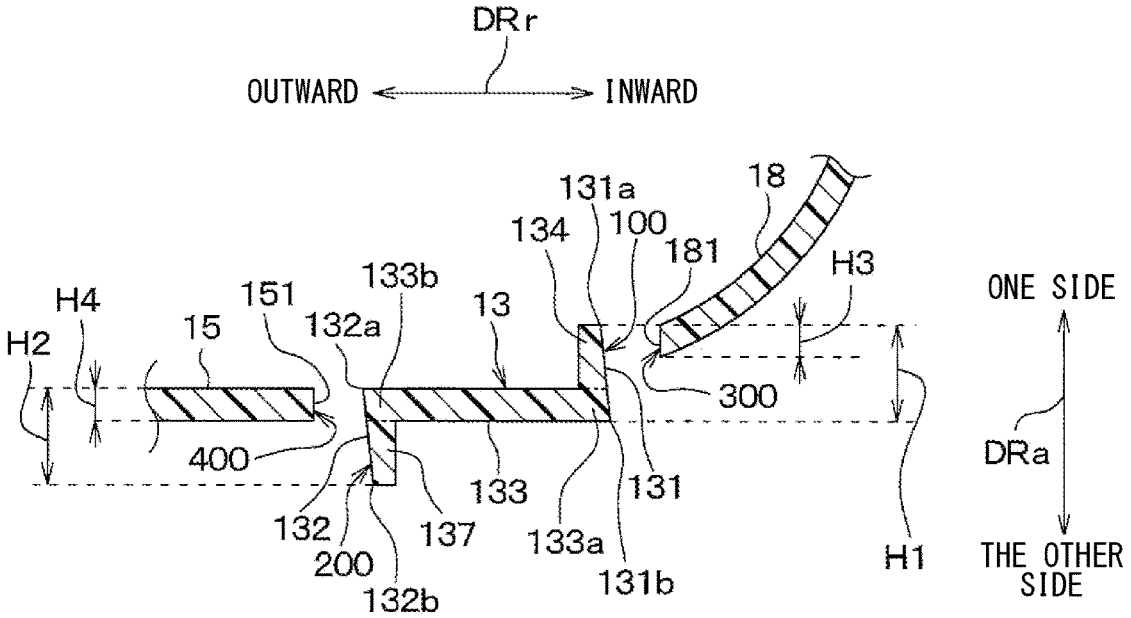
FIG. 31 is a cross-sectional view of a separation plate, a separation cylinder, and a partition plate according to a 27th embodiment.

As illustrated in FIG. 31, in the present embodiment, with respect to the twenty-sixth embodiment, inclined directions of an inner end surface 131 and an outer end surface 132 are different from those in the twenty-sixth embodiment. The inner end surface 131 extends from one side to the other side in the fan axial direction DRa such that one end 131*a* is located further outward in the fan radial direction DRr than the other end 131*b*. The outer end surface 132 extends from one side to the other side in the fan axial direction DRa such that one end 132*a* is located further outward in the fan radial direction DRr than the other end 132*b*.

Also in the present embodiment, in the same manner as in the first embodiment, a height H1 of the inner end surface 131 is larger than a height H3 of a separation cylinder end surface 181. A height H2 of the outer end surface 132 is larger than a height H4 of a partition plate end surface 151. In other words, the height H1 of an inner edge 100 is larger than a height H3 of a separation cylinder edge 300. A height H2 of an outer edge 200 is larger than a height H4 of a partition plate edge 400. Therefore, according to the present embodiment, the same effect as that of the first embodiment is also achieved.

In the present embodiment, in the same manner as in the twenty-sixth embodiment, an angle of the inner end surface 131 with respect to the fan axial direction DRa and an angle of the outer end surface 132 with respect to the fan axial direction DRa are set.

Thus, as long as the same effect as that of the first embodiment is achieved, the inner end surface 131 and the outer end surface 132 may be slightly inclined with respect to the fan axial direction DRa. Although not illustrated, in each of the above embodiments, as long as the same effect as that of the first embodiment is achieved, the separation cylinder end surface 181 and the partition plate end surface 151 may extend in a direction inclined with respect to the fan axial direction DRa as in the present embodiment.

Twenty-Eighth Embodiment

Figure 32:
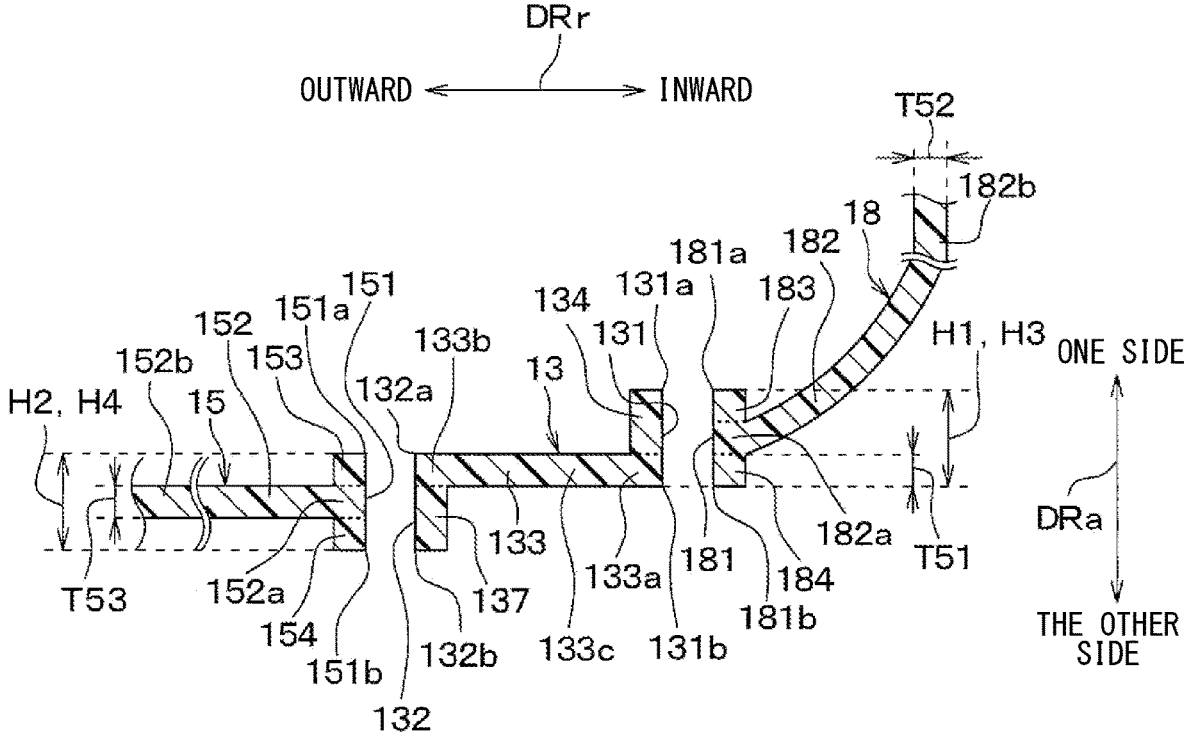
FIG. 32 is a cross-sectional view of a separation plate, a separation cylinder, and a partition plate according to a 28th embodiment.

As illustrated in FIG. 32, a separation plate 13 includes a separation plate main body portion 133, an inner protruding portion 134, and an outer protruding portion 137. The separation plate main body portion 133, the inner protruding portion 134, and the outer protruding portion 137 are the same as those in the fourth embodiment.

A height H1 of the inner end surface 131 is larger than a thickness T51 of a separation plate central portion 133*c*. A height H2 of the outer end surface 132 is larger than the thickness T51 of the separation plate central portion 133*c*. The separation plate central portion 133*c* is located at the center of the separation plate 13 in the fan radial direction DRr. The thickness T51 of the separation plate central portion 133*c* is a length of the separation plate central portion 133*c* in the normal direction to a surface of the separation plate central portion 133*c*.

A separation cylinder 18 includes a separation cylinder main body portion 182, and two separation cylinder protruding portions 183 and 184. The separation cylinder main body portion 182 and the two separation cylinder protruding portions 183 and 184 are the same as those in the eighteenth embodiment.

A height H3 of a separation cylinder end surface 181 is larger than a thickness T52 of a separation cylinder central portion 182*b*. The separation cylinder central portion 182*b* is located at the center of the separation cylinder 18 in the fan axial direction DRa. The thickness T52 of the separation cylinder central portion 182*b* is a length of the separation cylinder central portion 182*b* in the normal direction to a surface of the separation cylinder central portion 182*b*.

A partition plate 15 includes a partition plate main body portion 152, and two partition plate protruding portions 153 and 154. The partition plate main body portion 152 and the two partition plate protruding portions 153 and 154 are the same as those in the eighteenth embodiment.

A height H4 of a partition plate end surface 151 is larger than a thickness T53 of a partition plate central portion 152*b*. The partition plate central portion 152*b* is located at the center of the partition plate 15 in the fan radial direction DRr. The thickness T53 of the partition plate central portion 152*b* is a length of the partition plate central portion 152*b* in the normal direction to a surface of the partition plate central portion 152*b*.

In the present embodiment, the height H1 of the inner end surface 131 is the same as the height H3 of the separation cylinder end surface 181. The height H2 of the outer end surface 132 is the same as the height H4 of the partition plate end surface 151. A blower 10 has the same configuration as that in the first embodiment except for the above configuration.

Next, the blower 10 of the present embodiment is compared with a blower J10 of Comparative Example 1 illustrated in FIG. 4. The blower J10 of the comparative example 1 is different from the blower 10 of the present embodiment in that the separation plate 13 does not have the inner protruding portion 134 and the outer protruding portion 137, the separation cylinder 18 does not have two protruding portions such as the separation cylinder protruding portions 183 and 184, and the partition plate 15 does not have two protruding portions such as the partition plate protruding portions 153 and 154. In the blower J10 of Comparative Example 1, the height H1 of the inner end surface 131 is the same as the thickness T51 of the separation plate central portion 133*c*. The height H3 of the separation cylinder end surface 181 is the same as the thickness T52 of the separation cylinder central portion 182*b*. The height H4 of the partition plate end surface 151 is the same as the thickness T53 of the partition plate central portion 152*b*.

In the blower 10 of the present embodiment, in the same manner as in the first embodiment, the height H1 of the inner end surface 131 is increased compared with the blower J10 of Comparative Example 1. In the blower 10 of the present embodiment, in the same manner as in the twelfth embodiment, the height H3 of the separation cylinder end surface 181 is increased compared with the blower J10 of Comparative Example 1.

Consequently, in the same manner as in the first embodiment and the twelfth embodiment, in the relative positional relationship between the separation cylinder 18 and the separation plate 13 in the fan axial direction DRa, a facing range when the separation cylinder end surface 181 and the inner end surface 131 face each other in the fan radial direction DRr is wider than the facing range Rc3 in the blower J10 of the comparative example 1.

Therefore, according to the blower 10 of the present embodiment, in the relative positional relationship between the separation cylinder 18 and the separation plate 13, a range in the fan axial direction DRa in which the separability of two air flows can be maintained can be widened more than the first range Rc1 in the blower J10 of Comparative Example 1. Therefore, during assembly of the blower 10, even though a positional deviation occurs in relative positions between the separation cylinder 18 and the separation plate 13 in the fan axial direction DRa, the separability of the two air flow FL1 and FL2 can be maintained.

Similarly, in the blower 10 of the present embodiment, the height H2 of the outer end surface 132 is increased compared with the blower J10 of Comparative Example 1, in the same manner as in the first embodiment. In the blower 10 of the present embodiment, as in the twelfth embodiment, the height H4 of the partition plate end surface 151 is increased compared with the blower J10 of Comparative Example 1.

Consequently, in the same manner as in the first embodiment and the twelfth embodiment, in the relative positional relationship between the partition plate 15 and the separation plate 13 in the fan axial direction DRa, a facing range when the partition plate 15 and the outer end surface 132 face each other in the fan radial direction DRr is wider than the facing range Rc4 in the blower J10 of Comparative Example 1.

Therefore, according to the blower 10 of the present embodiment, in the relative positional relationship between the partition plate 15 and the separation plate 13, the range in the fan axial direction DRa in which the separability of the two air flows can be maintained can be widened more than the second range Rc2 in Comparative Example 1. Therefore, during assembly of the blower 10, even though a positional deviation occurs in relative positions between the partition plate 15 and the separation plate 13 in the fan axial direction DRa, the separability of the two air flows FL1 and FL2 can be maintained.

The present embodiment provides the configuration common to the fourth embodiment and the eighteenth embodiment. Therefore, the same effects as those of the fourth embodiment and the eighteenth embodiment are achieved.

A shape of the separation plate 13 is not limited to the present embodiment as long as the height H1 of the inner end surface 131 is larger than the thickness T51 of the separation plate central portion 133*c*. In the same manner as in the fifth embodiment illustrated in FIG. 8, the separation plate 13 may have an inner protruding portion 135 protruding toward the other side in the fan axial direction DRa. In the same manner as in the sixth embodiment illustrated in FIG. 9, the separation plate 13 may have two inner protruding portions 134 and 135. In the same manner as in the eleventh embodiment illustrated in FIG. 14, a thickness of the separation plate 13 may be gradually increased from the central portion of the separation plate 13 in the fan radial direction DRr toward the inner end of the separation plate 13 in the fan radial direction DRr.

A shape of the separation plate 13 is not limited to the present embodiment as long as the height H2 of the outer end surface 132 is larger than the thickness T51 of the separation plate central portion 133*c*. In the same manner as in the second embodiment illustrated in FIG. 5, the separation plate 13 may have an outer protruding portion 136 protruding toward one side in the fan axial direction DRa. In the same manner as in the sixth embodiment illustrated in FIG. 9, the separation plate 13 may have two outer protruding portions 136 and 137. In the same manner as in the eleventh embodiment illustrated in FIG. 14, a thickness of the separation plate 13 may be gradually increased from the central portion of the separation plate 13 in the fan radial direction DRr toward the outer end of the separation plate 13 in the fan radial direction DRr.

A shape of the separation cylinder 18 is not limited to the present embodiment as long as the height H3 of the separation cylinder end surface 181 is larger than the thickness T52 of the separation cylinder central portion 182*b*. The separation cylinder 18 may have only one of the two separation cylinder protruding portions 183 and 184. In the same manner as in the fifteenth embodiment illustrated in FIG. 19, a thickness of the separation cylinder 18 may be gradually increased outward from the inner side in the fan radial direction DRr in the outer portion 18*a* of the separation cylinder 18.

A shape of the partition plate 15 is not limited to the present embodiment as long as the height H4 of the partition plate end surface 151 is larger than the thickness T53 of the partition plate central portion 152*b*. The partition plate 15 may have only one of the two partition plate protruding portions 153 and 154. In the same manner as in the fifteenth embodiment illustrated in FIG. 19, a thickness of the partition plate 15 may be gradually increased inward from the outer side in the fan radial direction DRr in the inner portion 15*a* of the partition plate 15.

The height H1 of the inner end surface 131 and the height H3 of the separation cylinder end surface 181 may be different from each other. The height H2 of the outer end surface 132 and the height H4 of the partition plate end surface 151 may be different from each other. Also in these cases, the same effect as that of the present embodiment is achieved.

Twenty-Ninth Embodiment

Figure 33:
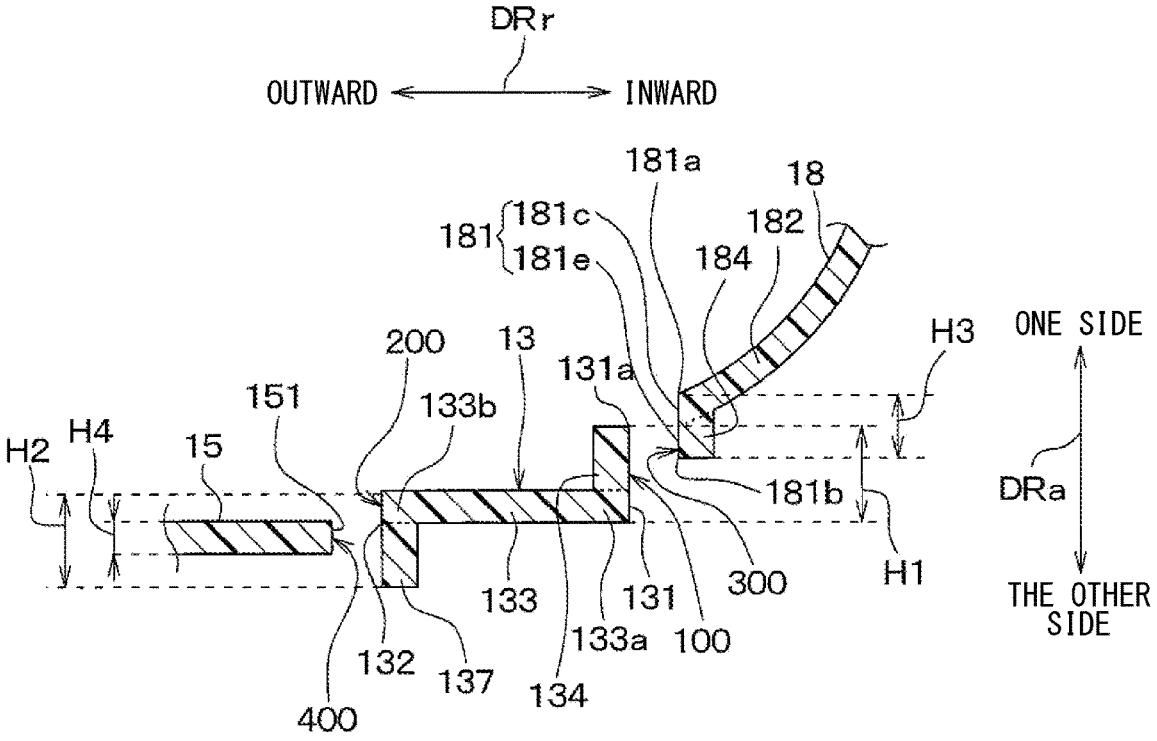
FIG. 33 is a cross-sectional view of a separation plate, a separation cylinder, and a partition plate according to a 29th embodiment.

As illustrated in FIG. 33, in the present embodiment, a separation cylinder protruding portion 184 is added to the separation cylinder 18 of the fourth embodiment in FIG. 7. The separation cylinder 18 includes a separation cylinder main body portion 182 and the separation cylinder protruding portion 184. The separation cylinder protruding portion 184 is the same as the other separation cylinder protruding portion 184 of the eighteenth embodiment in FIG. 22.

In the present embodiment, a separation cylinder end surface 181 includes an outer end surface 181*c* of the separation cylinder main body portion 182 in the fan radial direction DRr and an outer end surface 181*e* of the separation cylinder protruding portion 184 in the fan radial direction DRr. A separation cylinder edge 300 includes an outer portion of the separation cylinder main body portion 182 in the fan radial direction DRr, and the separation cylinder protruding portion 184.

One end 181*a* of the separation cylinder end surface 181 is located further toward one side in the fan axial direction DRa than one end 131*a* of an inner end surface 131.

A blower 10 has the same configuration as that in the fourth embodiment except for the above configuration. Also in the present embodiment, in the same manner as in the first embodiment, a height H1 of the inner end surface 131 is larger than a height H3 of a separation cylinder end surface 181. That is, the height H1 of an inner edge 100 is larger than the height H3 of a separation cylinder edge 300. A height H2 of the outer end surface 132 is larger than a height H4 of a partition plate end surface 151. That is, the height H2 of an outer edge 200 is larger than the height H4 of a partition plate edge 400. Therefore, according to the present embodiment, the same effect as that of the first embodiment is achieved.

Thirtieth Embodiment

Figure 34:
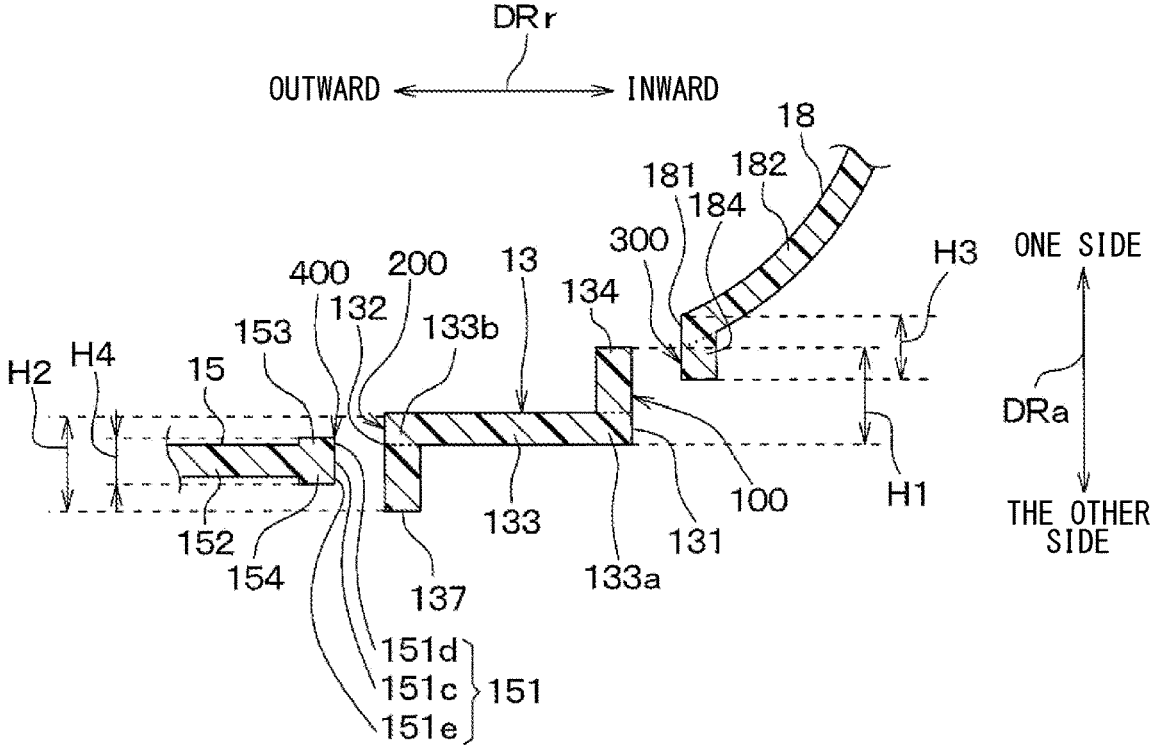
FIG. 34 is a cross-sectional view of a separation plate, a separation cylinder, and a partition plate according to a thirtieth embodiment.

As illustrated in FIG. 34, in the present embodiment, two partition plate protruding portions 153 and 154 are added to the partition plate 15 of the twenty-ninth embodiment in FIG. 33.

In the same manner as in the eighteenth embodiment in FIG. 22, the partition plate 15 has a partition plate main body portion 152, and the two partition plate protruding portions 153 and 154. A partition plate end surface 151 includes an inner end surface 151*c* of the partition plate main body portion 152 in the fan radial direction DRr, an inner end surface 151*d* of one partition plate protruding portion 153 in the fan radial direction DRr, and an inner end surface 151*e* of the other partition plate protruding portion 154 in the fan radial direction DRr. However, unlike the eighteenth embodiment, a height H2 of an outer end surface 132 is larger than a height H4 of the partition plate end surface 151. That is, the height H2 of an outer edge 200 is larger than the height H4 of a partition plate edge 400.

A blower 10 has the same configuration as that in the twenty-ninth embodiment except for the above configuration. Also in the present embodiment, the same effect as that of the twenty-ninth embodiment is achieved.

Thirty-First Embodiment

Figure 35:
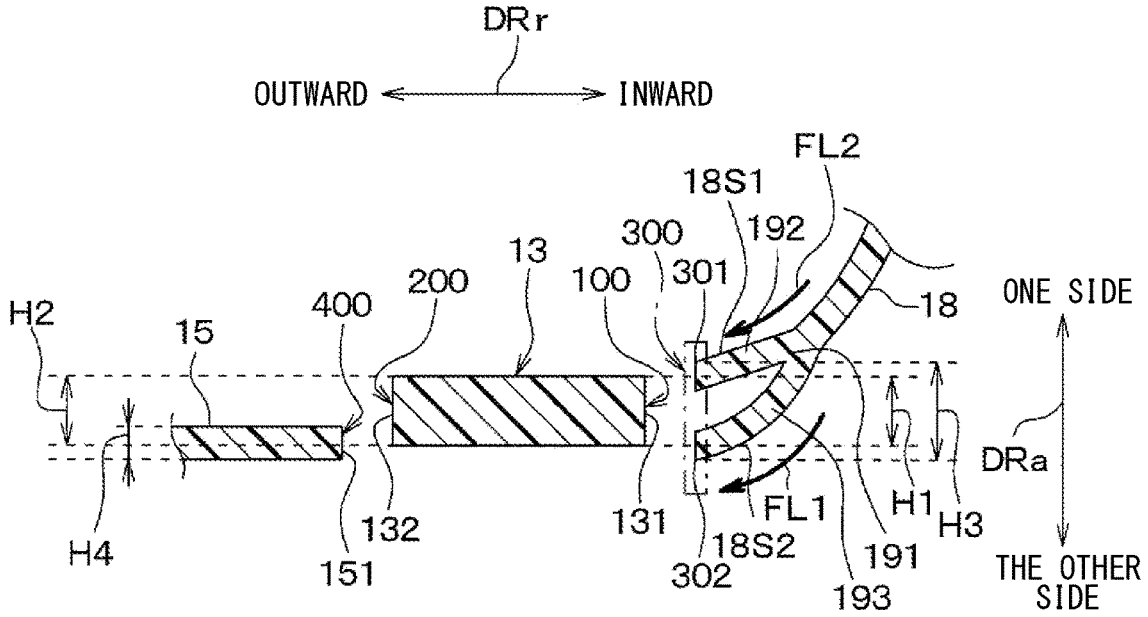
FIG. 35 is a cross-sectional view of a separation plate, a separation cylinder, and a partition plate according to a 31st embodiment.

As illustrated in FIG. 35, in the present embodiment, a shape of a separation cylinder 18 is different from that in the first embodiment. The separation cylinder 18 is bifurcated at an end part of the separation cylinder 18 on the other side in the fan axial direction DRa.

Specifically, the separation cylinder 18 includes a branch base portion 191, a first guide portion 192, and a second guide portion 193. The branch base portion 191 is located at the end part of the separation cylinder 18 on the other side in the fan axial direction DRa. The branch base portion 191 is a portion where the first guide portion 192 and the second guide portion 193 are connected to each other. The first guide portion 192 extends outward in the fan radial direction DRr from the branch base portion 191. The second guide portion 193 extends outward in the fan radial direction DRr from the branch base portion 191. The second guide portion 193 and the first guide portion 192 are disposed side by side in the fan axial direction DRa. The second guide portion 193 is located further toward the other side in the fan axial direction DRa than the first guide portion 192. A space is formed between the second guide portion 193 and the first guide portion 192.

The first guide portion 192 has a first guide surface 18S1 guiding the air flow F2 flowing outside the separation cylinder 18 outward in the fan radial direction DRr. The first guide surface 18S1 is a surface of the first guide portion 192 on one side in the fan axial direction DRa. That is, the first guide surface 18S1 is one surface 18S1 of the separation cylinder 18.

The second guide portion 193 has a second guide surface 18S2 guiding the air flow F1 flowing inside the separation cylinder 18 outward in the fan radial direction DRr. The second guide surface 18S2 is a surface of the second guide portion 193 on the other side in the fan axial direction DRa. That is, the second guide surface 18S2 is the other surface 18S2 of the separation cylinder 18. The air flow F1 is guided outward in the fan radial direction DRr by both of a surface of the main plate 122 illustrated in FIG. 1 on one side in the fan axial direction DRa and the second guide surface 18S2.

In the present embodiment, a separation cylinder edge 300 includes an outer end of the first guide portion 192 in the fan radial direction DRr and an outer end of the second guide portion 193 in the fan radial direction DRr. A height H3 of the separation cylinder edge 300 is larger than a height H1 of an inner edge 100. The height H3 of the separation cylinder edge 300 is a distance in the fan axial direction DRa between an outer end 301 of the fan radial direction DRr of the first guide surface 18S1, and the outer end 302 of the second guide surface 18S2 in the fan radial direction DRr. The height H1 of the inner edge 100 is the same as the height H1 of an inner end surface 131.

According to the configuration, in the same manner as in the twelfth embodiment, a facing range R3 when the separation cylinder edge 300 and the inner edge 100 face each other in the fan radial direction DRr is wider than the facing range Rc3 in the blower J10 of Comparative Example 1. Therefore, the same effect as that of the twelfth embodiment is achieved in the relationship between the separation cylinder 18 and the separation plate 13.

In the same manner as in the first embodiment, the height H2 of an outer end surface 132 is larger than the height H4 of a partition plate end surface 151. That is, H2 of an outer edge 200 is larger than the height H4 of a partition plate edge 400. The height H2 of the outer edge 200 is the same as the height H2 of the outer end surface 132. The height H4 of the partition plate edge 400 is the same as the height H4 of the partition plate end surface 151.

According to the configuration, in the same manner as in the first embodiment, a facing range R4 when the partition plate edge 400 and the outer edge 200 face each other in the fan radial direction DRr is wider than the facing range Rc4 in the blower J10 of Comparative Example 1. Therefore, the same effect as that of the first embodiment is achieved in the relationship between the separation plate 13 and the partition plate 15.

A blower 10 has the same configuration as that in the first embodiment except for the above configuration. According to the present embodiment, the following effects are further achieved.

Figure 36:
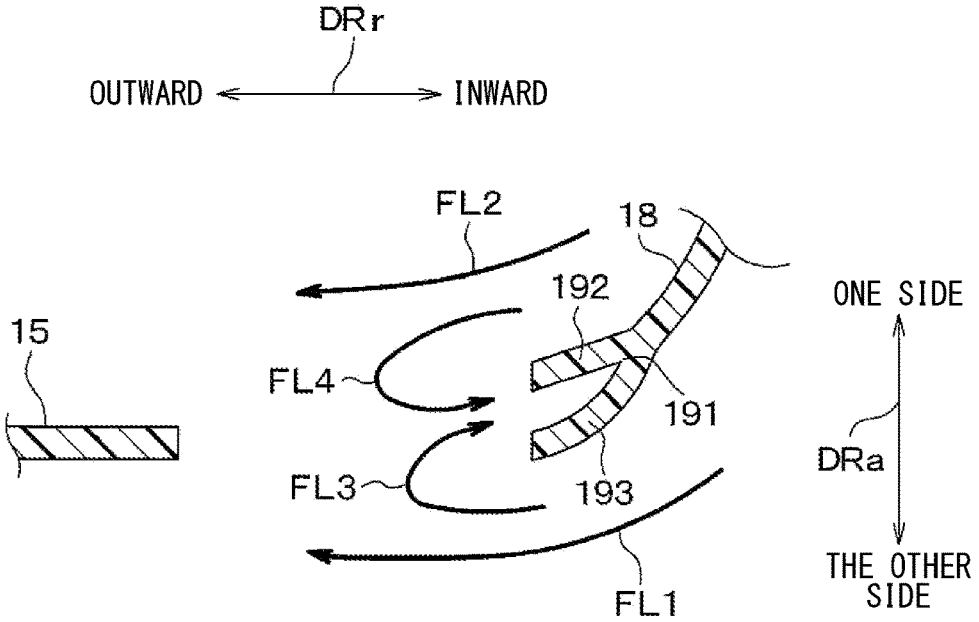
FIG. 36 is a cross-sectional view of a separation cylinder and a partition plate in a centrifugal blower of Comparative Example 2.

A separation cylinder 18 of a blower of Comparative Example 2 illustrated in FIG. 36 has the same shape as that in the present embodiment. Unlike the present embodiment, the blower of Comparative Example 2 does not have the separation plate 13. When the blower does not have the separation plate 13, the separation cylinder 18 is bifurcated as in the present embodiment such that the two air flows FL1 and FL2 can be separated in the fan axial direction DRa compared with a case where the separation cylinder 18 is not bifurcated. Therefore, the separability of the two air flows FL1 and FL2 can be improved.

However, in the blower of Comparative Example 2, air flows FL3 and FL4 illustrated in FIG. 36 are generated in a space between the separation cylinder 18 and the partition plate 15. This causes a decrease in fan efficiency and an increase in noise.

In contrast, according to the present embodiment, the separation plate 13 is disposed in the space between the separation cylinder 18 and the partition plate 15. Consequently, it is possible to reduce the generation of the air flows FL3 and FL4. Therefore, it is possible to suppress a decrease in fan efficiency and an increase in noise.

Thirty-Second Embodiment

Figure 37:
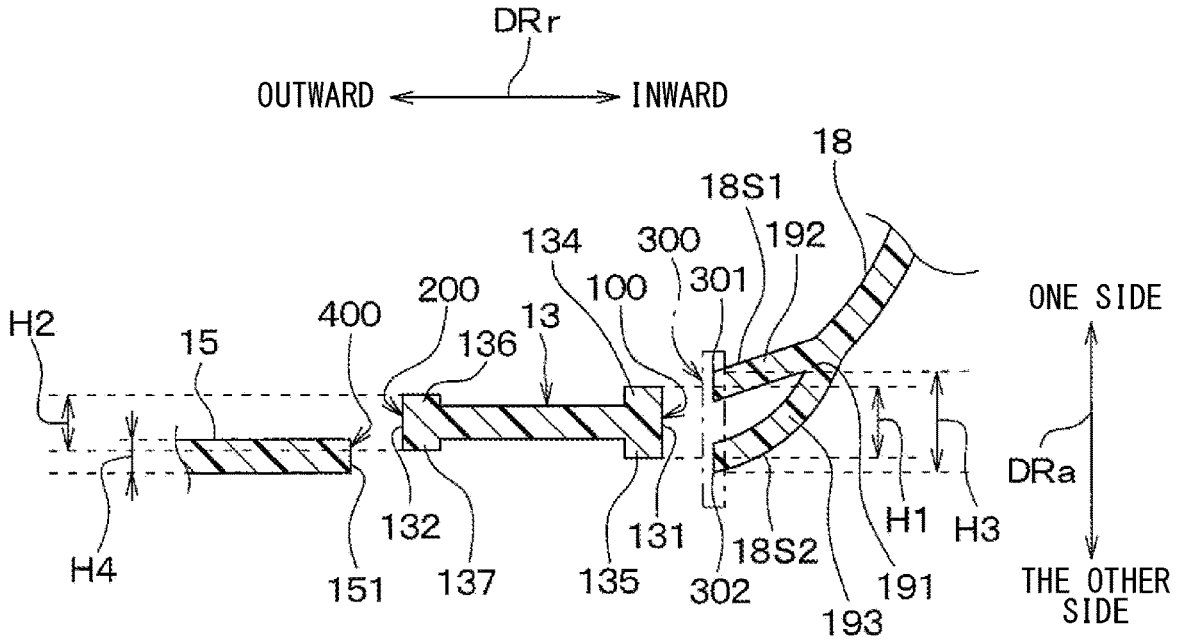
FIG. 37 is a cross-sectional view of a separation plate, a separation cylinder, and a partition plate according to a 32nd embodiment.

As illustrated in FIG. 37, a shape of the separation plate 13 is changed compared with the thirty-first embodiment in FIG. 35. The shape of the separation plate 13 is the same as that of the separation plate 13 of the sixth embodiment in FIG. 9. That is, the separation plate 13 has two inner protruding portions 134 and 135 and two outer protruding portions 136 and 137.

An inner edge 100 includes the two inner protruding portions 134 and 135. The height H1 of the inner edge 100 is the same as the height H1 of an inner end surface 131. An outer edge 200 includes the two outer protruding portions 136 and 137. The height H2 of the outer edge 200 is the same as the height H2 of the outer end surface 132.

Shapes of a separation cylinder 18 and a partition plate 15 are the same as those in the thirty-first embodiment. In the same manner as in the thirtieth embodiment, a height H3 of a separation cylinder edge 300 is larger than the height H1 of the inner edge 100. A height H2 of an outer edge 200 is larger than a height H4 of a partition plate edge 400. Therefore, the same effect as that of the thirty-first embodiment is achieved.

Unlike the present embodiment, the height H1 of the inner edge 100 may be larger than the height H3 of the separation cylinder edge 300. The height H4 of the partition plate edge 400 may be larger than the height H2 of the outer edge 200.

Unlike the present embodiment, the separation plate 13 may have only one of the two inner protruding portions 134 and 135. The separation plate 13 may have only one of the two outer protruding portions 136 and 137.

Thirty-Third Embodiment

Figure 38:
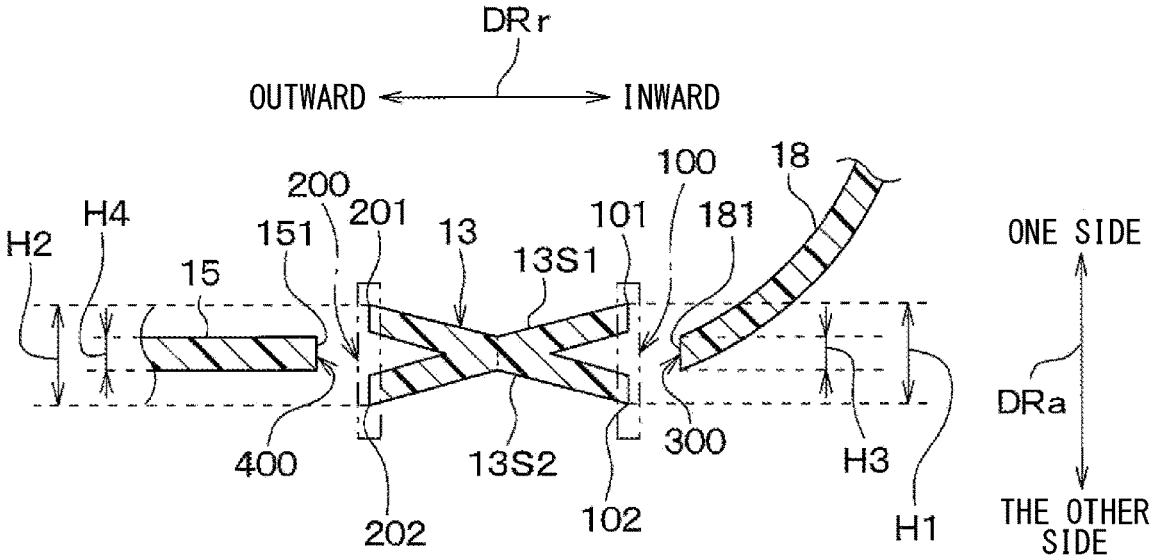
FIG. 38 is a cross-sectional view of a separation plate, a separation cylinder, and a partition plate according to a 33rd embodiment.

As illustrated in FIG. 38, in the present embodiment, a shape of a separation plate 13 is different from that in the first embodiment. Specifically, an inner portion of the separation plate 13 in the fan radial direction DRr is bifurcated. A height H1 of an inner edge 100 is larger than a height H3 of a separation cylinder edge 300.

The inner edge 100 includes inner ends of the bifurcated portions in the fan radial direction DRr. The height H1 of the inner edge 100 is a distance in the fan axial direction DRa between an inner end 101 of one surface 13S1 in the fan radial direction DRr and an inner end 102 of the other surface 13S2 in the fan radial direction DRr. The one surface 13S1 is a surface of the separation plate 13 on one side in the fan axial direction DRa. The other surface 13S2 is a surface of the separation plate 13 on the other side in the fan axial direction DRa.

An outer portion of the separation plate 13 in the fan radial direction DRr is also bifurcated. The height H2 of the outer edge 200 is larger than the height H4 of the partition plate edge 400.

The outer edge 200 includes outer ends of the bifurcated portions in the fan radial direction DRr. The height H2 of the outer edge 200 is a distance in the fan axial direction DRa between an outer end 201 of the one surface 13S1 in the fan radial direction DRr and an outer end 202 of the other surface 13S2 in the fan radial direction DRr.

A blower 10 has the same configuration as that in the first embodiment except for the above configuration. As described above, in the present embodiment, the height H1 of the inner edge 100 is larger than the height H3 of the separation cylinder edge 300. According to the configuration, in the same manner as in the first embodiment, the facing range R3 when the separation cylinder edge 300 and the inner edge 100 face each other in the fan radial direction DRr is wider than the facing range Rc3 in the blower J10 of Comparative Example 1. Therefore, the same effect as that of the first embodiment is achieved in the relationship between the separation cylinder 18 and the separation plate 13.

In the present embodiment, the height H2 of the outer edge 200 is larger than the height H4 of the partition plate edge 400. According to the configuration, in the same manner as in the first embodiment, a facing range R4 when the partition plate edge 400 and the outer edge 200 face each other in the fan radial direction DRr is wider than the facing range Rc4 in the blower J10 of Comparative Example 1. Therefore, the same effect as that of the first embodiment is achieved in the relationship between the separation plate 13 and the partition plate 15.

In the present embodiment, both inner and outer portions of the separation plate 13 in the fan radial direction DRr are bifurcated. However, only one of the inner and outer portions of the separation plate 13 in the fan radial direction DRr may be bifurcated.

A relationship between the height H1 of the inner edge 100 and the height H3 of the separation cylinder edge 300 may be opposite to that in the present embodiment. A relationship between the height H2 of the outer edge 200 and the height H4 of the partition plate edge 400 may be opposite to that in the present embodiment.

Thirty-Fourth Embodiment

Figure 39:
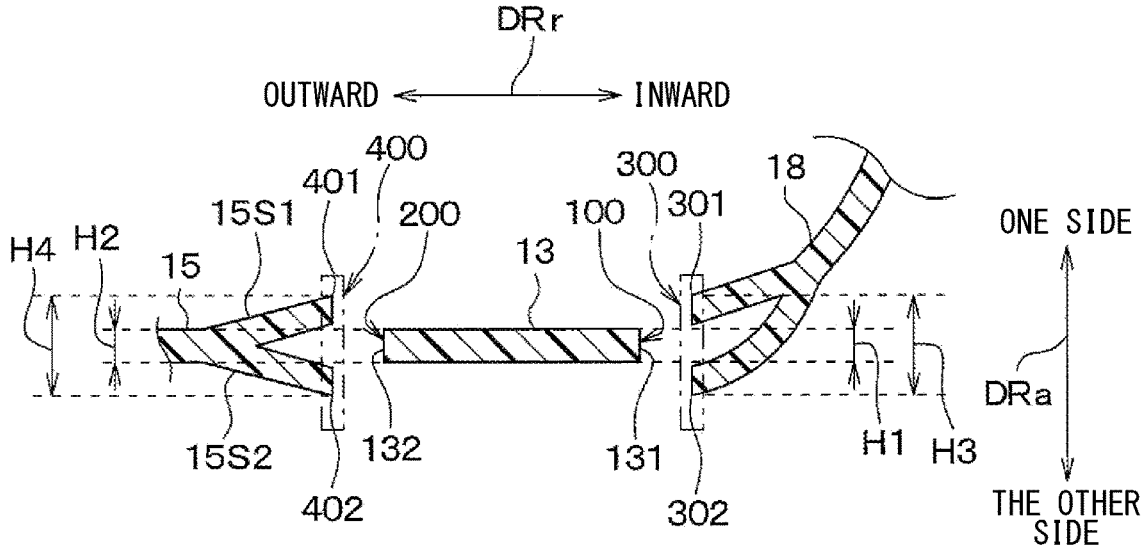
FIG. 39 is a cross-sectional view of a separation plate, a separation cylinder, and a partition plate according to a 34th embodiment.

As illustrated in FIG. 39, in the present embodiment, a shape of a separation cylinder 18 is the same as that in the thirty-first embodiment in FIG. 35. In the same manner as in the thirty-first embodiment, a height H3 of a separation cylinder edge 300 is larger than a height H1 of an inner edge 100. Therefore, the same effect as that of the thirty-first embodiment is achieved in a relationship between the separation cylinder 18 and a separation plate 13.

In the present embodiment, an inner portion of the partition plate 15 in the fan radial direction DRr is bifurcated. A height H4 of a partition plate edge 400 is larger than a height H2 of an outer edge 200.

The partition plate edge 400 includes inner ends of the bifurcated portions in the fan radial direction DRr. The height H4 of the partition plate edge 400 is a distance in the fan axial direction DRa between an inner end 401 of one surface 15S1 in the fan radial direction DRr and an inner end 402 of the other surface 15S2 in the fan radial direction DRr. The one surface 15S1 is a surface of the partition plate 15 on one side in the fan axial direction DRa. The other surface 15S2 is a surface of the partition plate 15 on the other side in the fan axial direction DRa. The height H2 of the outer edge 200 is the same as the height of an outer end surface 132.

According to the configuration, in the same manner as in the twelfth embodiment, a facing range R4 when the partition plate edge 400 and the outer edge 200 face each other in the fan radial direction DRr is wider than the facing range Rc4 in the blower J10 of Comparative Example 1. Therefore, the same effect as that of the twelfth embodiment is achieved in the relationship between the separation plate 13 and the partition plate 15.

A relationship between the height H1 of the inner edge 100 and the height H3 of the separation cylinder edge 300 may be opposite to that in the present embodiment. A relationship between the height H2 of the outer edge 200 and the height H4 of the partition plate edge 400 may be opposite to that in the present embodiment.

OTHER EMBODIMENTS (1) In each of the above embodiments, the inner end surface 131, the outer end surface 132, the partition plate end surface 151 and the separation cylinder end surface 181 are flat surfaces. However, the end surfaces 131, 132, 151, and 181 may have bent portions or may be curved surfaces.

Figure 40:
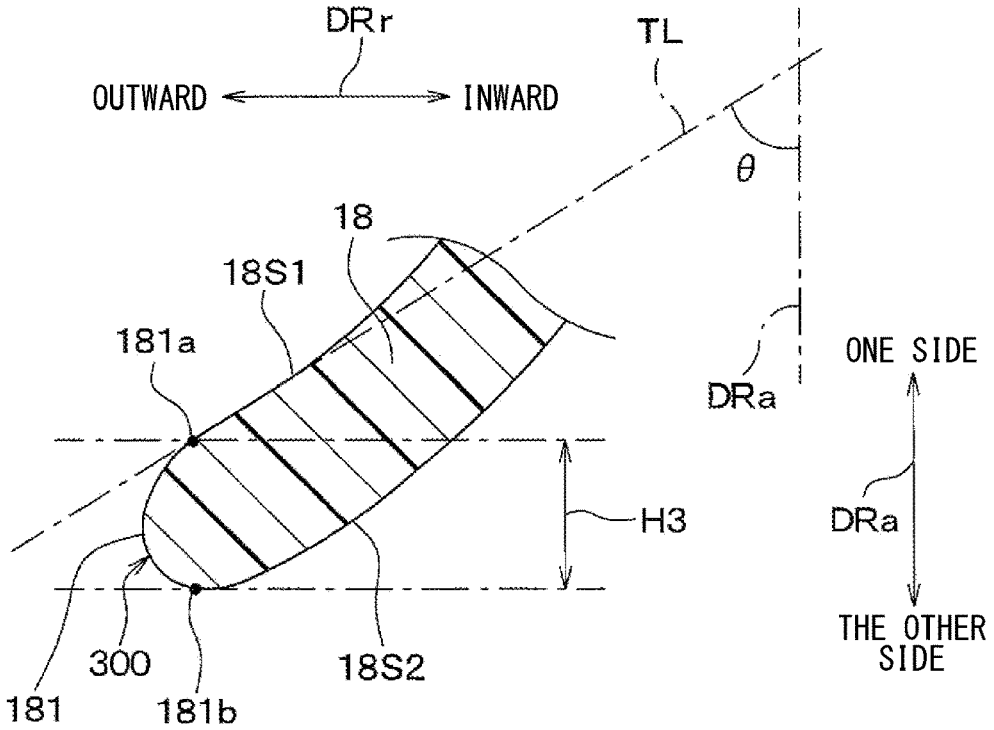
FIG. 40 is a cross-sectional view of a separation cylinder of another embodiment.

For example, as illustrated in FIG. 40, the separation cylinder edge 300 may have a rounded shape. That is, the separation cylinder end surface 181 may be a curved surface. In FIG. 40, a portion of the separation cylinder 18 on the other side in the fan axial direction DRa is directed from one side toward the end on the other side in the fan axial direction DRa such that the separation cylinder 18 is expanded in the fan radial direction DRr.

In this case, a position of the one surface 18S1 at which an angle θ formed between a tangent TL and the fan axial direction DRa is the maximum is an end 181*a* of one surface 18S1, that is, the one end 181*a* of the separation cylinder end surface 181. The tangent TL is a virtual straight line in contact with any position of the one surface 18S1 in a cross section of the blower 10 passing through the fan axis CL. As a position of the contact moves to the other side in the fan axial direction DRa, the angle θ gradually increases to a maximum and then gradually decreases.

A position of the separation cylinder 18 on the most other side in the fan axial direction DRa is an end 181*b* of the other surface 18S2, that is, the other end 181*b* of the separation cylinder end surface 181.

Figure 41:
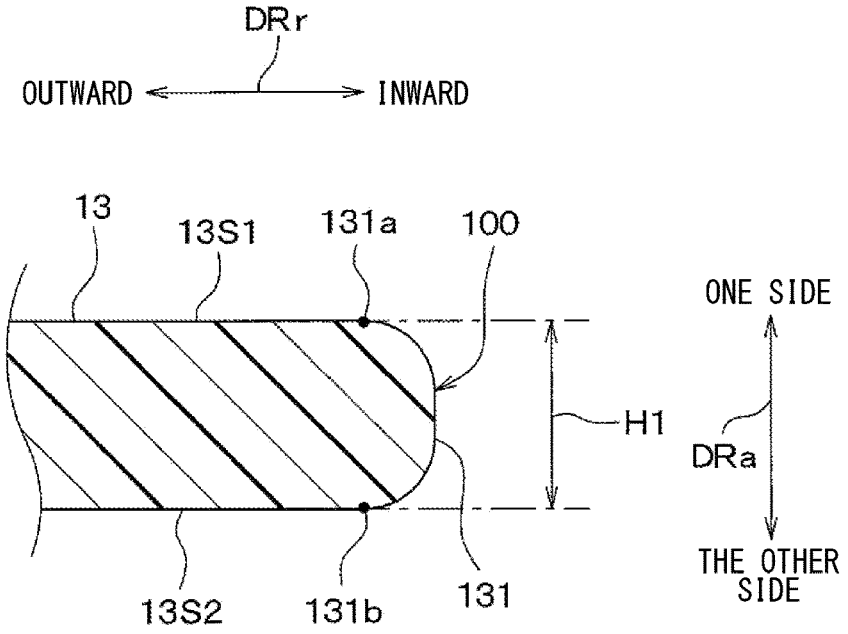
FIG. 41 is a cross-sectional view of a separation plate of another embodiment.

As illustrated in FIG. 41, the inner edge 100 of the separation plate 13 may have a rounded shape. That is, the inner end surface 131 may be a curved surface. In FIG. 41, one surface 13S1 and the other surface 13S2 are flat surfaces perpendicular to the fan axial direction DRa. In this case, a position at which the surface starts to bend with respect to the one surface 13S1 is the inner end 131*a* of the one surface 13S1, that is, the one end 131*a* of the inner end surface 131. A position at which the surface starts to bend with respect to the other surface 13S2 is the inner end 131*b* of the other surface 13S2, that is, the other end 131*b* of the inner end surface 131.

Figure 42:
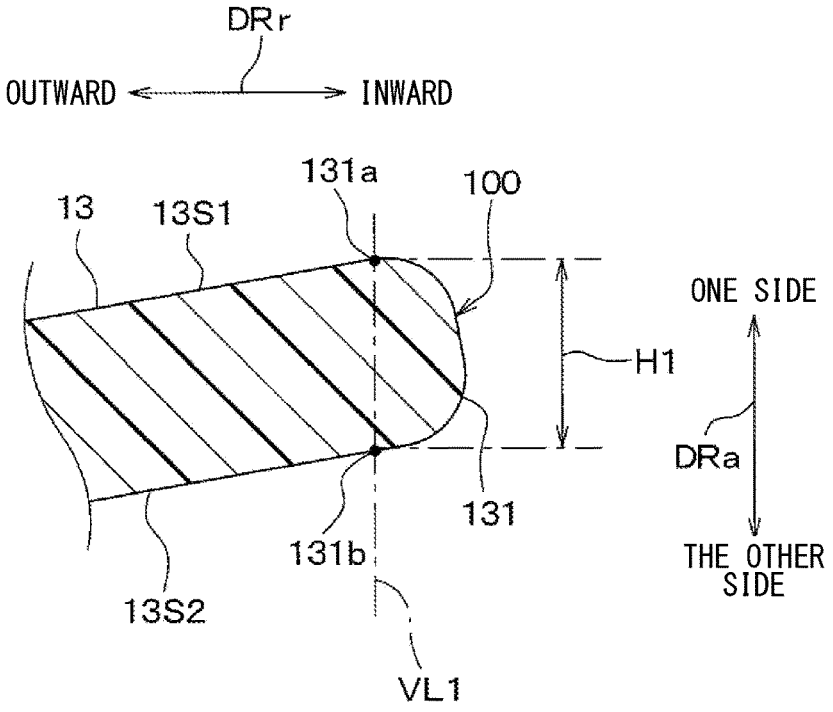
FIG. 42 is a cross-sectional view of a separation plate of another embodiment.

As illustrated in FIG. 42, the inner edge 100 of the separation plate 13 may have a rounded shape. In FIG. 42, the separation plate 13 is inclined with respect to the fan axial direction DRa to be located on one side in the fan axial direction DRa toward the inner end side in the fan radial direction DRr. In this case, a position of the separation plate 13 on the most one side in the fan axial direction DRa is the inner end 131*a* of the one surface 13S1, that is, the one end 131*a* of the inner end surface 131. In a cross section of the blower 10 passing through the fan axis CL, a position of an intersection point between a virtual straight line VL1 passing through the inner end 131*a* of the one surface 13S1 and parallel to the fan axial direction DRa and the surface of the separation plate 13 is the inner end 131*b* of the other surface 13S2, that is, the other end 131*b* of the inner end surface 131.

Figure 43:
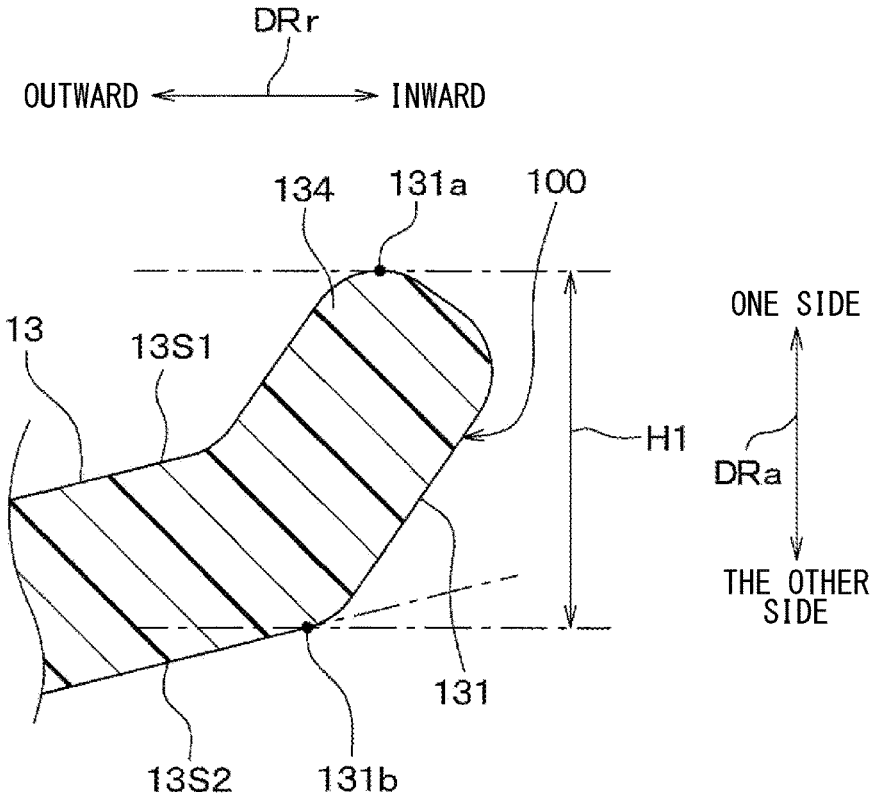
FIG. 43 is a cross-sectional view of a separation plate of another embodiment.

As illustrated in FIG. 43, the inner edge 100 of the separation plate 13 may have a rounded shape. In FIG. 43, the inner edge 100 includes the inner protruding portion 134. In this case, a position of the inner protruding portion 134 on the most one side in the fan axial direction DRa is the inner end 131*a* of the one surface 13S1, that is, the one end 131*a* of the inner end surface 131. A position at which the surface starts to bend with respect to the other surface 13S2 that is a flat surface is the inner end 131*b* of the other surface 13S2, that is, the other end 131*b* of the inner end surface 131.

Figure 44:
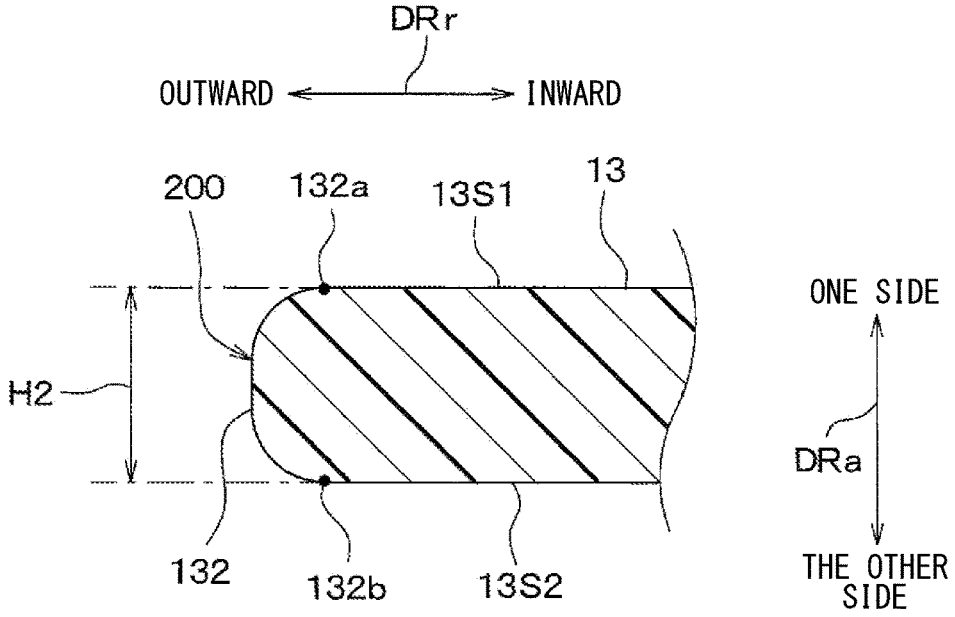
FIG. 44 is a cross-sectional view of a separation plate of another embodiment.

As illustrated in FIG. 44, the outer edge 200 of the separation plate 13 may have a rounded shape. That is, the outer end surface 132 may be a curved surface. In FIG. 44, one surface 13S1 and the other surface 13S2 are flat surfaces perpendicular to the fan axial direction DRa. In this case, a position at which the surface starts to bend with respect to the one surface 13S1 is the outer end 132*a* of the one surface 13S1, that is, the one end 132*a* of the outer end surface 132. A position at which the surface starts to bend with respect to the other surface 13S2 is the outer end 132*b* of the other surface 13S2, that is, the other end 132*b* of the outer end surface 132.

Figure 45:
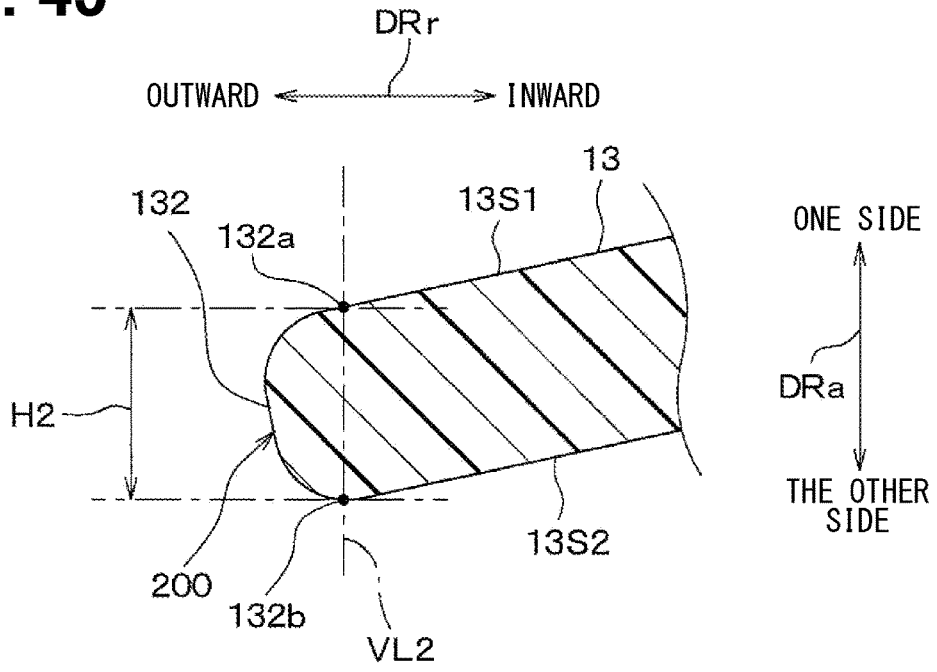
FIG. 45 is a cross-sectional view of a separation plate of another embodiment.

As illustrated in FIG. 45, the outer edge 200 of the separation plate 13 may have a rounded shape. In FIG. 45, the separation plate 13 is inclined with respect to the fan axial direction DRa to be located on the other side in the fan axial direction DRa toward the outer end side in the fan radial direction DRr. In this case, a position of the separation plate 13 on the most other side in the fan axial direction DRa is the outer end 132*b* of the other surface 13S2, that is, the other end 132*b* of the outer end surface 132. In a cross section of the blower 10 passing through the fan axis CL, a position of an intersection point between a virtual straight line VL2 parallel to the fan axial direction DRa passing through the outer end 132*b* of the other surface 13S2 and the surface of the separation plate 13 is the outer end 132*a* of the one surface 13S1, that is, the one end 132*a* of the outer end surface 132.

Figure 46:
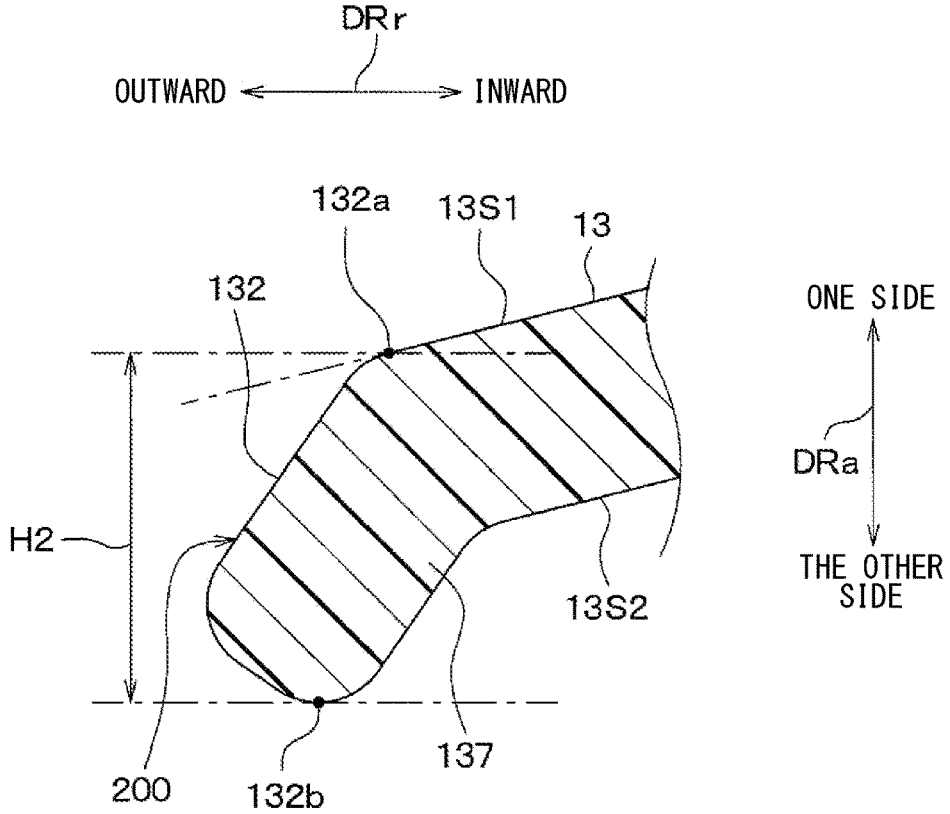
FIG. 46 is a cross-sectional view of a separation plate of another embodiment.

As illustrated in FIG. 46, the outer edge 200 of the separation plate 13 may have a rounded shape. In FIG. 46, the outer edge 200 includes an outer protruding portion 137. In this case, the position of the most other side of the outer protruding portion 137 in the fan axial direction DRa is the outer end 132*b* of the other surface 13S2, that is, the other end 132*b* of the outer end surface 132. A position at which the surface starts to bend with respect to the one surface 13S1 that is a flat surface is the outer end 132*a* of the one surface 13S1, that is, the one end 132*a* of the inner end surface 131.

Figure 47:
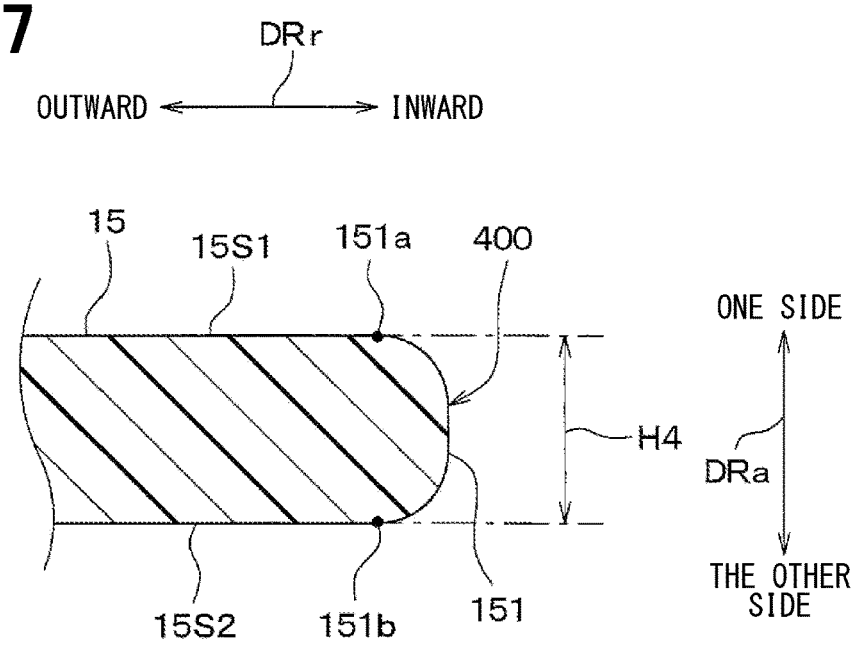
FIG. 47 is a cross-sectional view of a partition plate of another embodiment.

As illustrated in FIG. 47, the partition plate edge 400 may have a rounded shape. That is, the partition plate end surface 151 may be a curved surface. In FIG. 47, one surface 15S1 and the other surface 15S2 are flat surfaces perpendicular to the fan axial direction DRa. In this case, a position at which the surface starts to bend with respect to the one surface 15S1 is the end 151*a* of the one surface 15S1, that is, the one end 151*a* of the partition plate end surface 151. A position at which the surface starts to bend with respect to the other surface 15S2 is the end 151*b* of the other surface 15S2, that is, the other end 151*b* of the partition plate end surface 151.

Figure 48:
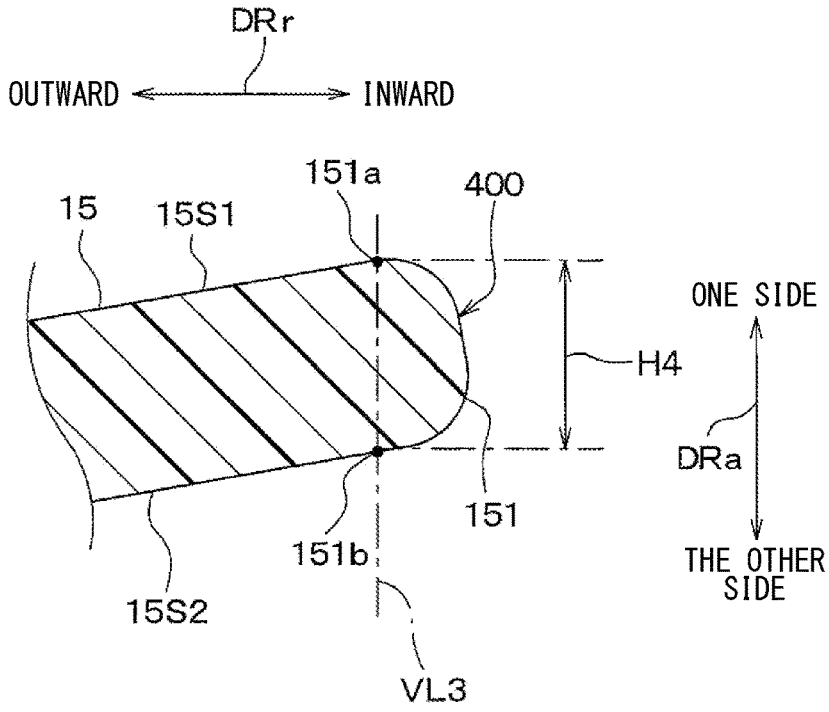
FIG. 48 is a cross-sectional view of a partition plate of another embodiment.

As illustrated in FIG. 48, the partition plate edge 400 may have a rounded shape. In FIG. 48, the partition plate 15 is inclined with respect to the fan axial direction DRa to be located on one side in the fan axial direction DRa toward the inner end side in the fan radial direction DRr. In this case, a position of the partition plate 15 on the most one side in the fan axial direction DRa is the end 151*a* of the one surface 15S1, that is, the one end 151*a* of the partition plate end surface 151. In a cross section of the blower 10 passing through the fan axis CL, a position of an intersection point between a virtual straight line VL3 passing through the end 151*a* of the one surface 15S1 and parallel to the fan axial direction DRa and the surface of the partition plate 15 is the end 151*b* of the other surface 15S2, that is, the other end 151*b* of the partition plate end surface 151.

(2) The present disclosure is not limited to the foregoing description of the embodiments and can be modified within the scope of the present disclosure. The present disclosure may also be varied in many ways. Such variations are not to be regarded as departure from the disclosure, and all such modifications are intended to be included within the scope of the disclosure. The above embodiments are not independent of each other, and can be appropriately combined except when the combination is obviously impossible. Further, in each of the above-mentioned embodiments, it goes without saying that components of the embodiment are not necessarily essential except for a case in which the components are particularly clearly specified as essential components, a case in which the components are clearly considered in principle as essential components, and the like. A quantity, a value, an amount, a range, or the like, if specified in the above-described example embodiments, is not necessarily limited to the specific value, amount, range, or the like unless it is specifically stated that the value, amount, range, or the like is necessarily the specific value, amount, range, or the like, or unless the value, amount, range, or the like is obviously necessary to be the specific value, amount, range, or the like in principle. Further, in each of the embodiments described above, when materials, shapes, positional relationships, and the like, of the components and the like, are mentioned, they are not limited to these materials, shapes, positional relationships, and the like, unless otherwise specified and unless limited to specific materials, shapes, positional relationships, and the like.

(Overview)

According to a first aspect of the present disclosure represented by a part or all of the embodiments, a centrifugal blower includes a centrifugal fan and a separation cylinder. The centrifugal fan has a separation plate. The separation plate has an inner end surface. The separation cylinder has a separation cylinder end surface. A height of one of the separation cylinder end surface and the inner end surface in the axial direction is larger than a height of the other of the separation cylinder end surface and the inner end surface in the axial direction.

According to a second aspect, the height of the separation cylinder end surface in the axial direction is larger than the height of the inner end surface in the axial direction. The second aspect can be adopted in the first aspect.

According to a third aspect, the separation cylinder includes a separation cylinder main body portion and a separation cylinder protruding portion. The separation cylinder main body portion extends from the one side toward the end on the other side in the axial direction and extends to be located outward in the radial direction toward the end on the other side of the axial direction. The separation cylinder main body portion has an outer portion in the radial direction, and the outer portion includes an outer end of the separation cylinder in the radial direction. The separation cylinder protruding portion protrudes toward at least one of the one side and the other side in the axial direction from the outer portion of the separation cylinder main body portion. The separation cylinder end surface includes an outer end surface of the separation cylinder main body portion in the radial direction and an outer end surface of the separation cylinder protruding portion in the radial direction.

Accordingly, the thickness of the separation cylinder which is composed of only the separation cylinder main body portion is thinner than the height of the separation cylinder end surface. Therefore, the material required for forming the separation cylinder can be reduced as compared with a case where the thickness of the separation cylinder is the same as the height of the separation cylinder end surface and is uniform over the entire area in the extension direction of the separation cylinder.

According to a fourth aspect, the thicknesses of the separation cylinder protruding portions in a normal direction to the end surface of the separation cylinder protruding portion is equal to or less than a thickness of the separation cylinder main body portion in the normal direction to a surface of the separation cylinder main body portion.

Accordingly, it is possible to increase the height of the separation cylinder end surface while suppressing the increase in the thickness of the separation cylinder as compared with case where the separation cylinder is composed of only the separation cylinder main body portion. The thicker the thickness of the resin molded product, the longer the cooling time during resin molding. Therefore, according to this, it is possible to suppress an increase in the cooling time while the separation cylinder is molded with resin.

According to a fifth aspect, the height of the inner end surface in the axial direction is larger than the height of the separation cylinder end surface in the axial direction. The fifth aspect can be adopted in the first aspect.

According to a sixth aspect, the separation plate includes a separation plate main body portion and an inner protruding portion. The separation plate main body portion extends outward from the inner side in the radial direction, and has an inner portion that is an inner portion in the radial direction and includes an inner end of the separation plate in the radial direction. The inner protruding portion protrudes toward at least one of the one side and the other side in the axial direction from the inner portion. The inner end surface includes an inner end surface of the separation plate main body portion in the radial direction and inner end surface of the inner protruding portion in the radial direction.

According to this, the thickness of the separation plate composed of only the separation plate main body portion is thinner than the height of the inner end surface. Therefore, the material required for forming the separation plate can be reduced as compared with case where the thickness of the separation plate is the same as the height of the inner end surface and is uniform over the entire area in the extending direction of the separation plate.

According to a seventh aspect, the thickness of the inner protruding portion in a normal direction to the end surface of the inner protruding portion is equal to or less than a thickness of the separation plate main body portion in a normal direction to a surface of the separation plate main body portion.

According to this, it is possible to increase the height of the inner end face while suppressing the increase in the wall thickness of the separation plate as compared with the case where the separation plate is composed of only the main body of the separation plate. The thicker the thickness of the resin molded product, the longer the cooling time during resin molding. Therefore, according to this, it is possible to suppress an increase in the cooling time during resin molding of the separation plate.

According to an eighth aspect, a centrifugal blower includes a centrifugal fan and a fan casing. The centrifugal fan has a separation plate. The fan casing has a partition plate. The separation plate has an outer end surface. The partition plate has a partition plate end surface. A height of one of the partition plate end surface and the outer end surface in the axial direction is larger than a height of the other of the partition plate end surface and the outer end surface in the axial direction.

According to a ninth aspect, the height of the outer end surface in the axial direction is larger than the height of the partition plate end surface in the axial direction. The ninth aspect can be adopted in the eighth aspect.

According to a tenth aspect, the separation plate includes a separation plate main body portion and an outer protruding portion. The separation plate main body portion extends outward from the inner side in the radial direction. The separation plate main body portion has an outer portion in the radial direction, and the outer portion includes an outer end of the separation plate in the radial direction. The outer protruding portion protrudes toward at least one of the one side and the other side in the axial direction from the outer portion. The outer end surface includes an outer end surface of the separation plate main body portion in the radial direction and outer end surface of the outer protruding portion in the radial direction.

According to this, the thickness of the separation plate formed only by the separation plate main body portion is thinner than the height of the outer end surface. Therefore, the material required for forming the separation plate can be reduced as compared with case where the thickness of the separation plate is the same as the height of the outer end surface and is uniform over the entire area in the extending direction of the separation plate.

According to an eleventh aspect, the thicknesses of the outer protruding portion in a normal direction to the end surface of the outer protruding portion is equal to or less than a thickness of the separation plate main body portion in a normal direction to a surface of the separation plate main body portion.

According to this, it is possible to increase the height of the outer end surface while suppressing the increase in the thickness of the separation plate as compared with case where the separation plate is composed of only the separation plate main body portion. The thicker the thickness of the resin molded product, the longer the cooling time during resin molding. Therefore, according to this, it is possible to suppress an increase in the cooling time while the separation plate is molded with resin.

According to a twelfth aspect, the height of the partition plate end surface in the axial direction is larger than the height of the outer end surface in the axial direction. The twelfth aspect can be applied in the eighth aspect.

According to a thirteenth aspect, the partition plate includes a partition plate main body portion and a partition plate protruding portion. The partition plate main body portion extends inward from the outer side in the radial direction, and has an inner portion in the radial direction. The inner portion includes an inner end of the partition plate in the radial direction. The partition plate protruding portion protrudes toward at least one of the one side and the other side in the axial direction from the inner portion. The partition plate end surface includes an inner end surface of the partition plate main body portion in the radial direction and an inner end surface of the partition plate protruding portion in the radial direction.

According to this, the thickness of the partition plate which is composed of only the partition plate main body portion is thinner than the height of the partition plate end surface. Therefore, the material required for forming the partition plate can be reduced as compared with case where the thickness of the partition plate is the same as the height of the partition plate end surface and is uniform over the entire area in the extending direction of the partition plate.

According to a fourteenth aspect, the thickness of the partition plate protruding portion in a normal direction to the end surface of the partition plate protruding portion is equal to or less than a thickness of the partition plate main body portion in a normal direction to a surface of the partition plate main body portion.

According to this, the height of the partition plate end surface can be increased while suppressing the increase in the thickness of the partition plate as compared with case where the partition plate is composed of only the partition plate main body portion. The thicker the thickness of the resin molded product, the longer the cooling time during resin molding. Therefore, according to this, it is possible to suppress an increase in the cooling time while the partition plate is molded with resin.

According to a fifteenth aspect, a centrifugal blower includes a centrifugal fan, a separation cylinder, and a fan casing. The centrifugal fan has a separation plate. The fan casing has a partition plate. The separation plate has an inner end surface and an outer end surface. The separation cylinder has a separation cylinder end surface. The partition plate has a partition plate end surface. A height of one of the separation cylinder end surface and the inner end surface in the axial direction is larger than a height of the other of the separation cylinder end surface and the inner end surface in the axial direction. A height of one of the partition plate end surface and the outer end surface in the axial direction is larger than a height of the other of the partition plate end surface and the outer end surface in the axial direction.

According to a sixteenth aspect, the height of the inner end surface in the axial direction is larger than the height of the separation cylinder end surface in the axial direction. The height of the outer end surface in the axial direction is larger than the height of the partition plate end surface in the axial direction. The sixteenth aspect can be adopted in the fifteenth aspect.

According to a seventeenth aspect, the separation plate includes a separation plate main body portion, an inner protruding portion, and an outer protruding portion. The separation plate main body portion extends outward from the inner side in the radial direction. The inner protruding portion protrudes toward at least one of the one side and the other side in the axial direction from an inner portion of the separation plate main body portion in the radial direction. The inner portion includes an inner end of the separation plate in the radial direction. The outer protruding portion protrudes toward at least one of the one side and the other side in the axial direction from an outer portion of the separation plate main body portion in the radial direction. The outer portion includes an outer end of the separation plate in the radial direction. The inner end surface includes an inner end surface of the separation plate main body portion in the radial direction and an inner end surface of the inner protruding portion. The outer end surface includes an outer end surface of the separation plate main body portion in the radial direction and an outer end surface of the outer protruding portion in the radial direction.

According to this, the thickness of the separation plate which is composed only of the separation plate main body portion is thinner than the height of the inner end surface and the height of the outer end surface. Therefore, the material required for forming the separation plate is reduced as compared with case where the thickness of the separation plate is the same as the height of the inner end surface or the outer end surface and is uniform over the entire area in the extending direction of the separation plate.

According to an eighteenth aspect, the thickness of the inner protruding portion in a normal direction to the end surface of the inner protruding portion is equal to or less than a thickness of the separation plate main body portion in a normal direction to a surface of the separation plate main body portion. The thickness of the outer protruding portion in a normal direction to the end surface of the outer protruding portion is equal to or less than the thickness of the separation plate main body portion.

According to this, the height of the inner end surface and the height of the outer end surface can be increased while suppressing the increase in the thickness of the separation plate as compared with case where the separation plate is composed of only the separation plate main body portion. The thicker the thickness of the resin molded product, the longer the cooling time during resin molding. Therefore, according to this, it is possible to suppress an increase in the cooling time while the separation plate is molded with resin.

What is claimed is:

1. A centrifugal blower comprising:

a centrifugal fan having a plurality of blades disposed about a fan axis, to blow out air drawn from one side in an axial direction of the fan axis outward in a radial direction; and a separation cylinder disposed inward of the plurality of blades in the radial direction of the centrifugal fan, and having an opening portion in both sides in the axial direction, in a tubular shape expanding in the radial direction as extended from the one side in the axial direction toward an end on the other side in the axial direction, to separate an air flow directed toward the centrifugal fan into two air flows, wherein the centrifugal fan has a separation plate provided to intersect each of the plurality of blades and shaped to extend outward from an inner side in the radial direction, to blow out the two air flows separated by the separation cylinder from the centrifugal fan in a state in which the two air flows are separated as air flowing through the one side in the axial direction and air flowing through the other side in the axial direction, the separation plate has an inner end surface extending from the one side to the other side in the axial direction at a position of an inner end in the radial direction, the separation cylinder has a separation cylinder end surface extending from the one side to the other side in the axial direction at a position of an end on the other side in the axial direction, a height of one of the separation cylinder end surface and the inner end surface in the axial direction is larger than a height of the other of the separation cylinder end surface and the inner end surface in the axial direction, and the height of the separation cylinder end surface in the axial direction is larger than the height of the inner end surface in the axial direction.

2. The centrifugal blower according to claim 1, wherein the separation cylinder includes a separation cylinder main body portion that extends from the one side toward the end on the other side in the axial direction and extends to be located outward in the radial direction as extended toward the end on the other side of the axial direction, and a separation cylinder protruding portion that protrudes toward at least one of the one side and the other side in the axial direction from an outer portion of the separation cylinder main body portion in the radial direction including an outer end of the separation cylinder in the radial direction, and the separation cylinder end surface includes an outer end surface of the separation cylinder main body portion in the radial direction and an outer end surface of the separation cylinder protruding portion in the radial direction.

3. The centrifugal blower according to claim 2, wherein a thickness of the separation cylinder protruding portion in a normal direction to the end surface of the separation cylinder protruding portion is equal to or less than a thickness of the separation cylinder main body portion in the normal direction to a surface of the separation cylinder main body portion.

4. The centrifugal blower according to claim 1, wherein the height of the inner end surface in the axial direction is larger than the height of the separation cylinder end surface in the axial direction.

5. A centrifugal blower comprising:

a centrifugal fan having a plurality of blades disposed about a fan axis, to blow out air drawn from one side in an axial direction of the fan axis outward in a radial direction; and a separation cylinder disposed inward of the plurality of blades in the radial direction of the centrifugal fan, and having an opening portion in both sides in the axial direction, in a tubular shape expanding in the radial direction as extended from the one side in the axial direction toward an end on the other side in the axial direction, to separate an air flow directed toward the centrifugal fan into two air flows, wherein the centrifugal fan has a separation plate provided to intersect each of the plurality of blades and shaped to extend outward from an inner side in the radial direction, to blow out the two air flows are separated as air flowing through the one side in the axial direction and air flowing through the other side in the axial direction, the separation plate has an inner end surface extending from the one side to the other side in the axial direction at a position of an inner end in the radial direction, the separation cylinder has a separation cylinder end surface extending from the one side to the other side in the axial direction at a position of an end on the other side in the axial direction, a height of one of the separation cylinder end surface and the inner end surface in the axial direction is larger than a height of the other of the separation cylinder end surface and the inner end surface in the axial direction, the height of the inner end surface in the axial direction is larger than the height of the separation cylinder end surface in the axial direction, the separation plate includes a separation plate main body portion that extends outward from the inner side in the radial direction, and an inner protruding portion that protrudes toward at least one of the one side and the other side in the axial direction from an inner portion of the separation plate main body portion in the radial direction including an inner end of the separation plate in the radial direction, and the inner end surface includes an inner end surface of the separation plate main body portion in the radial direction and an inner end surface of the inner protruding portion in the radial direction.

6. The centrifugal blower according to claim 5, wherein a thickness of the inner protruding portion in a normal direction to the end surface of the inner protruding portion is equal to or less than a thickness of the separation plate main body portion in a normal direction to a surface of the separation plate main body portion.

7. The centrifugal blower according to claim 5, wherein the inner protruding portion protrudes toward at least one of the one side or the other side in the axial direction from the inner end of the separation plate in the radial direction.

8. The centrifugal blower according to claim 5, wherein the inner protruding portion protrudes toward both of the one side and the other side in the axial direction from the inner end of the separation plate in the radial direction.

9. A centrifugal blower comprising:

a centrifugal fan having a plurality of blades disposed about a fan axis, to blow out air drawn from one side in an axial direction of the fan axis outward in a radial direction; and a separation cylinder disposed inward of the plurality of blades in the radial direction of the centrifugal fan and having an opening portion in both sides in the axial direction, in a tubular shape expanding in the radial direction as extended from the one side in the axial direction toward an end on the other side in the axial direction, to separate an air flow directed toward the centrifugal fan into two air flows, wherein the centrifugal fan has a separation plate provided to intersect each of the plurality of blades and shaped to extend outward from an inner side in the radial direction, to blow out the two air flows separated by the separation cylinder from the centrifugal fan in a state in which the two air flows are separated as air flowing through the one side in the axial direction and air flowing through the other side in the axial direction, the separation cylinder has a separation cylinder edge located in a periphery of the opening portion on the other side in the axial direction and includes an outer end of the separation cylinder in the radial direction, the separation plate has an inner edge that includes an inner end of the separation plate in the radial direction, and a height of the separation cylinder edge in the axial direction is larger than a height of the inner edge in the axial direction.

* * * * *